United States Patent [19]

Sahasrabudhe et al.

[11] Patent Number: 4,566,067

[45] Date of Patent: Jan. 21, 1986

[54] SPEED CONTROL APPARATUS AND METHOD FOR RAPID TRANSIT VEHICLES

[75] Inventors: Arun P. Sahasrabudhe, West Mifflin; Robert J. DiSilvestro, Monroeville, both of Pa.

[73] Assignee: Westinghouse Electric Corp., Pittsburgh, Pa.

[21] Appl. No.: 489,989

[22] Filed: Apr. 29, 1983

[51] Int. Cl.[4] ..... G06F 15/50; B61L 3/20; B61L 3/06

[52] U.S. Cl. ..... 364/426; 364/436

[58] Field of Search ..... 364/424, 426, 436

[56] References Cited

U.S. PATENT DOCUMENTS

| | | | |
|---|---|---|---|
| 3,218,537 | 11/1965 | Stamm | 318/274 |
| 3,305,712 | 2/1967 | Hoffman | 318/63 |
| 3,324,373 | 6/1967 | Stamm | 318/274 |
| 4,217,643 | 8/1980 | Anderson et al. | 364/426 |
| 4,270,716 | 6/1981 | Anderson | 364/426 X |
| 4,282,466 | 8/1981 | Matty | 318/434 |
| 4,410,154 | 10/1983 | Matty | 364/426 X |
| 4,459,668 | 7/1984 | Inoue et al. | 364/426 |

OTHER PUBLICATIONS

Krings B. J., Alternative Systems for Rapid-Transit Propulsion and Electrical Braking, Westinghouse Engineer Mar. 1973, vol. 33, No. 2, pp. 34–41.

Hillman et al., The Washington Metro Automatic Train Supervision System, ASME Publication 73-ICT-79, Sep. 1973, Intersociety Committee on Transportation Conference.

Greenway et al., Automatic Train Control and Communications for Washington Metro, Communications Society IEEE, Nov. 1974, pp. 14–21 and 30.

*Primary Examiner*—Felix D. Gruber

*Attorney, Agent, or Firm*—R. G. Brodahl

[57] ABSTRACT

There is disclosed a transit vehicle speed control apparatus and method operative to control the speed of the vehicle in relation to the lowest one of an input command speed limit and a program stop speed limit by determining the time period required for the vehicle speed to change from a present speed to a predetermined speed band limit in relation to each of the acceleration of the vehicle and the response delay time of the vehicle in accordance with the propulsion motor characteristics and the vehicle mass.

10 Claims, 30 Drawing Figures

BAND

1100
FPS=0
N
FPS=1
Y
Y
N
1102
ACC ≥0
N
Y
1108
1106
PVEC=
DACC(2*TRNLN)
PVEC=
PACC(2*TRNLN)
DEFAULT FPS=2
PVEC=PSDC(2*TRNLN)
PVEC=
PSAC(2*TRNLN)
BDEC
BACC
1110
1106
STTL=
SPD-SPLMT+LWM
STTL=
SPLMT-UPM-SPD
1112
CALC
CNT=0
LP
1114
N
CARRY
SET
SHIFT
PVEC RIGHT
Y
1116
TTRAN(2*CNT)=0
CALL TLL
SKIP
CNT=CNT+1
CNT=
NSTAT
N
Y

SPEED CONTROL APPARATUS AND METHOD FOR RAPID TRANSIT VEHICLES

BACKGROUND OF THE INVENTION

Rapid transit vehicles employing cam type propulsion control units present several problems for the automatic speed control of those transit vehicles. The discrete states or levels of tractive effort inherent in cam propulsion systems and the inability to command certain state to state transistions are somewhat incompatible with microprocessor based continuous type speed control systems such as described in U.S. Pat. No. 4,282,466 of T. C. Matty and entitled Transit Vehicle Motor Effort Control Apparatus and Method in relation to a chopper propulsion motor control system. Furthermore the cam state to state transition delay times and the increased equipment wear resulting from decreases in both positive and negative tractive effort present difficulties for the speed control apparatus and method.

It is desired for the Washington Metropolitan Area Transit Authority (WMATA) to provide an improved speed control apparatus and method responding to two primary control criteria, namely the vehicle speed has to be maintained within a predetermined speed band, such as a plus zero to minus four mile per hour speed band, relative to the commanded vehicle speed, and the number of adverse state changes has to be kept below six changes per minute. An adverse state change is defined as a decrease in either positive or negative tractive effort. Decreases in tractive effort are obtained in cam propulsion apparatus by opening resistor shorting switches. Since this action severely stresses these switches, the adverse change restriction is intended to reduce wear on the propulsion equipment and therefore extend equipment life. The previous automatic train speed control equipment controlling the cam propulsion units for the WMATA transit vehicles requests more than six adverse state changes per minute.

The previous WMATA train control apparatus includes twelve train lines over which the propulsion equipment and the ATC equipment communicate. There are ten specific propulsion train line patterns and five specific brake train line patterns in addition to a coast train line pattern which can be selected by the ATC equipment. These sixteen train line patterns, corresponding to sixteen states of the propulsion system operation, provide sixteen different levels of positive and negative tractive effort. WMATA, however, only uses fourteen of these states and only fourteen will be considered hereafter, since two propulsion states are not used. The adverse change limitation on train state transitions applies to changes in the train line pattern outputted by the ATC equipment.

The problem of speed maintaining within a four mile per hour band is not particularly difficult. A prior art proportional or proportional plus integral controller will successfully maintain speed with some modification to account for closed loop stability and certain unavailable state transitions while attempting to decrease tractive effort while in propulsion. This approach however results in more adverse state changes than desired.

A speed control approach simulating an ideal human operator is appropriate. An ideal human operator observes the train speed relative to the speed control band, and approximates the train acceleration in relation to forthcoming track conditions. He understands the undesirable effects of adverse state changes and therefore acts to minimize them. If he is speed maintaining low in the speed band and accelerating slightly he would take no action at that time. If on the other hand he were decelerating while low in the speed maintaining band he would transfer to a state providing more tractive effort. In addition he would not overreact, but would wait out the train delays to see the effect of the state transitions. Furthermore if a decrease in tractive or retarding effort were required he might transfer to a state sufficiently removed from the present state to assure that sufficient reduction occurs in an effort to reduce the number of adverse state transitions. A return to the coast state in this example would reverse the acceleration or deceleration under most conditions and result in the fewest adverse transitions. In this manner by monitoring speed, acceleration and the speed band while being aware of train delays, adverse transitions, and track conditions, an ideal human properly controls train performance. In addition there is a learning process that a human operator undergoes to improve his decision making ability with experience.

SUMMARY OF THE INVENTION

A speed control apparatus and method are provided for a transit vehicle, wherein a vehicle time to limit, defined as the time for speed to change from a present speed to a speed band limit, is provided as the difference between a predetermined speed band limit and the vehicle speed divided by the vehicle acceleration. This time to limit is compared with a determined vehicle response delay time for controlling when a transition from the present tractive effort state to a new tractive effort state takes place. The implementation of this speed control apparatus and method is through matrix mathematics.

DESCRIPTION OF THE PREFERRED EMBODIMENT

Figure 1:
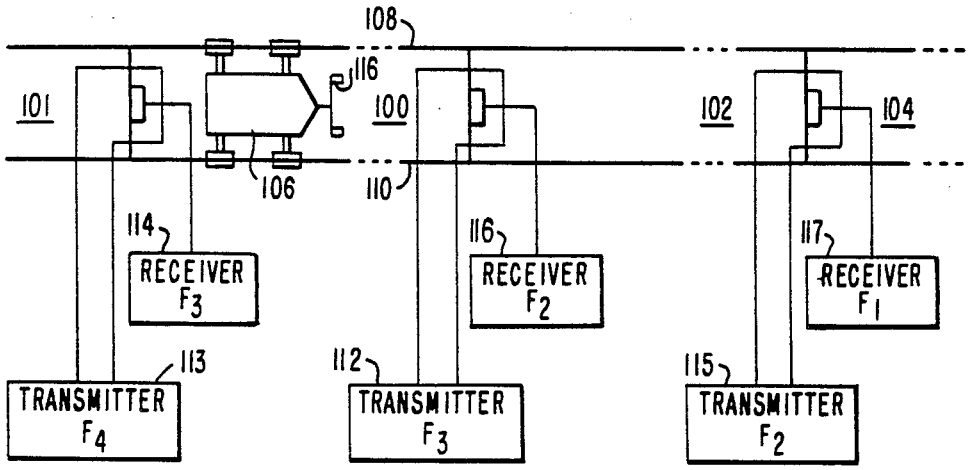
FIG. 1 PRIOR ART
FIG. 1 shows a prior art track signal block arrangement for controlling the operation of a transit vehicle.

In FIG. 1 there is shown a prior art transit vehicle control signal block arrangement whereby respective desired command speed signals are transmitted to each of successive track signal blocks 100, 102, 104, and so forth. A transit vehicle 106 is shown within the signal block 100 as it moves along the track rails 108 and 110. The vehicle 106 will electrically short circuit and prevent the command speed signal from transmitter 112 from reaching the associated signal receiver 114 for the purpose of detecting that the vehicle 106 occupies the signal block 100. The transmitter 113 is similarly operative with previous signal block 101, the transmitter 115 and receiver 116 are similarly operative with signal block 102, and the receiver 117 is similarly operative with signal block 104.

Figure 2:
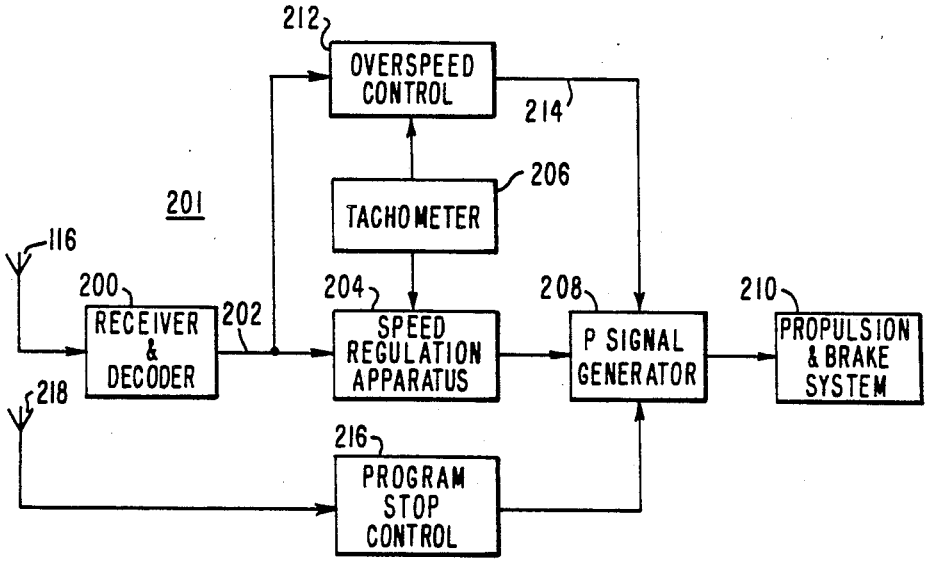
FIG. 2 PRIOR ART
FIG. 2 shows a prior art vehicle carried speed control apparatus for determining the movement speed of a transit vehicle along a roadway track.

In FIG. 2 there is shown a prior art speed control apparatus 201 carried by the transit vehicle 106 of FIG. 1. The speed control apparatus 201 determines the movement speed of the transit vehicle 106 along the track rails 108 and 110. Each signal block has an input command speed signal, and the track signal antennas 116 carried by the vehicle 106 as shown in FIG. 1 provides this input command speed signal to a receiver and decoder 200, which provides the input command speed at output 202. The speed regulation apparatus 204 compares the input command speed from output 202 with the vehicle actual speed from tachometer 206 for providing a speed error to the P signal generator 208, which then provides a tractive effort request P signal to the propulsion and brake system 210 for controlling the propulsion and the brake operation of the vehicle. A safety overspeed control 212 responds to the input command speed at output 202 and compares it in a failsafe manner with the vehicle actual speed from the tachometer 206 for providing an enable signal 214, which enables the P signal generator 208 to respond to the speed error from the speed regulation apparatus 204. A program stop control 216 responds to program stop control signals, provided from suitable wayside marker devices or a transposed cable positioned along the roadway track adjacent to a signal station, and sensed by a vehicle carried antenna 218 for determining the operation of the P signal generator 208 to control the program stop speed of the transit vehicle and thereby the stopping position of the vehicle in relation to the passenger station.

Figure 3:
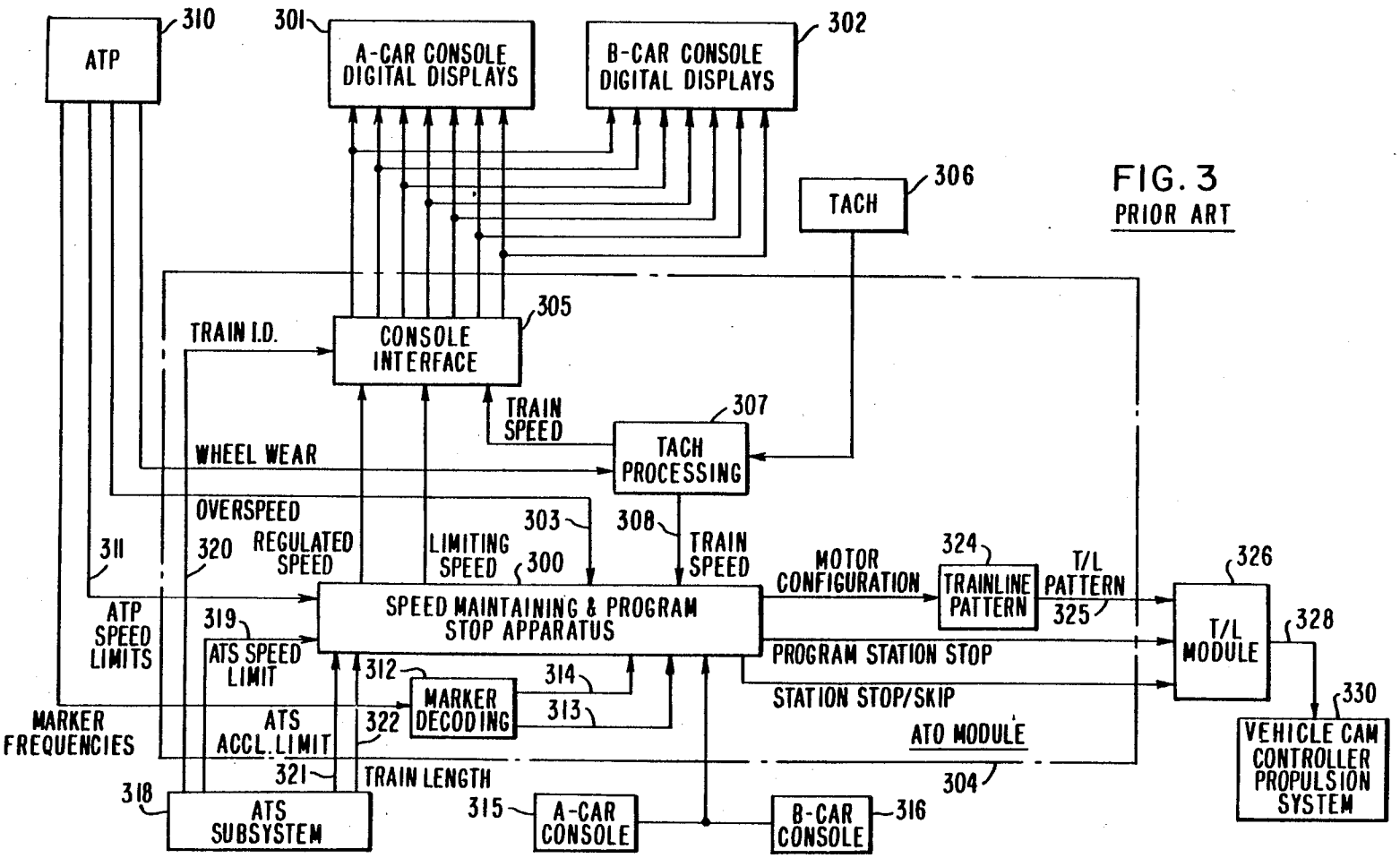
FIG. 3 PRIOR ART
FIG. 3 shows a block diagram of the prior art cam propulsion control apparatus that has been operational for several years with the WMATA transit system in Washington DC.

In FIG. 3 there is shown the prior art speed control apparatus presently in operation at the Washington Metropolitan Area Transit Authority (WMATA) transit system in Washington DC, and which includes a speed maintaining and program station stop speed control apparatus 300 operative with the transit cars provided on that system. The A and B cars include respective operator's console displays 301 and 302 operative with a console interface 305, and which indicate the train number, the train destination, train length, the regulated speed, the limiting speed, the actual speed and other data. The display in the lead car is driven by the ATO or automatic train operation module 304. The tachometer 306 provides an actual vehicle speed input signal 308 through the tachometer signal processing apparatus 307. The automatic train protection or ATP equipment 310 provides an input command speed signal 311 from the track signal block occupied by the train. The train grade from a wayside grade marker and a programmed stop speed limit from a wayside program stop marker when the train is approaching a passenger station are supplied to the marker decoding apparatus 312, which operates to decode and provide the grade signal 313 and the program stop speed limit signal 314. Respective operator's consoles 301 and 315, and 302 and 316 are provided in the A and B transit cars, with the operator being located in the lead car of the train. The ATS or automatic train supervision subsystem 318 provides a performance speed limit 319 that can be reduced below the ATC command speed to effect a performance modification because of bad weather or track conditions that require restricted operation of the train, provides a train I.D. signal 320, a one-half power acceleration limit 321 and a train length signal 322. The train line pattern apparatus 324 provides binary voltages on respective train lines for providing a desired one of the available states of power or brake operation, with there being available eight different power states, five different brake states and a coast state for this purpose. There are two WMATA propulsion states, switch 1 and switch 2, shown as states $\frac{1}{3}$ and $\frac{2}{3}$ of FIG. 20, that are also available but not used by WMATA. The train line module 326 includes relay devices that provide adequate current handling capability to energize the train lines 328 leading to the vehicle cam controller propulsion apparatus 330 in each car of the train. The control apparatus shown in FIG. 3 is provided in each A car, and is operative in the lead car of the train for controlling the propulsion system 330 in each car of the train through the train line 328 which passes through the train and couples with the propulsion system 330 in each car of that train.

Figure 4:
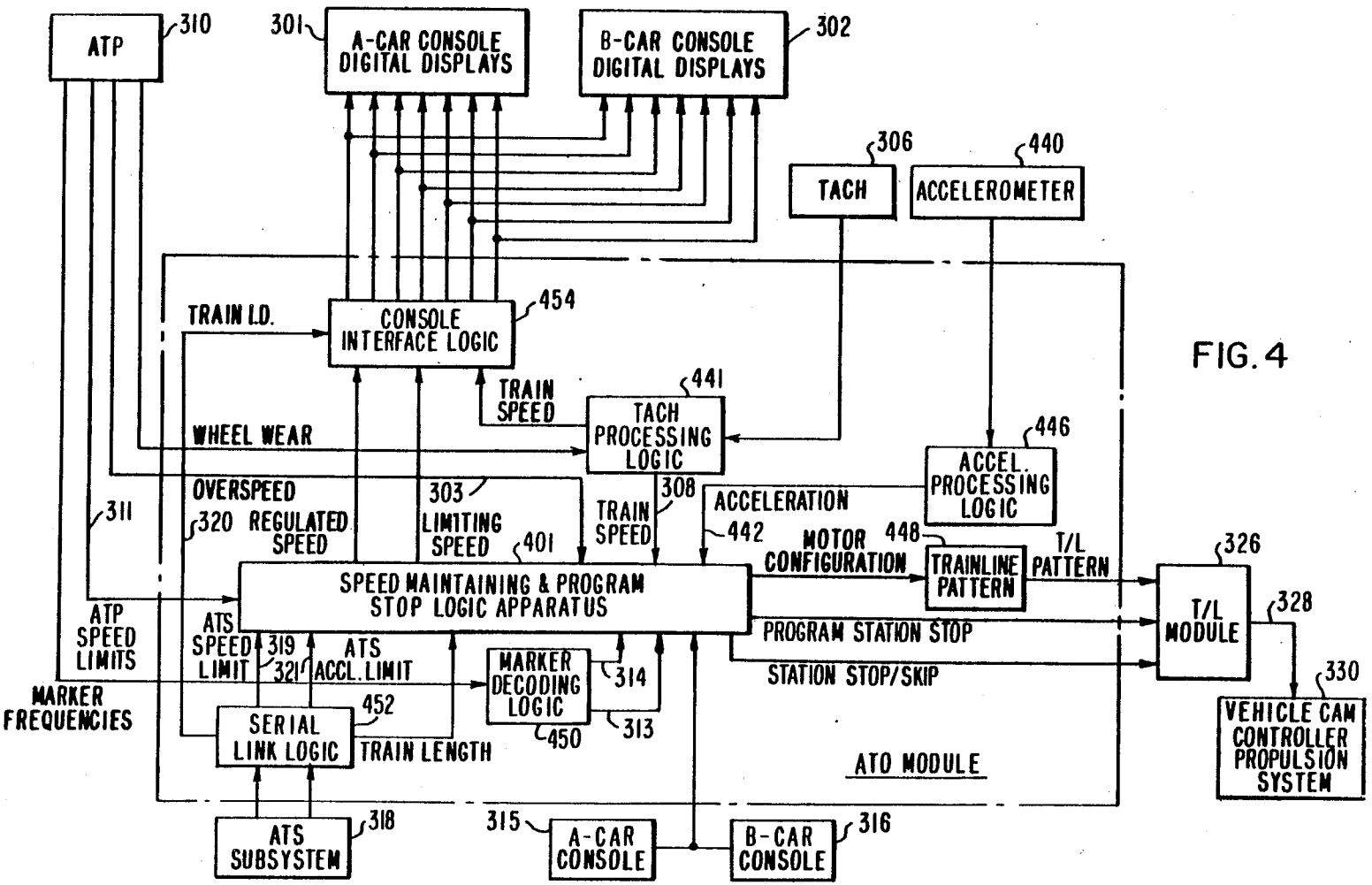
FIG. 4 shows a block diagram of the improved cam propulsion control system of the present invention.

In FIG. 4 there is shown the improved cam propulsion speed control system of the present invention, including a programmed microprocessor based speed maintaining and program stop logic apparatus 401. A weighted pendulum balance accelerometer 440 provides an acceleration indication signal. The elements shown in FIG. 4 that are common with FIG. 3 have been given the same reference numbers. The provision of the tachometer signal processing logic 441, the acceleration signal processing logic 446, the train line pattern logic 448, the marker decoding logic 450 and the serial link logic 452 is believed to be within the routine understanding of persons having ordinary skill in this art, and the functional operations of these logic devices are not unique to this application.

In general the time period required for the train vehicle to change from a present speed to a speed band limit is called the time to limit. The time period required for the train vehicle to respond to and provide a new requested tractive effort state is the delay time and is a function of the cam controller operation, the control system response, the propulsion motor operation in relation to the known motor curves, the mass of the train and so forth. A change of state will be made when the time to limit is determined to be equal or less than the delay time of the train.

The vehicle carried ATP or automatic train protection system responds to the track signal provided command speed for controlling the actual speed of the train to be within a desired speed band, such as a plus zero to minus four miles per hour band relative to that command speed. In addition there is an ATS system that provides an additional speed limit for each section of the roadway track. The speed maintaining control system responds to the lower of the ATP command speed limit and the ATS speed limit. When a program stop signal is provided in relation to a passenger station, the speed maintaining control system responds to the lowest of these three signals as the velocity reference signal.

A grade indicating marker is provided in the WMATA system in relation to each of predetermined portions of the roadway track and furnishes a grade indication signal that is considered to be too inaccurate to be used by the control apparatus and method of the present invention, which determines the grade by differentiating the speed indication signal from the tachometer in an averaging manner to remove noise and comparing this differentiated signal with the accelerometer signal. The previous WMATA control system obtained the grade from the provided marker.

Figure 21:
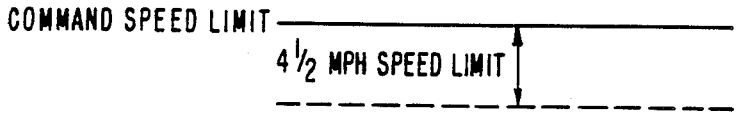
FIG. 21 shows a typical speed band in relation to the command speed limit.

The WMATA train control system operates with a cam controller and includes 12 voltage train lines connected to determine the operation of the propulsion motor control system. Respective binary voltage signals are placed on the train lines to establish a desired control pattern to determine the operation of each vehicle in the train in accordance with a wayside provided command signal. The propulsion equipment provides one of a desired power or a desired brake effort in response to the control pattern of the train line signals. The cam controller on the lead car of each train determines the discrete level of tractive effort for the whole train. It is required that the speed of the train be maintained within a predetermined speed band in relation to the command speed from the roadway track, as shown in FIG. 21. In addition there is a limited number of adverse control changes established, with an adverse change being defined as a decrease in either positive or negative traction effort. To control the train, responses are made to the acceleration of the train from a pendulum accelerometer and the actual speed of the train from a tachometer.

A time to limit determination, when the vehicle is accelerating, is made by establishing the difference between a predetermined speed band limit and the present actual speed of the train, with that difference being divided by the present acceleration of the train, in accordance with the relationship:

$$TTL_A = \frac{\text{Upper Speed Limit (MPH)} - \text{SPEED (MPH)}}{\text{Acceleration (MPHPS)}} \quad (1)$$

This time to limit determination, when the vehicle is decelerating, is made in accordance with the relationship:

$$TTL_D = \frac{\text{Lower Speed Limit (MPH)} - \text{Speed (MPH)}}{\text{Acceleration (MPHPS)}} \quad (2)$$

An assumption is made that the present acceleration will not change substantially in the short period of time, about 100 milliseconds, before the microprocessor next performs this calculation. In addition the delay time required for the train to change from the present tractive effort state to the new tractive effort state is established as a function of where the present operation is located on the known motor curves, the mass of the train, etc. Then a comparison is made of this time to limit and this delay time by subtracting the delay time from the time to limit and for as long as the time to limit is greater than the delay time no state transition change is made in the operation of the cam controller, in accordance with the relationship:

$$TTL - \text{Delay} > 0 \text{ No State Transition} \quad (3)$$
$$TTL - \text{Delay} \leqq 0 \text{ State Transition Occurs} \quad (4)$$

The head end vehicle of the train includes an automatic train protection system or ATP equipment that provides the command speed limit. In addition there is provided an automatic train supervision system or ATS which provides a speed limit that is considered safe for track conditions. The train speed determining cam controller responds to the lower of these two speed limits.

The weighted pendulum balance accelerometer apparatus measures the train acceleration, excluding the effect of track grade. A way to establish the total train acceleration is to differentiate the tachometer measured speed. The result would include the grade, but this calculation is considered too noisy for the desired speed control purpose. Furthermore, the wayside grade markers are too inaccurate to be used in obtaining grade acceleration. Therefore the grade acceleration is computed by differentiating the tachometer output and comparing the result to the accelerometer output and averaging the difference over an 800 millisecond time period. This can be done because the grade does not change very fast. This computed grade acceleration is then added to the instantaneous accelerometer acceleration to obtain the total acceleration. Differentiation of the tachometer output in an averaging manner to directly obtain total acceleration is prohibited due to the rapid changes possible in total acceleration.

A determination is made of all delay times associated with the state-to-state transitions of the train and these are placed in a fourteen by fourteen delay time matrix, (with provision being made for sixteen by sixteen in the microprocessor software). The time to limit calculation is updated ten times a second to determine the present time to limit (TTL). The delay time for a possible state transition is obtained from the delay time matrix and compared with the calculated TTL to see if the quantity TTL minus delay is greater than or equal to zero. When it becomes zero, a state transition is made. To fill a 14×14 decision matrix the 14×14 TTL transition reward matrix is multiplied by a 1×14 probability vector. The control system is designed to benefit by actual operation learning experience. Initially the probability or experience vector will include zeros and ones in its matrix. These could be changed to reflect how likely a particular state is to be chosen in accordance with real time learning experience such as a human operator would receive. The multiplication of matrices is per se a mathematically well known operation, i.e. the multiplication of the reward matrix by the probability vector to provide the next state decision matrix.

Figure 22:
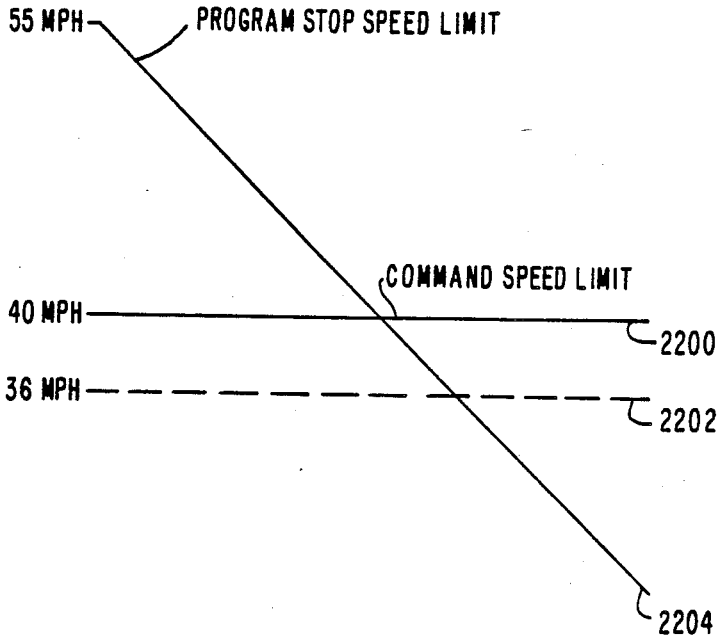
FIG. 22 shows the program stop speed limit crossing the command speed limit in relation to a program stop at a passenger station.

In FIG. 22, for program stop control of the train, and after the first program stop control marker is detected, the cam controller responds to the lowest of the ATS speed limit signal, the ATP command speed limit signal 2200 and the program stop speed limit signal 2204. The desired deceleration for program stop is minus 2 miles per hour per second. This can be implemented by effectively adding two to the determined train acceleration. The time to limit calculation for program stop control, if the train acceleration is above minus two miles per hour per second, then becomes TTL equals upper program stop speed limit minus speed divided by acceleration plus two, in accordance with the relationship:

$$TTL_A = \frac{\text{Upper Program Stop Speed Limit} - \text{Speed}}{\text{Acceleration} + 2} \quad (5)$$

The time to limit calculation for program stop control, when the train acceleration is less than minus two miles per hour per second, then becomes TTL equals lower program stop speed control limit minus speed divided by acceleration plus two in accordance with the relationship:

$$TTL_D = \frac{\text{Lower Program Stop Speed Limit} - \text{Speed}}{\text{Acceleration} + 2} \quad (6)$$

All units of speed are in miles per hour and all units of acceleration are in miles per hour per second.

There are eight power states, one through eight, with the larger number providing more propulsion effort. There are five brake states, nine to thirteen with the higher number providing more brake effort. There is one coast state providing essentially no effort. The grade must be considered, since when in power and going up a positive grade a return to coast or zero propulsion will usually be adequate to control the speed, but when in power and going down a negative grade, a return to coast may not be adequate to slow the train enough to turn the speed around, and a brake state might be required for this purpose.

Figure 5:
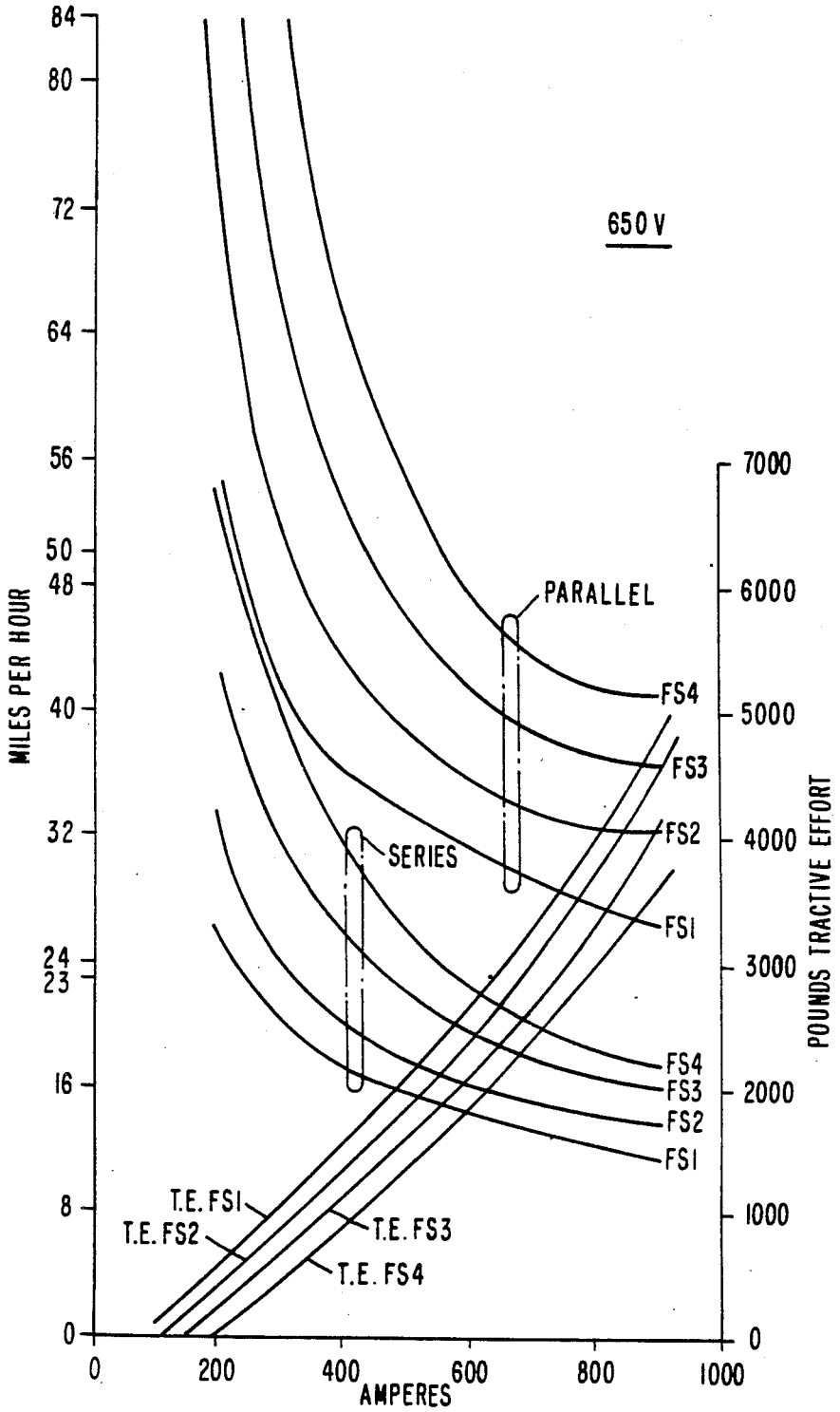
FIG. 5 shows the motor curves for a well known traction motor operating at the system line voltage of 650 volts.

In FIG. 5 there are shown the motor curves for a well known traction motor type 1462A. This traction motor is available at the present time from the Westinghouse Electric Corporation. These motor curves are for this traction motor operating at a system line voltage of 650 volts, and relate to tractive effort as a function of motor current for various speeds of operation. In relation to determining the time delays in the vehicle response to a change in command speed, it is necessary to establish how much time is required to obtain a new tractive effort to provide a transition change to the new command speed. The four lower curves marked FS1, FS2, FS3 and FS4 are for the series operation of the four propulsion motors on each car. The four upper curves marked FS1, FS2, FS3 and FS4 are for the parallel operation of these motors.

Figure 6:
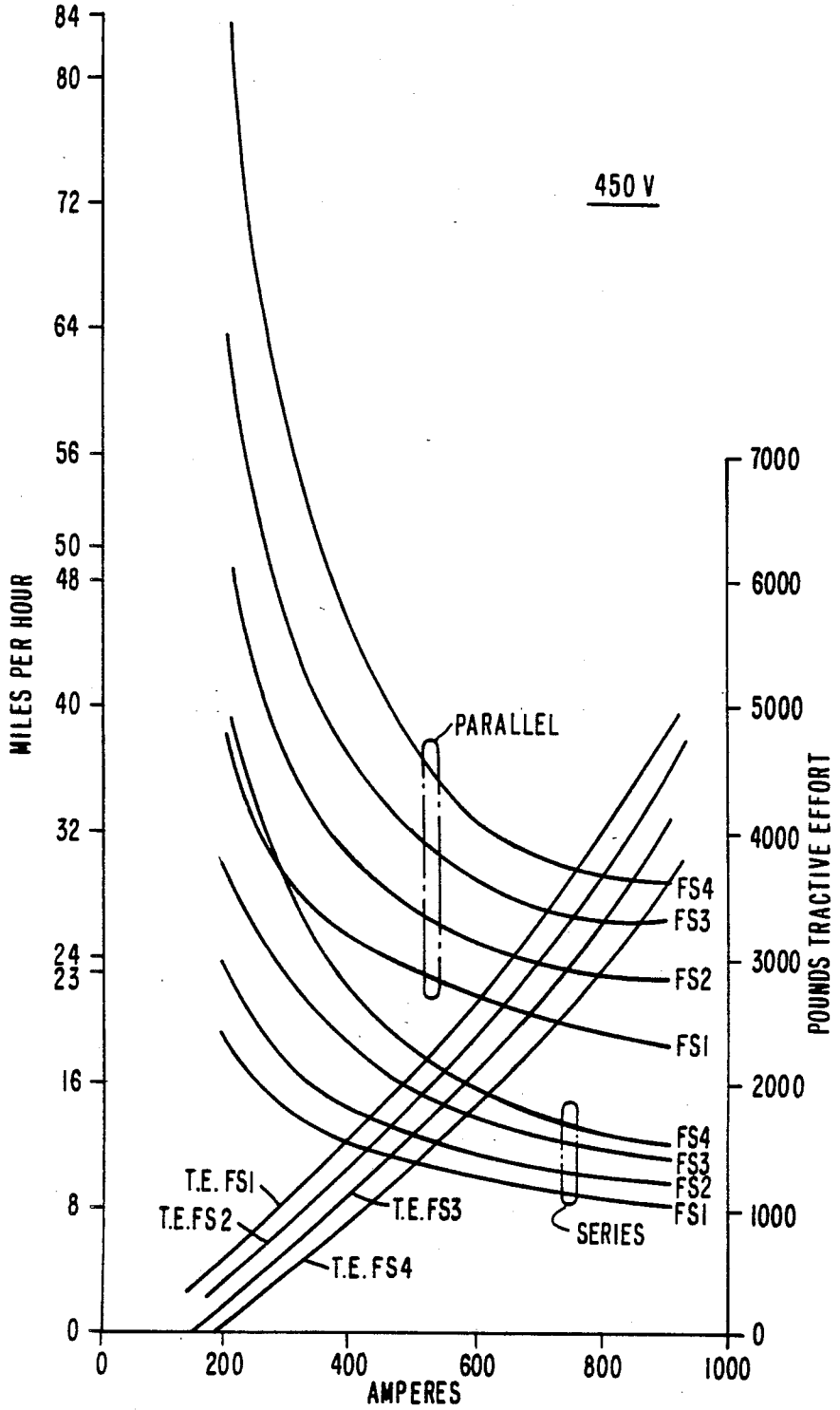
FIG. 6 shows the motor curves for a well known traction motor operating at the lower range line voltage of 455 volts.

In FIG. 6 there are shown the motor curves for the same traction motor operating at a lower range line voltage of 455 volts.

Figure 7:
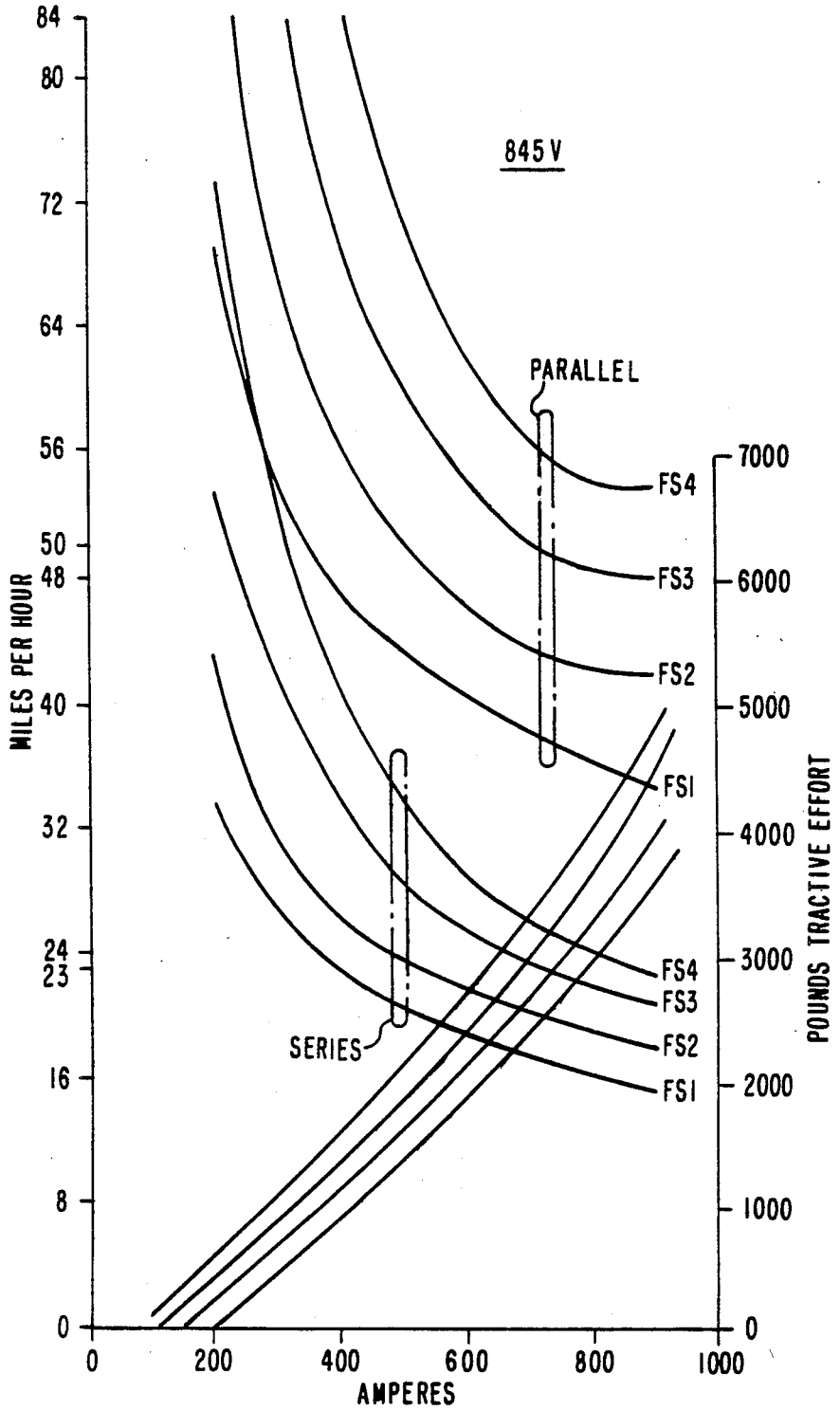
FIG. 7 shows the motor curves for a well known traction motor operating at the higher range line voltage of 845 volts.

In FIG. 7 there are shown the motor curves for the same traction motor operating at an upper range line voltage of 845 volts.

It has been determined that these motor curves can be divided into three bands of speed in relation to the time delay characteristics of the motor operation. Within the lowest speed band of zero to 23 miles per hour, the time delays are reasonably constant. Within the middle speed band of 23 to 50 miles per hour, the time delays are reasonably constant, and within the highest speed band of 50 to 75 miles per hour, the time delays are reasonably constant.

To obtain a tractive effort value for a certain vehicle speed and motor state and line voltage, the first step is to find the vehicle speed on the speed axis then proceed perpendicularly from the speed axis until the desired motor state curve intersects this speed. If the motor state curve does not intersect this speed one of two things is done. If the speed is higher in value than what the motor curve reaches, a nominal value in tractive effort should be assumed. If the curve starts above the desired speed the following formula should be used, the tractive effort equals the mass of the car times the maximum acceleration permitted by the propulsion equipment for the motor state divided by 21.95 miles per hour per second. From the point where the vehicle speed crosses the motor state curve, then proceed parallel to the speed axis until the tractive effort curve for the motor state is reached. If the motor curve is the FS1 curve, go to the tractive effort FS1 curve. If the motor curve is the FS2 curve, use the tractive effort FS2 curve, etc. Once this point is found, go parallel to the line current axis until the tractive effort axis is reached. This is the tractive effort value for that speed and motor state. By reversing this process a given tractive effort and motor state will obtain a vehicle speed. For the WMATA project, multiply the obtained tractive effort by four to give the total tractive effort per car since there are four motors on each car and the tractive effort per car is the sum of these motors.

Figure 8A:
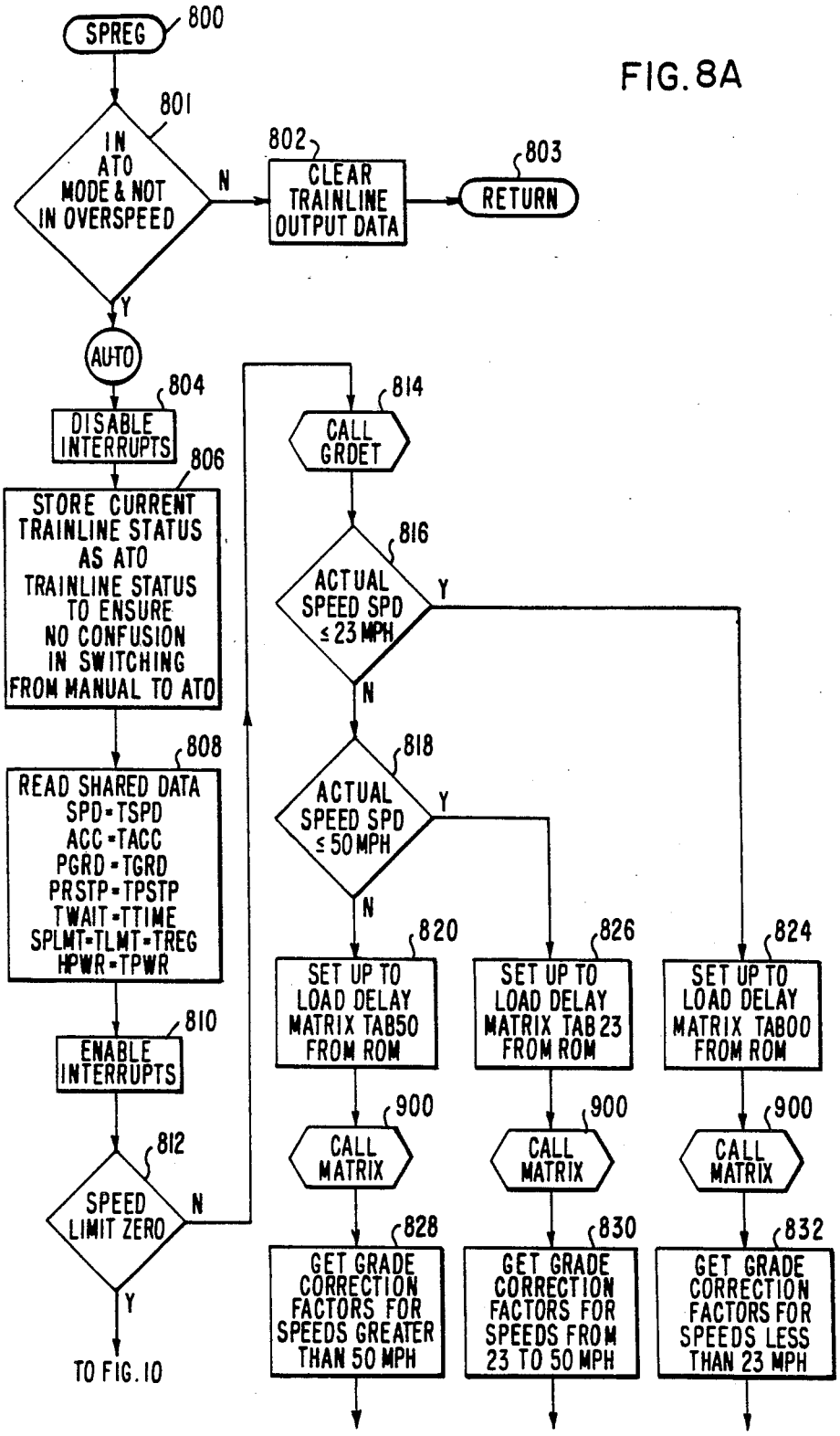
FIGS. 8A and 8B show the speed regulation routine of the present invention.
Figure 8B:
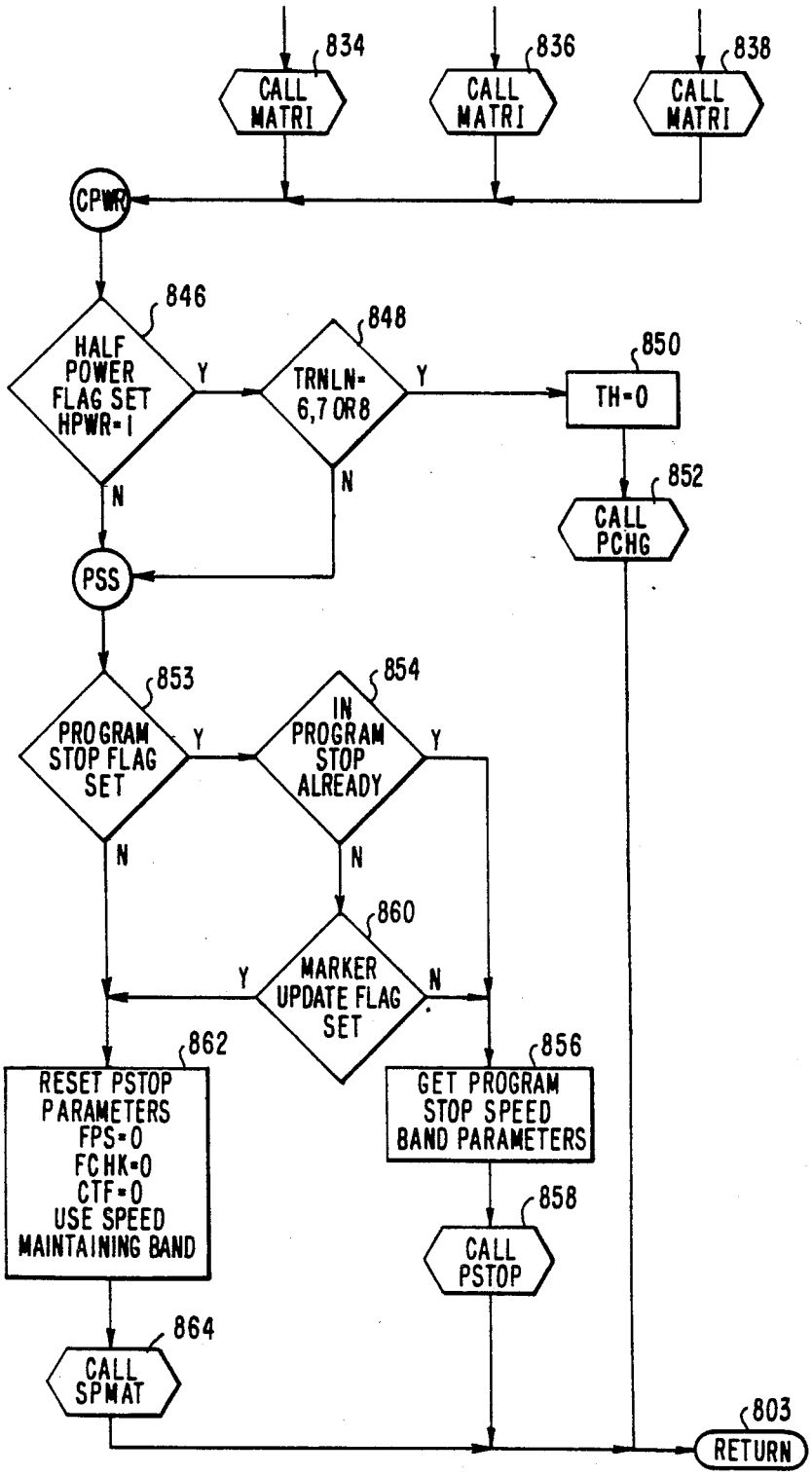
Figure 9:
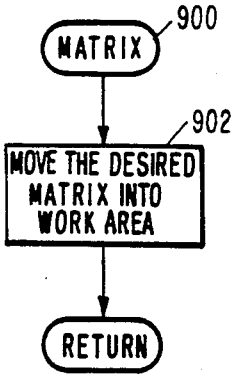
FIG. 9 shows the matrix transfer subroutine of the present invention.
Figure 24:
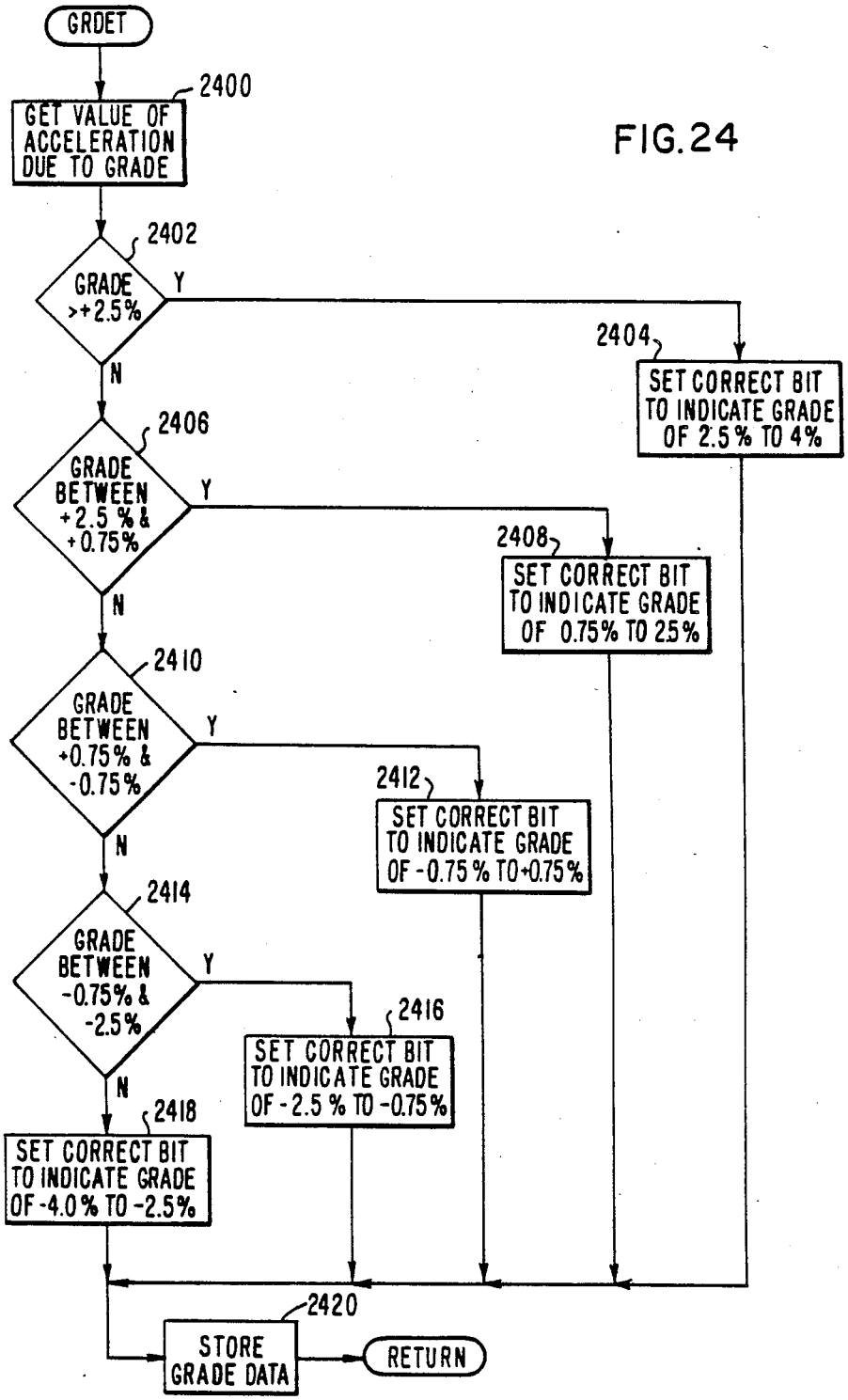
FIG. 24 shows the grade determination routine.

In FIG. 8 there is shown the speed regulation or speed maintaining routine 800. When this routine is called, at step 801 a check is made to see if the train is operating in the ATO mode and not in overspeed. If not, at step 802 the trainline output data is cleared and the routine exits at return 803. If so, at step 804 there interrupts are disabled, and at step 806 the current trainline status is stored as ATO trainline status to ensure no confusion when switching from manual to ATO. At step 808 the desired data are input and placed in memory. The interrupts are again enabled at step 810. At step 812 a check is made to see if the speed limit is zero. If yes, the routine goes to the overspeed control step 1002 of FIG. 10 for requesting full service brakes. If not, at step 814 the grade determination routine of FIG. 24 is called. At step 816 a determination is made to see if the train actual speed SPD is less than or equal to 23 miles per hour, which relates to the lowest speed band shown in FIGS. 5, 6 and 7. Within each of the speed band shown in FIGS. 5, 6 and 7 the delay times are considered to be substantially constant for the purpose of the propulsion control operation for a transit vehicle including a particular type of propulsion control. If the actual speed is not within the lowest band at step 816, at step 818 a check is made to see if the actual speed is within the middle speed band. If the actual speed is not less than or equal to 50 miles per hour, at step 820 a block of delay data starting at tab 50 is loaded from ROM into a work area using the matrix transfer routine 900 shown in FIG. 9, where at step 902 the desired matrix is moved into the work area. If the actual speed is less than or equal to 23 miles per hour, at step 824 a block of delay data starting at tab zero is load from ROM into a work area. If the actual speed is greater than 23 miles per hour and less than or equal to 50 miles per hour, at step 826 a block of delay data starting at tab 23 is loaded from ROM into the work area. This delay data is taken from the appropriate motor curves shown in FIGS. 5, 6 and 7. Now a correction for the actual track grade is begun. The time delays loaded at one of the steps 820, 824 or 826 were based on a substantially level track and are appropriate for that track condition. However the WMATA track system can vary in grade from plus 4% to minus 4%, so suitable grade correction factors are required. At the appropriate one of steps 828, 830 and 832 the grade correction factors for the actual speed range is obtained in conjunction with the entry search routine shown in FIG. 25 at steps 834, 836 or 838.

Figure 13:
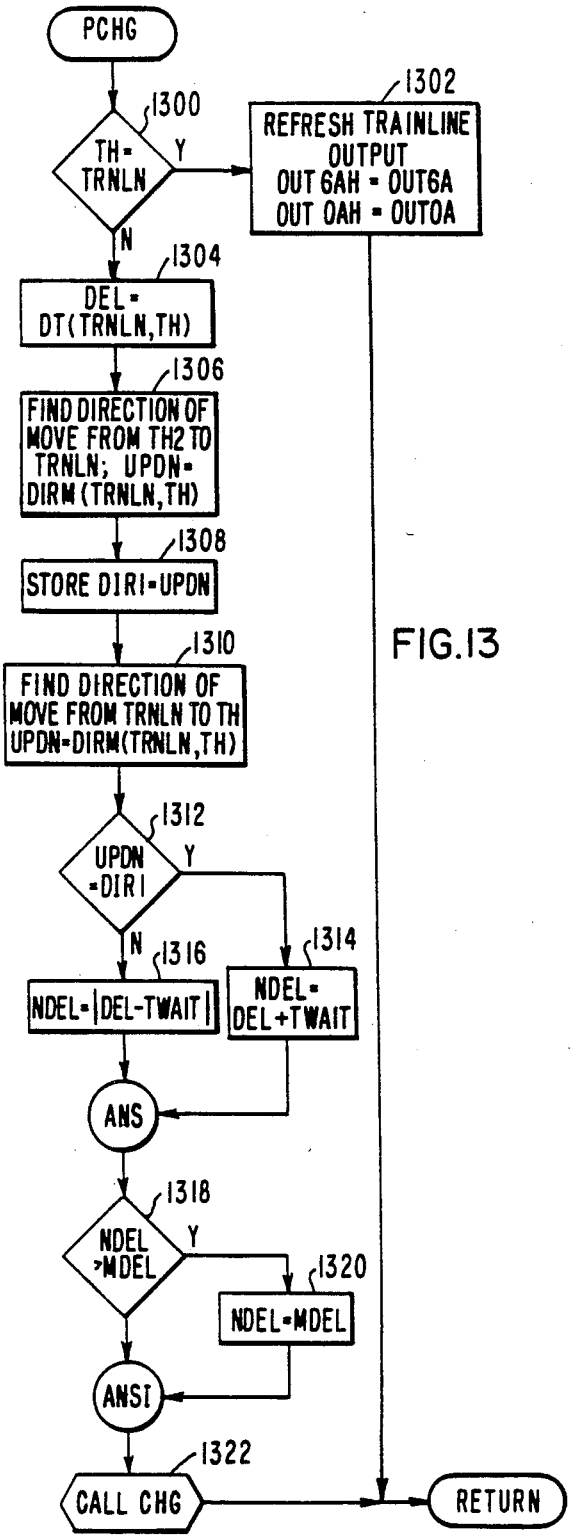
FIG. 13 shows the change states subroutine of the present invention.
Figure 14:
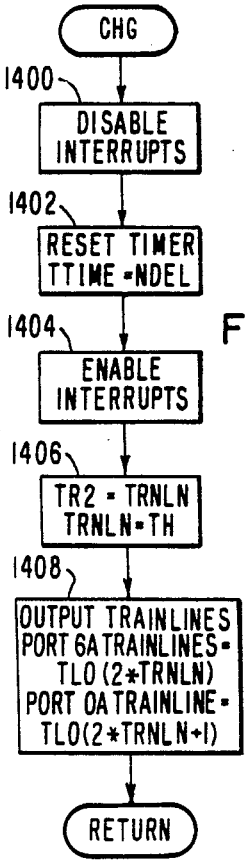
FIG. 14 shows the train line output subroutine of the present invention.
Figure 15A:
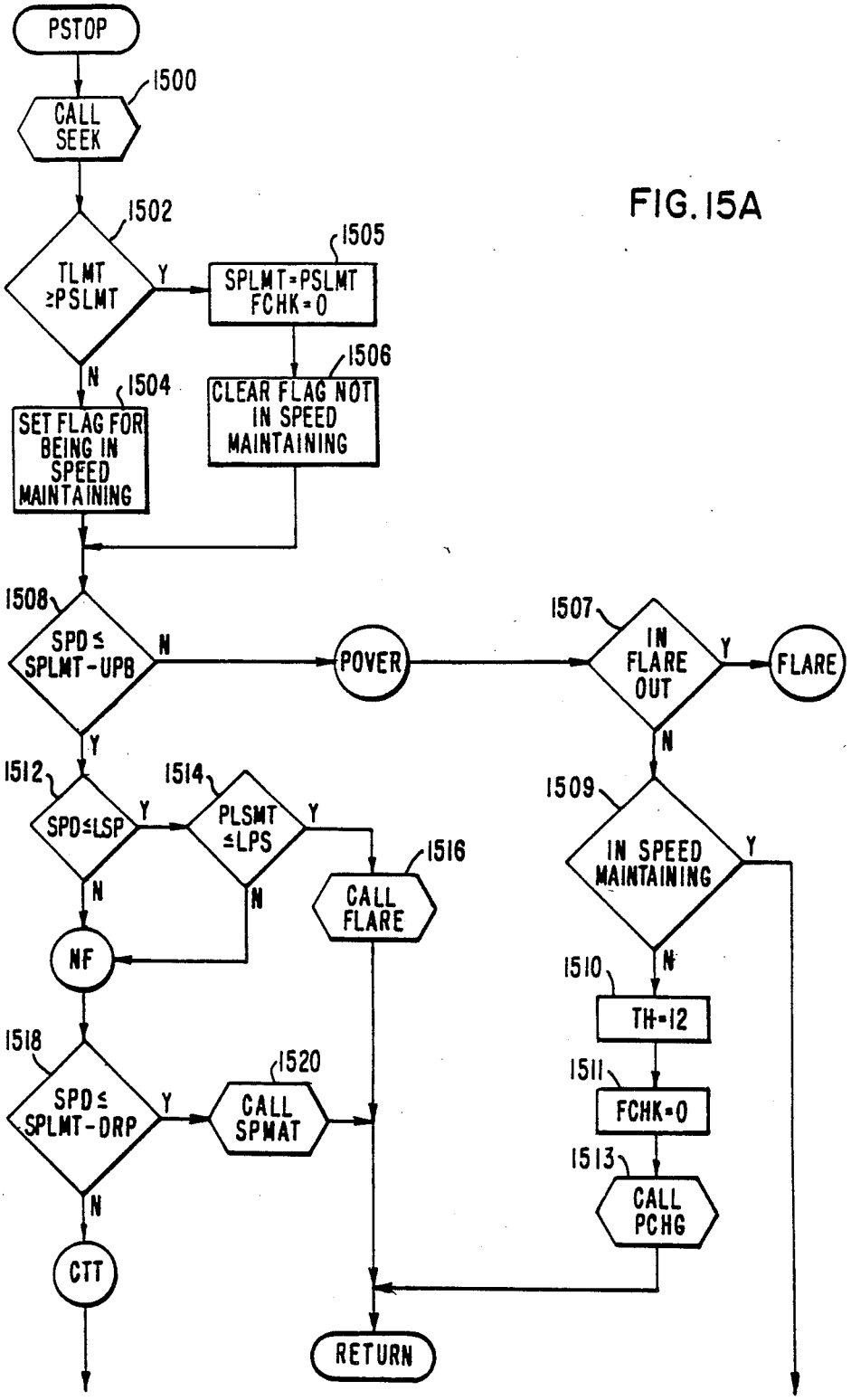
FIGS. 15A and 15B show the program stop subroutine of the present invention.
Figure 15B:
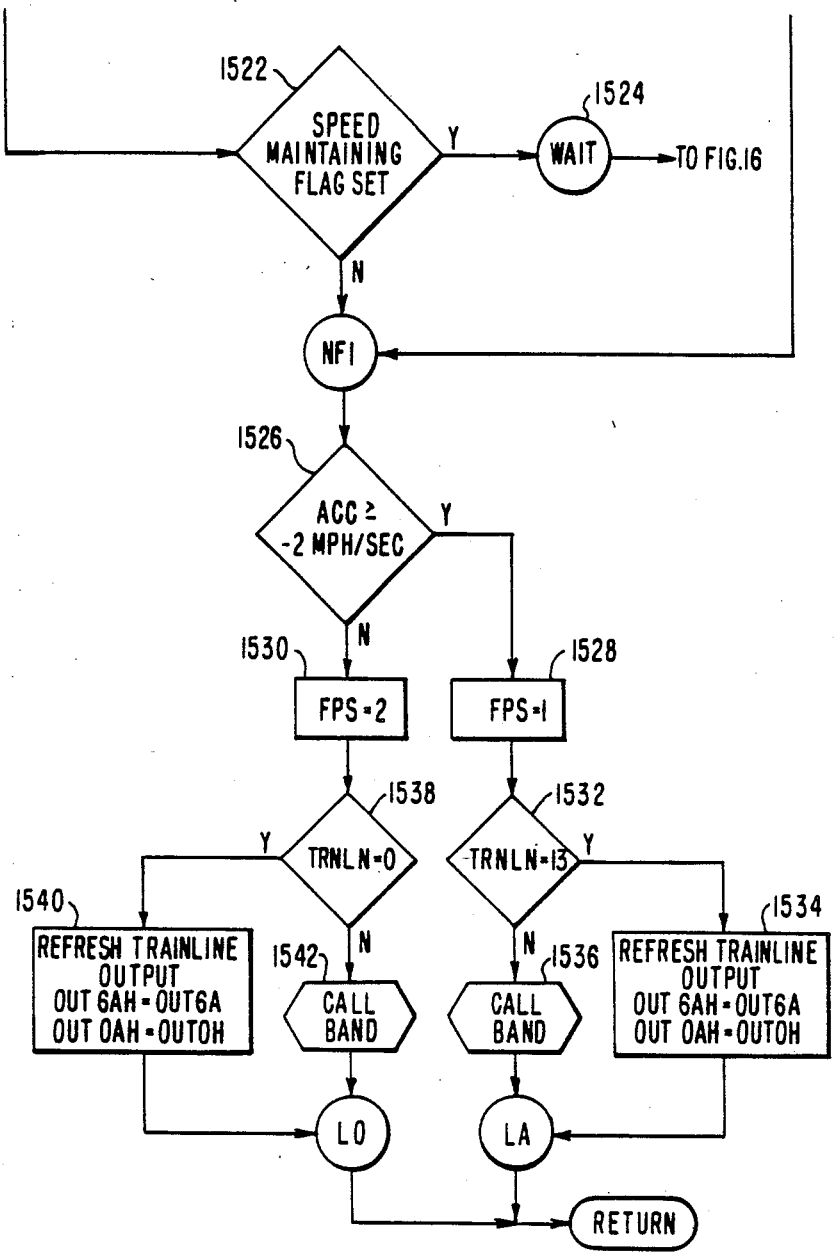

The ATS subsystem 318 shown in FIG. 4 provides a full power or half power flag signal 321 that determines if a 50% limit is placed on the train acceleration. At step 846 in FIG. 8B a check is made to see if this half power flag is set, and if it is then at step 848 a check is made to see if the train line is requesting the three highest levels of power operation that will provide the three miles per hour per second maximum power. If the power state six, seven or eight is requested, at step 850 the state TH is set equal to zero, which is coast. At step 852 the change states subroutine shown in FIG. 13 is called to provide the necessary state changes and the bookkeeping functions. Then the train line output subroutine shown in FIG. 14 is called by the latter subroutine to output the next desired state pattern on line 325 shown in FIG. 4 leading to the cam controller propulsion system 330. The program operates such that the only way to get from power state six, seven or eight into one of the lower power states one, two, three, four or five is by returning to coast, and then to let the speed maintaining operation go to a desired one of the power states one to five. If the half power flag is not set at step 846, at step 853 a check is made to see if the program stop flag is set. If so, at step 854 a check is made to see if the operation is already in program stop. If yes, at step 856 the program stop speed band parameters are obtained, and at step 858 the P stop subroutine shown in FIG. 15 is called. At step 854, if the operation is not already in program stop, at step 860 a check is made to see if the marker update flag is set, and if not the routine goes to step 856. If yes, at step 862 the program stop flags used in a program stop control of a vehicle approaching a passenger station are reset and cleared. At step 864 the speed maintaining subroutine shown in FIG. 10 is called.

Figure 10:
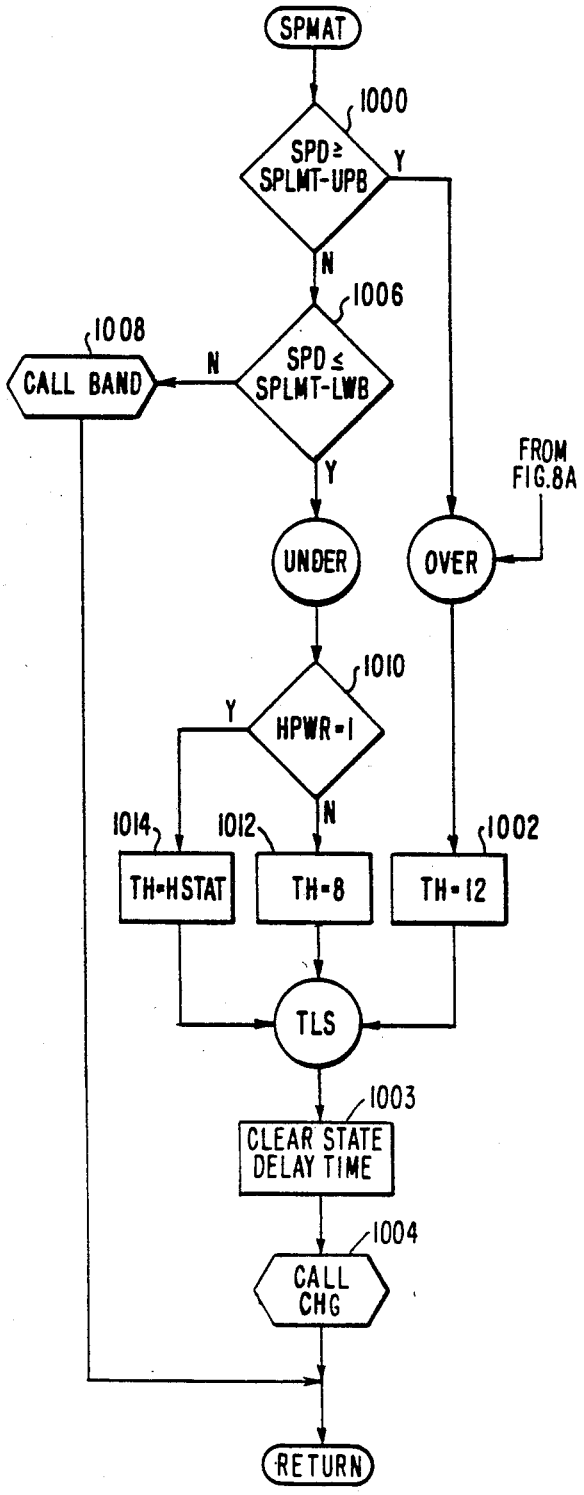
FIG. 10 shows the speed maintaining subroutine of the present invention.
Figure 20:
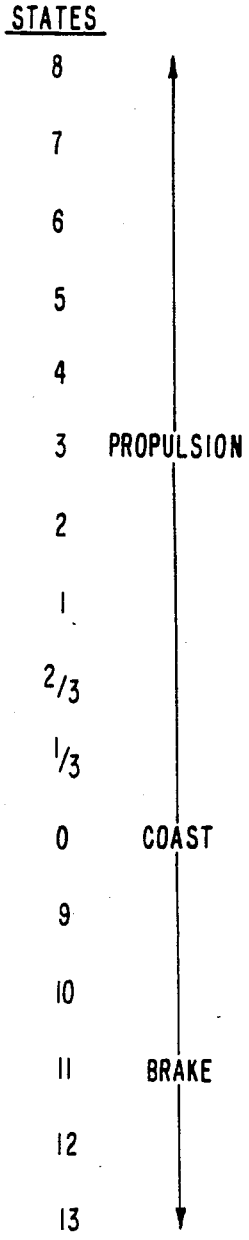
FIG. 20 shows the propulsion, brake and coast transition states of the present invention.

The speed maintaining subroutine shown in FIG. 10 at step 1000 checks to see if the actual train speed is greater than the command speed limit minus a control factor at the top of the speed band. At present this control factor UPB is set at plus zero, but it is provided to make available a conservative margin such as ½ mile per hour if desired in the speed control of the train operation. If yes, this indicates the vehicle is going faster than the command speed limit, so at step 1002 the train line pattern TH state is output to request state 12, which is full service brakes to correct the overspeed. The program then goes to step 1003 to clear state delay time and at step 1004 calls for the P change subroutine shown in FIG. 13 because of the requested change of state. If the actual speed is not over the command speed limit at step 1000, at step 1006 a check is made to see if the actual speed is less than or equal to the command speed limit minus a control factor at the bottom of the speed band, which at the present is minus four and a half miles per hour. This checks the actual speed in relation to the bottom of the predetermined speed band. If not, at step 1008 the time to limit determining speed band subroutine shown in FIG. 11 is called. If yes, the train is under speed so at step 1010 a check is made to see if the half power flag is set, and if it is not set then at step 1012 a state of eight is output, which requests full propulsion as shown in FIG. 20. The train is underspeed and full propulsion is requested. At step 1010 if the answer is yes, the maximum half power state is requested at step 1014. This is selectable, and can be set at state five or whatever state is desired for this purpose. In the speed maintaining subroutine shown in FIG. 10, at step 1006 if the actual speed is within the predetermined desired speed band such as plus zero to minus four and a half miles per hour below the command speed as shown in FIG. 21, the speed band subroutine shown in FIG. 11 is called at step 1008.

Figure 11A:
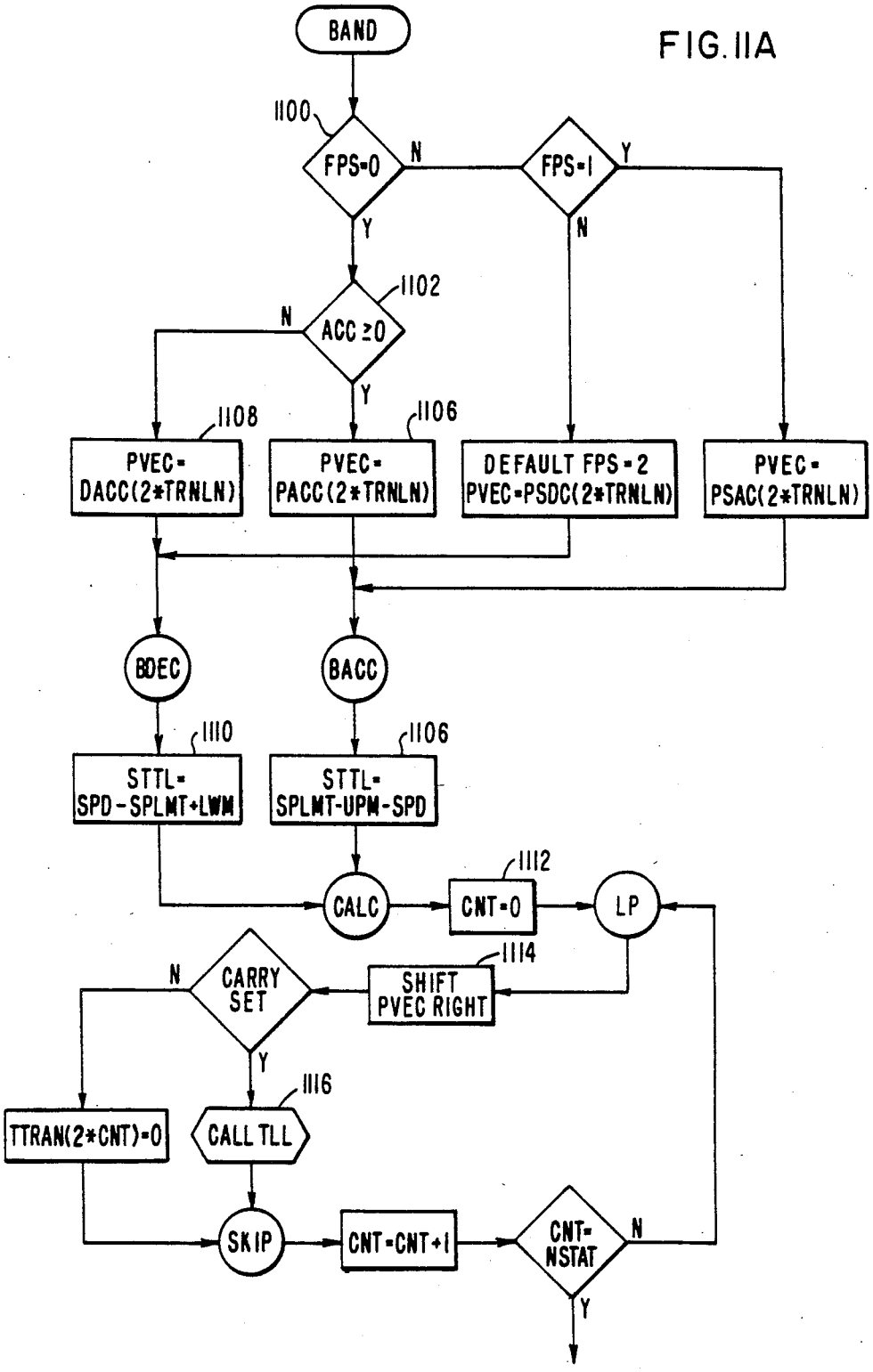
FIGS. 11A and 11B show the speed band subroutine of the present invention.
Figure 11B:
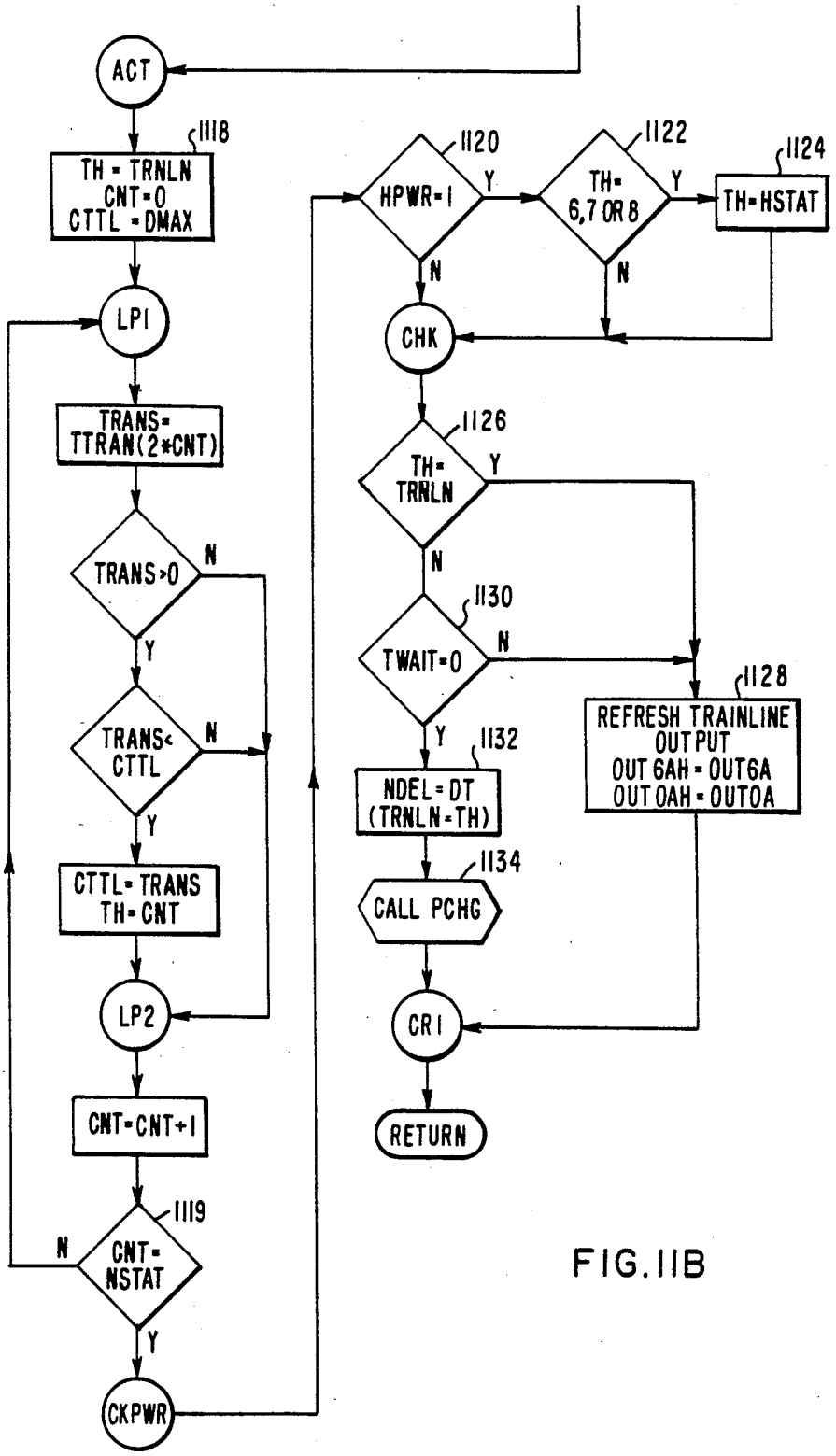

In the speed band subroutine shown in FIGS. 11A and 11B at step 1100 a check is made to see if the program stop flag is zero. If yes, at step 1102 a check is made to see if the train is accelerating, and if yes at step 1104 the probability rector is determined by obtaining from ROM a permission Vector. This vector can be obtained from RAM data corresponding to state probability history. If this is found to be necessary for a particular application, the filling of the reward matrix, steps 1114 to 1118 would be modified slightly to multiply each matrix element (TTL element) by the value in PVEC. At step 1106 a portion of the time to limit equation is determined and sets STTL (speed TTL) equal to the command speed limit minus the upper conservation factor in the upper part of the speed band, which is presently set at plus zero but can be selected as desired, and minus the train speed to establish how far the actual speed is below the upper speed limit. Going back to step 1102, if the acceleration is less than zero then at step 1108 the probability vector PVEC is set equal to a vector from ROM as previously described.

Figure 12:
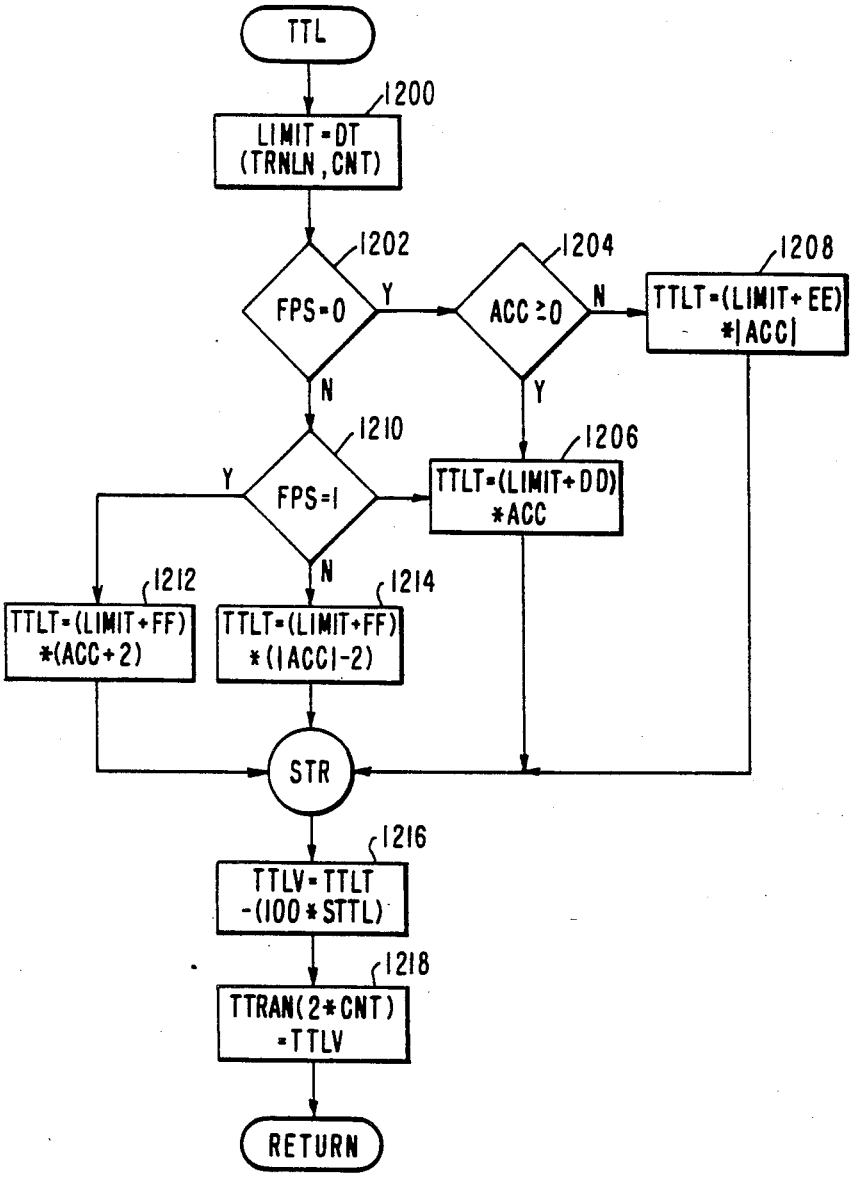
FIG. 12 shows the time to limit subroutine of the present invention.

At the present time this permission or probability vector has all zeroes with the exception of a single one that selectively determines the next transition state of the train operation, but the capability is provided for future utilization with positive real numbers in this vector such that the decision matrix element value would be determined by a multiplication of this probability vector times the TTL reward matrix element value established in FIG. 12. The speed band subroutine could fill the probability vector with values in accordance with the probability of being in a particular state based on how often the operation has been there over a predetermined past period of time. At step 1112 the counter CNT is set to zero, and each time through the rest of this loop the counter CNT is incremented by one and when the counter equals the number of possible states the program operation is completed. If the probability vector were filled with real numbers this operation multiplies the reward matrix row element values by the probability vector element values. Presently, at step 1114 the P vector is shifted right to fill the P vector only for those states of the train operation permitted. At step 1116 the time to limit subroutine shown in FIG. 12 is called.

At step 1118 in FIG. 11 the present train line state TRNLN is put into memory location TH (train line hold), the counter is set to zero and CTTL is initialized. The ACT routine sequentially looks at the decision matrix row for each of the possible state transitions and selects the highest value and its associated transition. For each pass through the routine every time a value is found that is higher than the last value then the number of that new state is put into TH and the transition will be to this desired state. The decision matrix is the product of the probability vector times the reward matrix. At step 1120 if the half power flag is set, at step 1122 if the new train operation state is six, seven or eight then at step 1124 the new state is changed to the maximum half power state. If the half power flag is set at step 1120 and if the new state is not six, seven or eight at step 1122, or if the half power flag is not set, then at step 1126 a check is made to see if the desired state TH is the same as the present train line state. If yes, at step 1128 the same old data is output, and if not at step 1130 a check is made to see if a long enough waiting time has occurred since the last transition change to have the full performance benefit of that change. If not enough waiting time has taken place, the same outputs are refreshed at step 1128. If enough waiting time has been provided, at step 1132 N delay is set equal to the delay from the matrix in relation to the requested state transition, with the train line TRNLN being the present state and TH being the next desired state. At step 1134 the change states subroutine PCHG shown in FIG. 13 is called to make the desired change of state. The maximum delay is three seconds from full propulsion to full brake.

In FIG. 12 the delay associated with the particular state to state transition is established in relation to the corresponding element in the delay matrix DT. At step 1200 the limit is established as equal to the delay matrix element DT corresponding to the present train line state TRNLN and the new state CNT, where CNT equals TH from steps 1118 to 1119. At step 1202 a check is made to see if the program stop flag is set equal to zero. If yes, at step 1204 a check is made to see if the acceleration is positive or negative. If positive, at step 1206 TTLT is set to equal the vehicle delay time plus grade correction DD to give the overall delay times the acceleration which results in the maximum Δ speed allowed. If negative at step 1204, at step 1208 TTLT is set equal to the vehicle delay time plus grade correction EE times the absolute value of the acceleration which results in the maximum allowed Δ speed.

This Δ speed divided by acceleration gives the time required to reach the speed limit from the present speed, but instead of dividing Δ speed by acceleration and comparing it with a time delay, the time delay is multiplied by acceleration and compared to Δ speed to facilitate the operation of the microprocessor.

If the program stop flag at step 1202 does not equal zero, then at step 1210 if the program stop flag equals one at step 1212 TTLT is set equal to the vehicle delay limit LIMIT plus the grade correction factor FF times the acceleration plus two. If the program stop flag is not one at step 1210, which indicates deceleration of more than two miles per hour per second in program stop, at step 1214 the limit plus grade correction FF is multiplied by the absolute value of the acceleration minus two. In program stop the control objective is dynamic equilibrium of the speed control at a deceleration of minus two miles per hour per second. At step 1216, TTLV is set equal to the time to limit TTLT minus 100 times STTL. STTL is the actual Δ speed computed by taking the difference between the speed band limit and the actual speed. 100 is a scaling constant. The Δ speed between the speed band limit and the actual speed is STTL as determined in FIG. 11 at one of the steps 1106 and 1110. TTLT was just computed as the allowable Δ speed limit. A comparison is made of these and is put in the appropriate decision matrix row at step 1218. When the speed band subroutine is completed the appropriate decision matrix row will be filled with values representing the desirability of state transitions.

The change states subroutine in FIG. 13 at step 1300 checks to see if the new requested state is the same as the present state, and if yes at step 1302 the output train line is refreshed. If no, at step 1304 the delay time is read from the delay matrix. The direction of the last state-to-state transition (positive or negative) is determined by the direction of move macro routine shown in FIG. 19 and which is called in step 1306. At step 1306 the direction of move from the previous state to the present state determines the up down flag UPDN for that previous state transition. At step 1308 this flag is stored in location DIR1. At step 1310 the direction of the present move from the present state to the desired new state is found to determine the up down flag UPDN for the new state transition. At step 1312 a check is made to see if the new state transition up down flag equals the previous state transition flag, and if yes at step 1314 the new delay NDEL is set equal to the delay remaining for the last transition plus the delay for the new transition. If not, at step 1316 the new delay equals the absolute value of the new delay minus the remaining delay for the last move. At step 1318 a check is made to see if this new total delay time is greater than a predetermined maximum delay, and if yes at step 1320 this maximum limit is used in place of the new delay. At step 1322 the train line output subroutine shown in FIG. 14 is called. The purpose for this delay time addition or subtraction is to find the actual state-to-state transition time for use in the wait-out period after the new state transition is made.

The train line output subroutine in FIG. 14 at step 1400 disables the interrupts and at step 1402 resets the TTIME timer with the new delay time NDEL. At step 1404 the interrupts are enabled, and at step 1406 TR2 is set with the now old train line state TRNLN and the present train line pattern TRNLN is set with the new desired train line state. At step 1408 the train lines are output through the designated output ports leading to the train line module 326 and the cam controller propulsion system 330.

In FIG. 15 there is shown the program stop subroutine operative with the program stop marker signals received from the roadway track. The WMATA transit system has a first program stop marker positioned about 2700 feet from the center line of the passenger station platform. The second program stop marker is positioned about 1200 feet. The third marker is positioned about 484 feet, and the fourth is positioned about 160 feet from the center line of that station platform. The objective is to position the head end of the train at the proper position relative to the platform center line.

Figure 16:
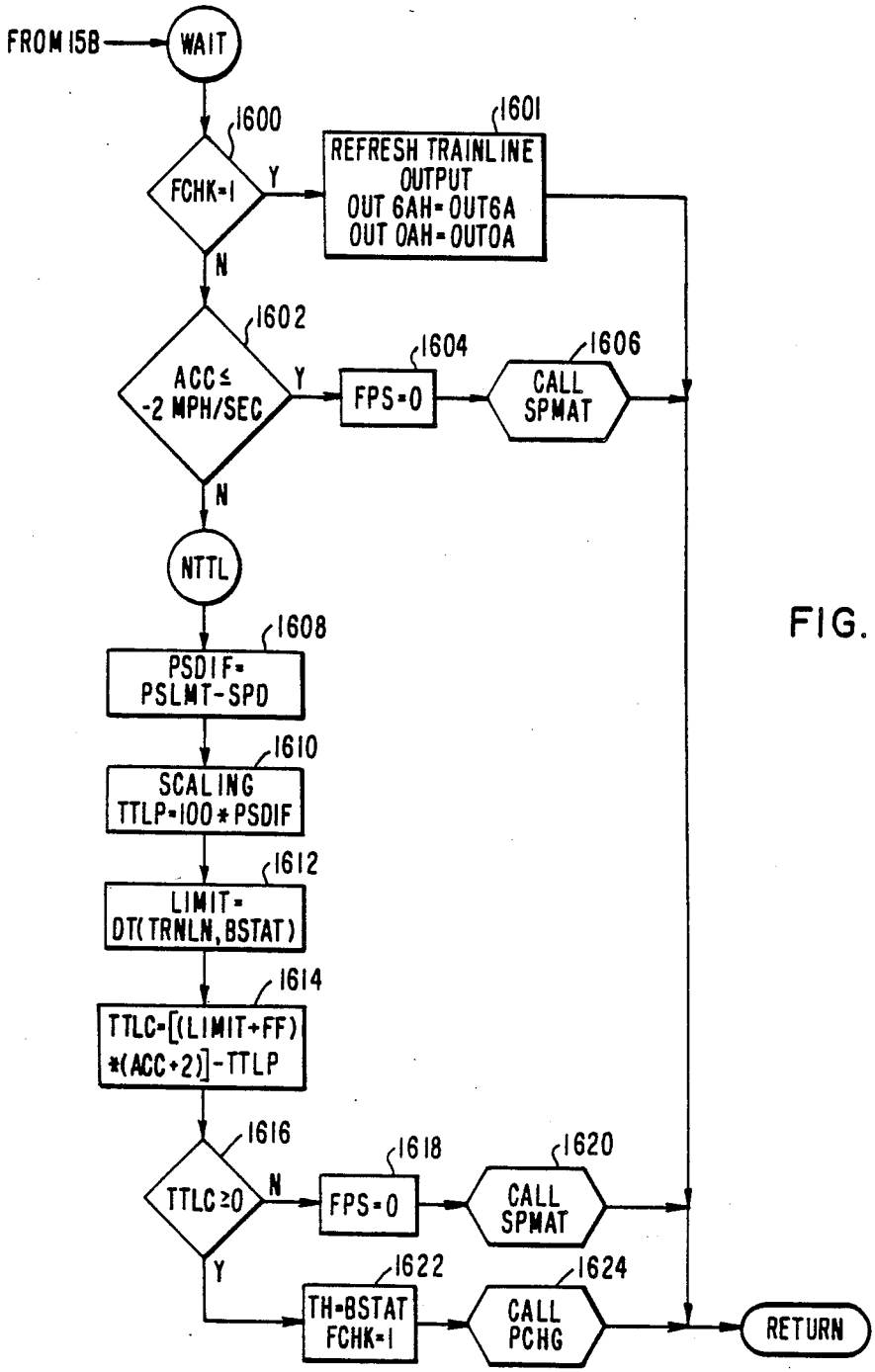
FIG. 16 shows the look ahead subroutine that is operative when in program stop and the commanded speed limit is below the program stop profile speed.
Figure 17:
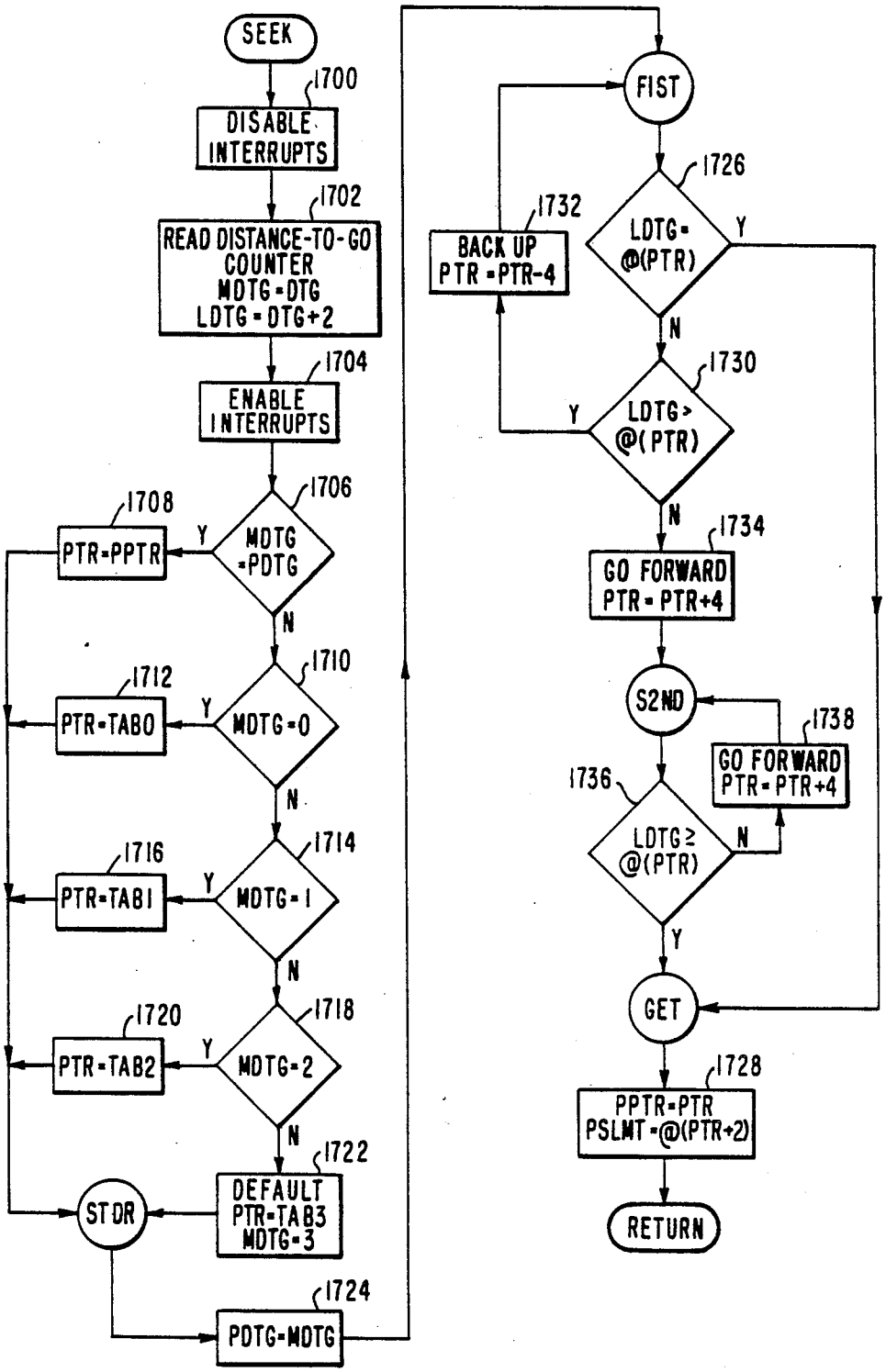
FIG. 17 shows the seek subroutine operative to make a program stop table search.
Figure 18:
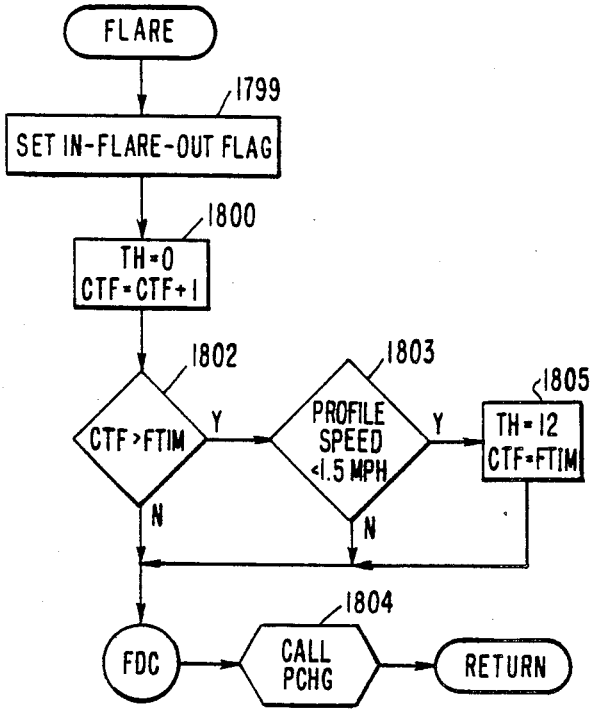
FIG. 18 shows the flare-out subroutine of the present invention.

In the program stop subroutine shown in FIG. 15 at step 1500 the program stop table search subroutine shown in FIG. 17 is called. At step 1502 a comparison is made to see if the lesser of the ATP command speed limit and the ATS speed limit is greater than or equal to the program stop speed limit. If no, at step 1504 a flag is set for speed maintaining. If yes, at step 1505 the speed limit to be used is set to be the programmed stop speed limit, and the check flag is set equal to zero. At step 1506 a flag is cleared since the operation is not in speed maintaining. At step 1508 a check is made to see if the actual speed is less than or equal to the speed limit minus the upper correction, which is plus zero miles per hour. If no, there is an overspeed. At step 1507 a check is made to see if the train is operating in flare out and if yes, the flare-out subroutine shown in FIG. 18 is called. The flare-out subroutine provides a jerk-limited station stop to increase passenger comfort. If not, step 1509 checks to see if the train is in speed maintaining mode, and if not, step 1510 sets the state for full service brakes, the check flag is set to zero at step 1511 and the change states subroutine shown in FIG. 13 is called at step 1513. If there is no overspeed at step 1508, at step 1512 a check is made to see if the actual speed is less than the flare-out speed limit. If yes, at step 1514 a check is made to see if the program stop speed limit is less than or equal to the flare-out speed limit. If yes, at step 1516 the flare-out subroutine shown in FIG. 18 is called. If not, at step 1518 a check is made to see if the speed is less than or equal to the bottom of the speed maintaining band minus an additional programmable offset. If yes, at step 1520 the speed maintaining subroutine shown in FIG. 10 is called. If not, at step 1522 a check is made to see if the speed maintaining flag is set. If yes, at step 1524 the speed limit below program stop profile subroutine shown in FIG. 16 is called. This subroutine is used when the program stop speed limit is still above the command speed limit but closing in on the command speed limit and a transition to a program stop brake state must be made now in anticipation of the minus two mile per hour per second program stop speed limit deceleration. If the speed maintaining flag is not set, the train is operating in program stop and at step 1526 a check is made to see if the acceleration is greater than or equal to minus two miles per hour per second. If yes, at step 1528 the program stop flag is set for accelerating, and if not at step 1530 the program stop flag is set for decelerating. At step 1532 a check is made to see if the present train line state is emergency brake. If yes, at step 1534 the output is refreshed, and if not at step 1536 the speed band subroutine shown in FIG. 11 is called. At step 1538 a check is made to see if the train line state is zero, corresponding to coast. If yes, at step 1540 the train line output is refreshed, and if no at step 1542 the speed band subroutine is called.

As shown in FIG. 22, the program stop speed limit 2204 comes down at minus two miles per hour per second. If the command speed limit 2200 remains at some command speed, such as 40 miles per hour, when the train passes the 1200 foot marker where the program stop speed limit is a higher speed, such as 55 miles per hour, after a period of time, such as about 12.5 seconds, the program stop speed limit will intersect the command speed limit as shown in FIG. 22. To avoid overshooting the program stop speed limit 2204, since the speed maintaining calculation would provide an acceleration in relation to the program stop speed limit 2204 at the speed maintaining acceleration plus two, this subroutine shown in FIG. 16 is provided to correct such an overshoot of the program stop speed limit 2204 that might otherwise cause an undesired correction that would adversely stress the propulsion equipment on each vehicle.

In FIG. 16 the speed limit below program stop profile subroutine is shown. At step 1600 a check is made to see if the check flag is set to one. If yes, the subroutine has already been executed and at step 1601 the train line outputs are only refreshed. Since this flag is set to one later in this same program, the first time through this program it is not set to one. At step 1602 a check is made to see if the acceleration is less than or equal to minus two miles per hour per second, and if so the program stop flag is reset at step 1604 and the speed maintaining subroutine shown in FIG. 10 is called at step 1606. If the answer is no at step 1602, at step 1608 the program stop speed difference is set equal to the program stop speed limit minus the actual speed. At step 1610 some scaling is applied. At step 1612 the delay limit is obtained from the delay matrix for the present state in relation to a brake state, BSTATE, which is presently set at nine or minimum brake. At step 1614 the time to limit Δ speed difference is computed by subtracting the delay limit plus a grade correction factor FF times the acceleration plus two from the scaled program stop speed difference. At step 1616 if the time to limit Δ speed difference is greater than or equal to zero, no action is required at the present time so the program stop flag is set to zero at step 1618 and the speed maintaining routine is called at step 1620. If at step 1616 the answer is yes, then the program stop speed limit is too close to the command speed limit and corrective action must be taken to avoid overshoot. At step 1622 the BSTATE is requested which is state nine or minimum brake, and the check flag is set to one. At step 1624 the change states subroutine shown in FIG. 13 is called.

In FIG. 17 there is shown the seek subroutine operative to make a search of a predetermined program stop table. This table has two entries, one being the distance to the centerline of the passenger station platform and the other being the maximum MPH at that distance. The subroutine takes the present distance to go and searches the table for the next greater distance, with the corresponding MPH from the table being the maximum allowed MPH for the train at the present distance. At step 1700 the interrupts are disabled. At step 1702 the distance to go counter is read, and at step 1704 the interrupts are enabled. At step 1706 a comparison is made of the most significant byte of the three bytes in the distance to go counter in relation to the last pointer, and if the same, the old pointer is used at step 1708. If not, at step 1710 in an effort to determine which table should be used, a comparison is made with zero, and if yes, a new table entry pointer is loaded at step 1712 for that pointer. If not equal to zero at step 1710, then at step 1714 a check is made to see if this byte is equal to one, and if so, at step 1716 a different table entry pointer is loaded. If not equal to zero and not equal to one, at step 1718 a check is made to see if this byte is equal to two and if so, at step 1720 another table entry pointer is loaded. If none of the checks at steps 1706, 1710, 1714 and 1718 is yes, then at step 1722 a default is established and the table entry pointer is set for the highest value which is about 80 MPH. At step 1724 the most significant byte of the distance to go counter is stored as the past distance to go for use the next time through this loop. At step 1726 the least significant byte is compared with the pointer. If equal, at step 1728 the value in the pointer table is put into the past pointer table to use next time through the loop, and the program stop speed limit takes the corresponding entry speed limit value. At step 1730, if the distance to go counter is less than the entry value pointed to, a four byte back up is made at step 1732 since there are four bytes in the table for every entry, and this is repeated until the distance to go counter is less than the pointer value at step 1730. At step 1734 the pointer value is incremented by four locations, at step 1736 a search is made to find the next higher distance by comparing the distance to go with the pointer and if the distance to go is greater this indicates a value is found. At step 1728 the pointer is stored and the program stop speed limit is established. If less, at step 1738 the next higher distance increment is selected for the pointer and this loop continues until a distance to go value is found that is greater than the pointer distance.

In the flare-out subroutine shown in FIG. 18, at step 1799 the in flare-out flag is set and at step 1800 the next state is commanded to be coast and the time in flare-out is incremented 1/10 second since the routine is run every 100 milliseconds and each run is 1/10 second. At step 1802 a check is made to see if the counter is greater than a predetermined time, such as 3.6 seconds. If not, at step 1804 the change states subroutine shown in FIG. 13 is called to command the coast. If yes, at step 1803 a check is made to see if the profile speed is less than 1.5 MPH and if yes at step 1805 the next state is set at full service brake which is 12 and the timer value is set at maximum, then at step 1804 the change states subroutine is called and return. If no at step 1803 the routine goes to step 1804 and return. This subroutine provides jerk limiting when coming into a station by going into coast for a while and then full calling for service brakes.

Figure 19:
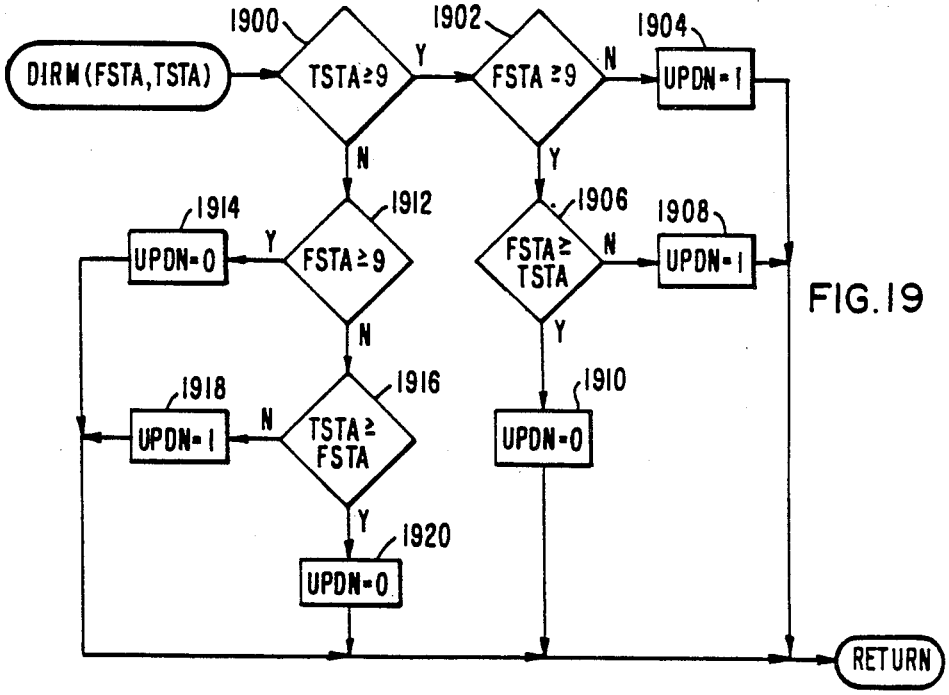
FIG. 19 shows the direction of move macro routine of the present invention.

In FIG. 19 the direction of move macro routine, which is used to determine the adding or subtracting of time delays, is shown. At step 1900 a check is made to see if the next or "to" state of the train is brake. If yes, at step 1902 a check is made to see if the present or "from" state is in brake. If the present "from" state is brake and the next "to" state is not in brake, at step 1904 the flag UPDN is set to one, since the move is down from propulsion or coast to brake. At step 1906, a check is made to see if the present "from" state is greater than the next "to" state, and if not at step 1908 a down movement is indicated.

If the "from" state is greater than the next "to" state at step 1906, then at step 1910 an up move is indicated. If not going to a brake state at step 1900, this means the next state is either coast or propulsion and at step 1912 a check is made to see if the "from" state is brake, and if yes, at step 1914 an up move is indicated. If the "from" state is not brake at step 1912, then at step 1916 a check is made to see if the "to" state is greater than the "from" state. If not, at step 1918 a down movement is indicated, and if yes, at step 1920 an up move is indicated by the UPDN flag.

The present control system uses the acceleration of the train in relation to the difference between the command speed band limits and the actual speed to establish a time to limit. When the train is accelerating in power, the upper command speed limit in relation to the predetermined speed band is used for this purpose. When the train is decelerating in brake, the lower band speed limit is used for this purpose. Then the vehicle response delay time is compared with the time to limit to determine when a state transition must occur. In this way a longer waiting period is provided between state transitions such that the train speed changes operate within the full width of the determined speed band and the required restriction on adverse state changes is satisfied. Reducing the width of the speed band, for example speed maintaining between plus zero and minus three miles per hour would result in more state-to-state changes.

Figure 23A:
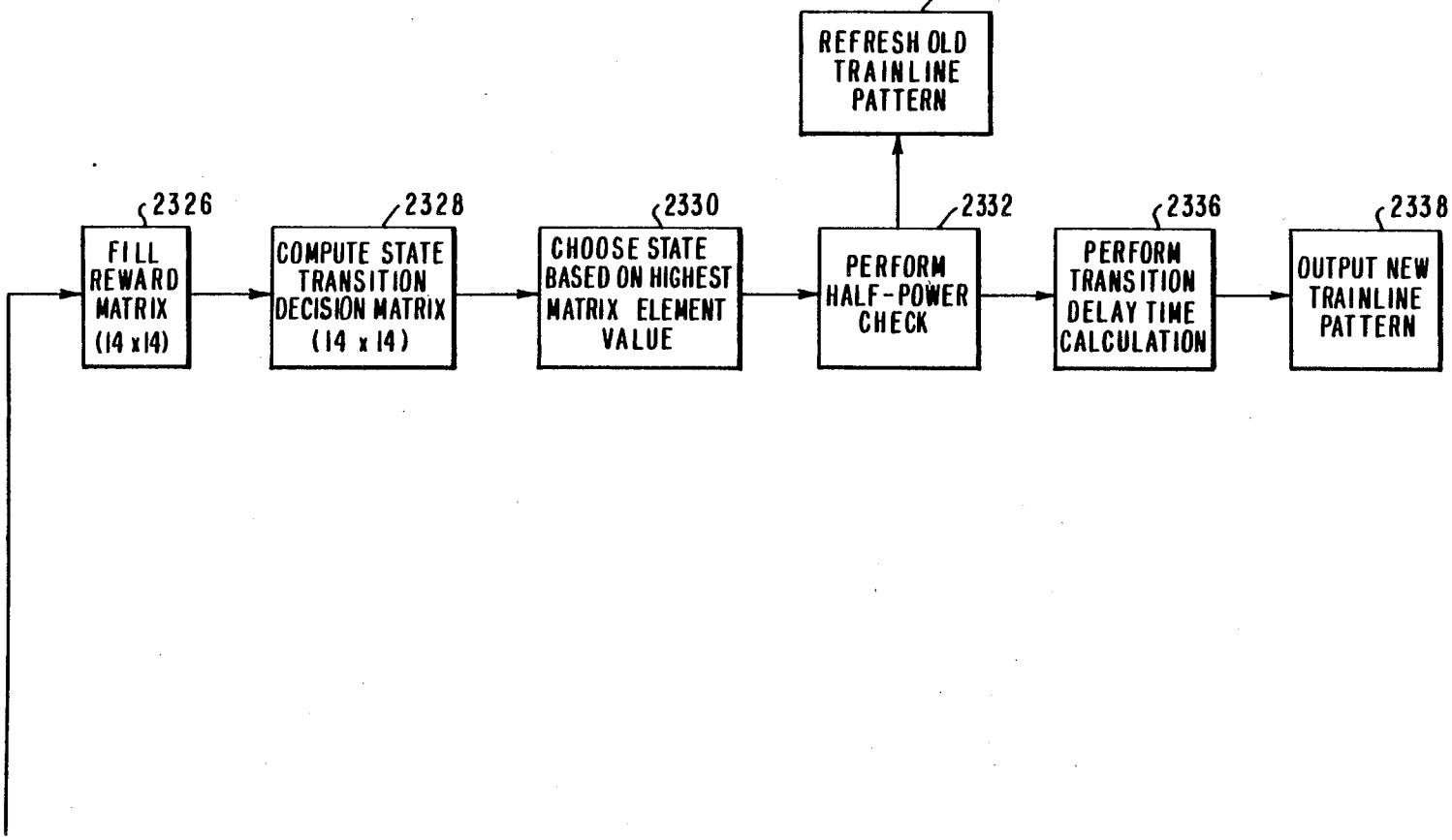
FIGS. 23A, 23B and 23C show a functional block diagram to illustrate the operation of the present speed control apparatus and method for rapid transit vehicles.
Figure 23B:
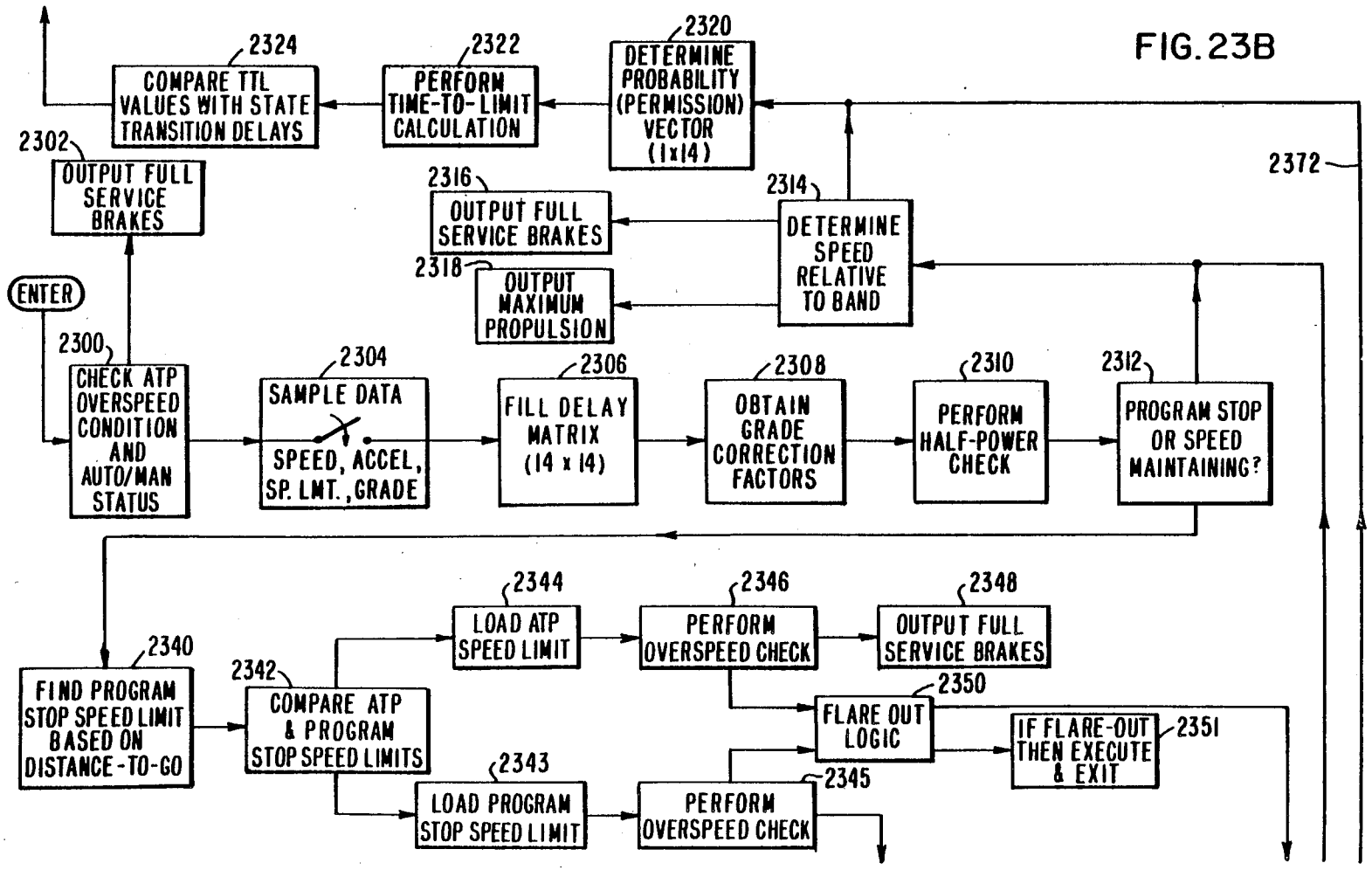
Figure 23C:
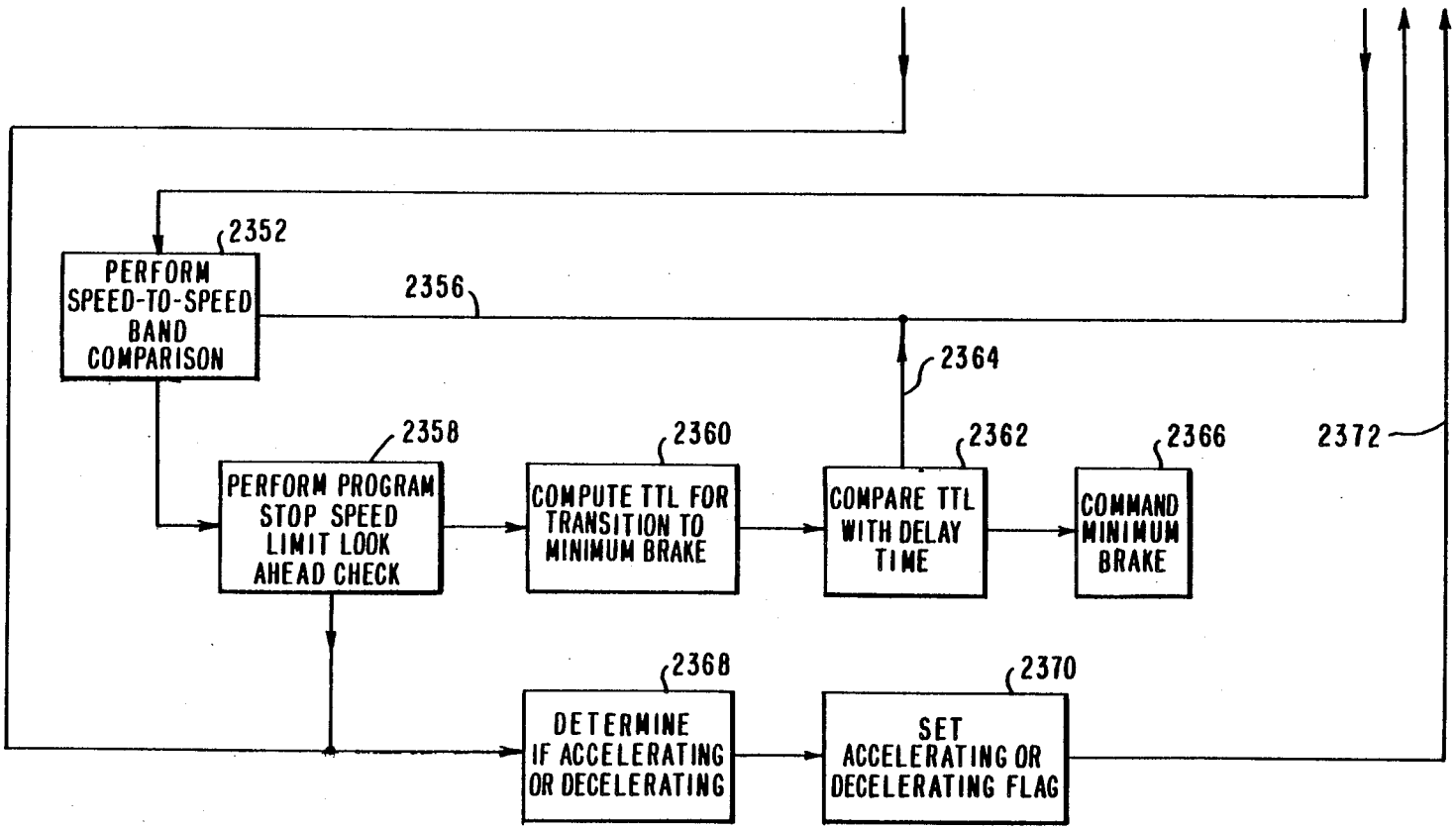

In FIG. 23 there is shown a functional block diagram to illustrate the operation of the speed maintaining and program stop logic apparatus 401 shown in FIG. 4. This apparatus includes an Intel 8080 microprocessor programmed with the software control program shown in FIGS. 8 to 19. At block 2300 a check is made to see if the ATP equipment 310 shown in FIG. 4 is indicating an overspeed operation of the train on input 303 to the speed maintaining and program stop logic apparatus 401, which is done at step 800 in FIG. 8. When the ATP equipment 310 indicates an overspeed condition, block 2302 outputs full service brakes which is done at step 801 in FIG. 8. Block 2304 samples the input data, such as the ATP command speed limit on input 311, the accelerometer indicated acceleration on input 442, the ATS performance modification speed limit on input 319, and the grade marker information on input 313 (not presently used) and puts this in memory, which is done at step 803 in FIG. 8. At block 2306 the delay time matrix is filled using the motor curves and jerk limit requirements that were prevously put in the memory look up table in relation to the present state and the next desired state, such that the train speed is used to find the desired data from the look up table which data is then loaded into a memory buffer, and this operation is done at steps 806 to 818 in FIG. 8. Each location in that look up table corresponds to a state transition. At block 2308 the grade correction factors are obtained from a storage table that was previously established from empirical data, and which is done at steps 818 to 844 in FIG. 8. At block 2310 a check is made to see if a half power acceleration limit is provided on the input 321, which is done at steps 846 to 852 in FIG. 8. At block 2312 a check is made to see if the train is operating in a speed maintaining mode or in a program stop mode as determined by the program stop marker providing an indication on input 314, and which is done at step 853 in FIG. 8.

Assume the train is operating in speed maintaining mode. At block 2314 a determination is made to see if the actual speed on input 308 from the tachometer 306 is within the predetermined plus zero mile per hour to minus four and a half mile per hour speed band below the command speed on input 311, which is done at steps 1000 and 1006 in FIG. 10. It is readily apparent that this speed band can be adjusted in mile per hour width as may be desired to improve the speed control of the train. If the actual speed is above the speed band, at block 2316 full service brakes are output which is done at step 1002 in FIG. 10. If the actual speed is below the speed band, at block 2318 maximum permitted propulsion power is output which is done at step 1010 in FIG. 10. If the speed is within the speed band, at block 2320 the permission or probability vector is determined, which is a $1\times14$ vector that can have numbers according to the historical probability of each state but at the present time has all zeroes and a single one; the speed band subroutine is called at step 1008 in FIG. 10 and this determination is done at steps 1100 to 1114 of FIG. 11 to fill this probability vector. At the present time if the train is in propulsion state one and accelerating, the permission vector establishes the next transition state to be two and if decelerating the next transition state to be zero (coast). At block 2322 the time to limit calculation is performed, which is called at step 1116 of FIG. 11 and is done at steps 1200 to 1214 of FIG. 12. At block 2324 a comparison is made between the time to limit values with the state transition delays, which is done at step 1216 of FIG. 12. At block 2326 the 14×14 reward matrix is filled with the results of the time to limit calculations and comparison with the state transition delays, which is done at steps 1200 to 1218 of FIG. 12. The control concept here is to multiply the probability vector times the reward matrix to provide a decision matrix. However the probability vector at present is a permission vector with only zeroes and a single one in it, so the operation here is simplified to shift through the probability vector and for each one (presently a single one) the corresponding reward values are put into one corresponding decision matrix row for the 14 possible states to which a transition can be made from the present state, and which is done at steps 1118 to 1119 in FIG. 11 and includes blocks 2328 and 2330 in FIG. 23. At block 2332 a half power check is made, which is done at step 1120 to 1124 in FIG. 11. The final new state is then compared with the present state in step 1126. If the new state chosen is the same as the present state, at block 2334 the old train line pattern is refreshed which is done at step 1128 in FIG. 11. If a new state is chosen, in step 1130 a check is made to see if the delay time associated with the last change has expired. If it has not, the present train line pattern is refreshed. If it has expired, at block 2336 a transition delay time is obtained from ROM which is done at step 1132. Step 1134 calls the change states subroutine in FIG. 13. Bookkeeping in relation to the delay times is required because the train might not have reached the full tractive effort after the last state change so only a partial change has so far taken place, and it is necessary to consider this partial change in relation to a currently chosen new state transition. At block 2338 the new train line output subroutine shown in FIG. 14 is called by step 1322 of the change states subroutine shown in FIG. 13.

At block 2312 if a program stop marker was sensed, at block 2340 the program stop speed limit based on distance to go is found in a lookup table which is called at step 1500 in the program stop subroutine shown in FIG. 15 and is done by the seek program stop table search subroutine shown in FIG. 17. At block 2342 a comparison is made between the ATP command speed limit on input 311 and the program stop speed limit from block 2340, which operation is done at step 1502 in FIG. 15. If the command speed limit is less than or equal to the program stop speed limit, at block 2344 the ATP command speed limit is loaded for the control of train speed which is done at step 1504. At block 2346 an overspeed check is made which is done at step 1508. If an overspeed is determined, at block 2348 full service brakes is output which is done at steps 1510 to 1513. At block 2342 if the program stop speed limit is more restrictive, at block 2343 the program stop speed limit is loaded for the control of train speed, which is done at step 1506. At block 2345, an overspeed check is made which is done at step 1508. If the train is not in an overspeed condition, at block 2350 a check is made to see if the flare-out subroutine should be implemented which are steps 1507 and 1516. If flare-out is to be initiated, at block 2351 the flare out subroutine shown in FIG. 18 is executed, and this is done at step 1516. If not in flare-out, at block 2352 a check is made to see if the actual speed is below the plus zero to minus eight miles per hour program stop speed band, which is done at step 1518. If the speed is too far below the program stop speed limit, a return to speed maintaining is made at line 2356 and this is done at step 1520. At block 2358 a program stop speed limit look ahead check is made where the ATP command speed limit does not change but the program stop speed limit is decreasing at the rate of minus 2 miles per hour per second, such that the program stop speed limit with the time to limit calculation could become the more restrictive, which is done by the speed limit below program stop profile subroutine shown in FIG. 16 and is called at step 1524. At block 2360 the time to limit for a transition to BSTATE (minimum brake) is computed, which is done at step 1612. At block 2362 the time to limit is compared with the delay time, step 1614, and if the time to limit is greater at line 2364 a return is made to speed maintaining, which is done at step 1616 and 1620. If the time-to-limit is not greater than the delay time, at block 2366 minimum brake is commanded, which is done at step 1622 and 1624. If the train is operating in program stop, the look ahead check is no longer applicable, and block 2368 determines if the train is accelerating or decelerating relative to minus two miles per hour per second and this is done at step 1526 in FIG. 15. At block 2370 the accelerating or decelerating program stop flag is set and this is done at step 1528 for accelerating and step 1530 for decelerating. The operation then essentially goes back to speed maintaining at line 2372 by calling the band subroutine, FIG. 11, in steps 1536 and 1542.

In FIG. 24 there is shown the flow chart of the roadway track grade determination routine, which at block 2400 obtains the vehicle acceleration due to grade from RAM storage. The tachometer routine previously differentiated the averaged tachometer speed signal and includes the accelerometer output to calculate the acceleration due to the track grade, which is then added to the accelerometer value. This program determines the grade range of this acceleration. At block 2402, if the grade is greater than positive 2.5%, which corresponds to a certain value of the acceleration, at step 2404 a first bit in a flag word located in RAM is set. If the grade is between positive 2.5% and 0.75% at block 2406, corresponding to a different value of acceleration, another second bit in that five bit flag word is set at block 2408. At block 2410 if the grade is between positive 0.75% and negative 0.75%, at block 2412 a third bit in that flag word is set. At block 2414 if the track grade is between minus 0.75% and 2.5%, then at block 2416 a fourth bit is set in the flag word. At block 2418, if none of the other bits have been set by this routine, the fifth bit in the flag word is set. At block 2420, the grade data is stored in memory.

Figure 25:
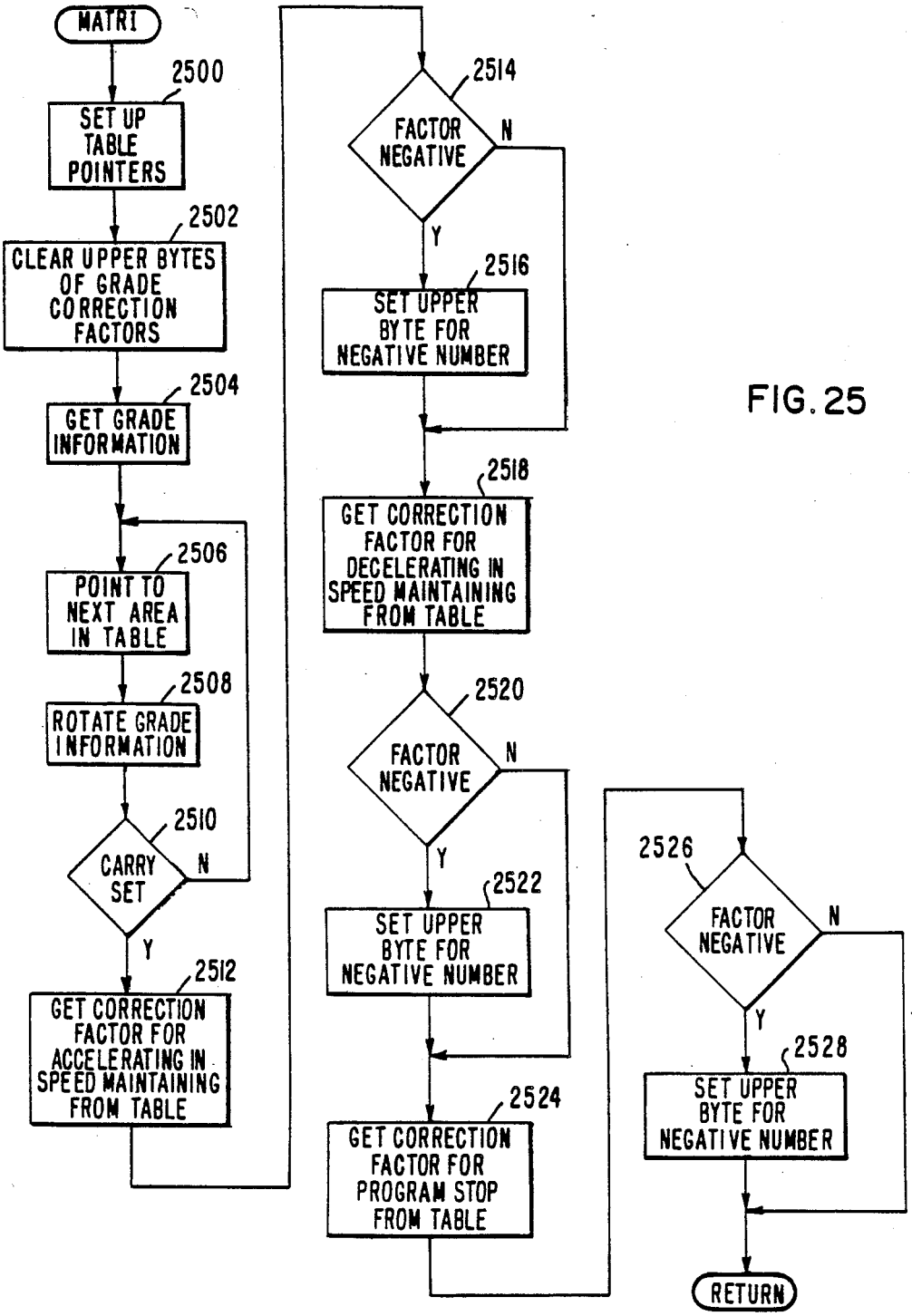
FIG. 25 shows the matrix search routine that determines the number of entries in the grade correction factor table.

In FIG. 25 there is shown the flow chart of the matrix routine that determines the total number of entries in the grade correction factor table, which is arranged in five groups of three entries. The first is for accelerating during speed maintaining, the second is for decelerating during speed maintaining and the third is for program stop. At block 2500 the number of entries for each table group is loaded. At block 2502 the grade correction factors are cleared. At block 2504 the grade information is obtained, which is a word with five bits, and one of those bits is set by the grade determination program shown in FIG. 24. The first and least significant bit is for the steepest uphill grade and this ranges over to the fifth bit which is for the steepest downhill grade. At block 2506 the routine points to one of the vehicle speed ranges delete 00 between 0 and 22, delete 23 between 23 and 50, and delete 50 when over 50, as shown at appendix pages A25 and A26 to identify which of the five groups of grade correction factors corresponds to the bits of the grade determination. This is established by the carry set condition. At block 2508 the carry is rotated, and if the carry is not set at block 2510, the routine increments to point to the next of these areas. The carry is determined to be set when the area group is found that does correspond. At block 2512 the first entry of the group is obtained and stored in the DD factor. At block 2514 if the number from the table is negative, at block 2516 FF is put into the upper byte to signify a negative correction factor. At block the routine gets the second factor from the table, and at block 2520 checks if the number is negative. If so, at block 2522 FF is put into the upper byte. If not, at block 2524 the grade correction factor for the program stop is obtained, and a check is made at block 2526 to see if it is a negative number. If so, at block 2528 the upper byte is made FF, and if not an exit is taken from the routine.

In the time to limit subroutine shown in FIG. 12, the time required to reach the speed band limit is determined as a difference between the present speed and the speed band limit, which is the upper limit for acceleration and the lower limit for deceleration, divided by the train acceleration. This time to limit is then compared with the train response delay time. Since a microprocessor can multiply easier than it can divide, the actual calculation is to compare Δ speed difference with the delay time multiplied by the acceleration. This comparison determines making or not making the state transition by setting the value in the reward matrix. One speed control objective is to wait as long as is reasonable before making a state transition to minimize adverse transitions, and another speed control objective is to stay within the speed band.

As compared to human speed control operation of a transit vehicle, a programmed microprocessor control system cannot see the track conditions as a human can, and the speed and acceleration sensing devices are not entirely accurate in the information they provide to the microprocessor system. Also vehicle delays, although measurable, vary with vehicle mass and the propulsion system supply line voltages and are therefore not known exactly at any given time.

The time to limit or TTL of the vehicle is the time remaining prior to the vehicle exceeding the upper or lower speed limit, and is a function of vehicle actual speed relative to the respective speed band limit and the vehicle acceleration. The time to limit must be compared to vehicle response delay time encountered prior to achieving a new state with sufficient tractive or retarding effort to maintain speed within the speed band. To determine the time to limit when accelerating, the time to limit equals the upper speed band limit minus the actual speed divided by the acceleration, and when decelerating the time to limit equals the lower speed band limit minus the speed divided by acceleration. When the time to limit equals or falls below the vehicle response time, the state transition must occur. Therefore if the time to limit minus the delay is greater than zero, no state transition takes place. If the time to limit minus delay is less than or equal to zero, the state transition occurs.

In order to provide sufficient corrective action under most conditions and to minimize the number of adverse state transitions, the state transitions which result in decreases in positive or negative tractive effort will be returned to coast. Increases in positive or negative tractive effort will step through the successive train line patterns, since each such change is not penalized by the system specification. The WMATA motor curves indicate that the vehicle response delay times change relative to speed. These delays are set to be conservative even if the worst case vehicle mass and line voltage conditions are considered. Once a transition occurs another speed maintaining transition is not permitted until the first transition delay time elapses.

Depending on the grade of the roadway track, when descending for example a negative 4% grade a return from propulsion to coast may not guarantee deceleration of the train. Similarly ascending a positive 4% grade for example a return from brake to coast may not guarantee acceleration of the train. Therefore the state transition delay times must be modified to allow for subsequent transitions to provide sufficient tractive effort relative to the grade condition. Grade information is available from the track markers which indicate track grade in one of five levels. This information was found to be insufficient to provide delay correction factors which result in satisfactory train performance for various grades, train masse and line voltages. Therefore, the grade is computed using tachometer differentiation and accelerometer acceleration as previously described. The previous tractive effort state history processed continually can further optimize performance relative to variables such as weather, line voltage and vehicle mass.

For any given state, 14 state transitions exist including the stationary or no change transition. Some of these transitions are desirable to maintain train speed and some are undesirable and others are unobtainable due to propulsion equipment configuration. A control approach is required to manipulate the potential 196 state transitions and the decision mechanism in a compact and efficient manner. The logical nature of the state transitions and microprocessor based control is operative with a state transition decision matrix. The elements of this state transition decision matrix representing the desirability of each state transition can be obtained from a $14\times14$ reward matrix and a state transition probability vector. The 196 elements of the reward matrix are each a function of the present train line pattern or state, the new state, vehicle speed and acceleration, speed maintaining band, vehicle delays and grade. The state probability vector is defined such that its elements represent the probability of being in state i after N transitions. The state probability vector elements will vary with such variables as weather conditions, line voltage and vehicle mass. Given the reward matrix and the state transition probability vector, the elements of the state transition decision matrix can be determined and the best state transition decision can be made. Each state transition decision matrix element is assigned a value based on the aforementioned parameters. These values indicate the overall desirability of choosing that particular state transition. The state transition associated with the matrix element with the highest desirability is implemented. Filling of the matrix and choosing the element of greatest value is a repetitive and computational process well suited to microprocessor based control systems. This approach to transition decision making also results in improved logic understanding and facilitates trouble shooting and modification when necessary.

For programmed station stopping, the speed control logic employing a state transition decision matrix with time to limit based elements is also applicable. The WMATA marker system provides program station stopping distance information at 2700, 1200, 484 and 160 feet from the center line of the station platform. From this distance information, a speed profile can be generated which provides the specified two mile per hour per second deceleration rate. After passing a marker the cumulative distance travel information can be maintained with reasonable accuracy by integrating the tachometer. Since once under program stop subsystem control the speed limit decreases at two miles per hour per second and the train deceleration must also approximate this rate. To achieve this deceleration the time to limit TTL calculation must be modified such that if acceleration is above minus two miles per hour per second, then TTL equals the upper program stop speed limit minus the speed divided by acceleration plus two, and if acceleration is below minus two miles per hour per second then the time to limit TTL equals the lower program stop speed limit minus speed divided by acceleration plus two, where all units of speed are miles per hour and all units of acceleration are miles per hour per second.

The transition decision matrix elements are modified not only by the time to limit calculation procedure change but also in the decision mechanism logic used for selection of certain states. For example only brake states are typically permitted when the program stop speed limit is controlling and the speed is within plus zero and minus four miles per hour of this limit. Once a program stop speed marker is detected a check of the time to limit is continually made using both the commanded speed limit and the program stop profile speed limit. The more restrictive limit is chosen and its logic executed. A flare-out technique is also implemented just prior to stopping. This routine consists of a return from brake to coast for one to two seconds and then an application of full service brakes. In this manner a jerk limited stop is achieved providing increased passenger comfort.

DESCRIPTION OF INSTRUCTION PROGRAM LISTING

In Appendix A there is included an instruction program listing that has been prepared to provide the desired operation of a transit vehicle in accordance with the disclosed speed control apparatus and method. The instruction program listing establishes the functional operation of the present invention, and is written in the assembly language of an Intel 8080 microprocessor computer system. Many of these computer systems have already been supplied to customers, including customer instruction books and descriptive documentation. A person skilled in this art could routinely apply the attached program in relation to specific transit vehicles to be controlled for a particular vehicle track system.

The following page is Appendix -A1-

```
ISIS-II 8080/8085 MACRO ASSEMBLER, V3.0          SPREG     PAGE    1
WMATA SPEED REGULATION ROUTINE

 LOC  OBJ        LINE        SOURCE STATEMENT

                   1 $MACROFILE
                   2 $PAGEWIDTH(80)
                   3 $PAGELENGTH(63)
                   4 $XREF
                   5 $        TITLE('WMATA SPEED REGULATION ROUTINE')
                   6          NAME     SPREG
                   7 ;09/02/82         CREATION BY D.A. HERBERT
                   8 ;                 MODIFIED BY K.W. CLAWSON
                   9 ;
                  10 ;        THIS ROUTINE PERFORMS THE SPEED MAINTAINING
                  11 ;                 FUNCTION AND PROGRAM STOP FUNCTION
                  12 ;                 FOR THE WMATA ATO MODULE.
                  13 ;        THIS IS DONE BY MONITORING THE SPEED, SPEED
                  14 ;                 COMMAND, AND ACCELERATION AND CALCUL-
                  15 ;                 ATING THE CORRECT TRAINLINES TO BE
                  16 ;                 OUTPUTTED TO THE CAR.
                  17 $EJECT
                  18 ;
                  19 ;*****   MACRO TO READ AN 8 BIT VALUE
                  20 ;        FROM THE DELAY MATRIX.
                  21 ;        VALUES PASSED ARE PRESENT AND NEW TRAINLINES
                  22 ;        VALUE RETURNED IS DT(PTL,NTL) IN REGISTER A,
                  23 ;        ADDRESS IS IN HL REGISTERS.
                  24 ;
                  25 GETD     MACRO    PTL,NTL ;DEFINE MACRO
 -                26          LXI      H,DT    ;GET ADDRESS OF DELAY MATRIX
 -                27          LDA      PTL     ;GET ROW NUMBER
 -                28          RLC              ;DETERMINE ROW OFFSET
 -                29          RLC              ;OFFSET = 16*PTL
 -                30          RLC              ;MULTIPLY BY 16 =
 -                31          RLC              ;4 SHIFTS LEFT
 -                32          ANI      0F0H    ;CLEAR LOWER 4 BITS
 -                33          MOV      E,A     ;E= ROW OFFSET
```

```
LOC  OBJ        LINE        SOURCE STATEMENT

-                 34          LDA     NTL       ;GET COLUMN OFFSET
-                 35          ADD     E         ;ADD TO ROW OFFSET
-                 36          MOV     E,A       ;STORE TOTAL OFFSET IN DE
-                 37          MVI     D,0       ;CLEAR D
-                 38          DAD     D         ;ADD OFFSET TO BASE
-                 39          MOV     A,M       ;READ MATRIX VALUE INDIRECT
                  40          ENDM              ;END MACRO DEFINITION
                  41          ;
                  42 $EJECT
                  43 ;*****   MACRO TO FIND DIRECTION OF MOVE
                  44 ;        DETERMINES THE DIRECTION OF A TRANSITION
                  45 ;        FROM A STATE FSTA TO A STATE TSTA.
                  46 ;        VALUES PASSED ARE FSTA,TSTA
                  47 ;        VALUE RETURNED IS UPDN FLAG
                  48 ;        REGISTERS USED ARE A,B
                  49 ;        UPDN = 1 = DOWN
                  50 ;        UPDN = 0 = UP
                  51 ;
                  52 DIRM     MACRO   FSTA,TSTA         ;DIRECTION OF MOVE
                  53          LOCAL   DFLAG,DBRAK,ZFLAG,DIRR
-                 54          LDA     TSTA      ;GET TO STATE
-                 55          CPI     9         ;IN PROPULSION?
-                 56          JP      DBRAK     ;NO IN BRAKE
-                 57          LDA     FSTA      ;FROM AND TO STATES IN PROP?
-                 58          CPI     9         ;COMPARE
-                 59          JP      ZFLAG     ;YES SET FLAG TO ZERO
-                 60          MOV     B,A       ;TO >= FROM?
-                 61          LDA     TSTA      ;GET TO STATE
-                 62          SUB     B         ;TO STATE - FROM STATE
-                 63          JP      ZFLAG     ;YES SET FLAG TO ZERO
-                 64 DFLAG:   MVI     A,1       ;MOVING DOWN
-                 65          STA     UPDN      ;SET UPDN FLAG
-                 66          JMP     DIRR      ;DONE
-                 67 DBRAK:   LDA     FSTA      ;IN BRAKE CHECK FROM STATE
-                 68          CPI     9         ;IN PROPULSION?
-                 69          JM      DFLAG     ;YES SET FLAG TO ONE
-                 70          LDA     TSTA      ;FROM >= TO?
-                 71          MOV     B,A       ;B=TSTA
-                 72          LDA     FSTA      ;A=FSTA
-                 73          SUB     B         ;FROM - TO
-                 74          JM      DFLAG     ;NO SET FLAG TO ONE
-                 75 ZFLAG:   XRA     A         ;MOVING UP
-                 76          STA     UPDN      ;ZERO FLAG
-                 77 DIRR:                      ;DONE
                  78          ENDM              ;END MACRO
                  79          ;
                  80 $EJECT
                  81 ;
                  82 ;        PUBLIC  TREG,TSPD,TPSTP,TACC,TTIME,TGRD,TPWR
                  83 ;
                  84 ;        PUBLIC  SPLMT
                  85 ;
                  86 ;
2010              87 SBASE    EQU     2010H     ;ABSOLUTE LOCATION
2010              88          ORG     SBASE
                  89 ;
                  90 $EJECT
                  91 ;-----------SPEED REGULATION ROUTINE----------
                  92 ;WMATA ATO.
                  93 ;SPEED REGULATION PROGRAM BASED ON TIME-TO-LIMIT
                  94 ;MATRIX DECISION THEORY FOR CAM PROPULSION SYSTEM
                  95 ;
2010 DB38         96 SPREG:   IN      38H       ; CHECK FOR AUTO MODE OR
                  97                            ;     ATP OVERSPEED.
2012 E60C         98          ANI     0CH       ; MASK OFF APPROPIATE BITS.
2014 FE0C         99          CPI     0CH       ; COMPARE BITS.
2016 CA2C20      100          JZ      AUTO      ; IN AUTOMATIC AND NOT OVER-
                 101                            ;     SPEED.
2019 AF          102          XRA     A         ; GO INTO B4 STATE.
201A 320B76      103          STA     OUT6A     ; OUTPUT DATA FOR A TRAINLINE
201D 2F          104          CMA               ;     OF B4.
201E D36A        105          OUT     6AH       ; OUTPUT DATA TO TRAINLINES.
```

```
LOC  OBJ        LINE        SOURCE STATEMENT

2020 3A0274     106         LDA     OUTOA   ; GET PROGRAM STOP DATA BITS
2023 E6C0       107         ANI     0C0H    ;     AND MASK OFF.
2025 320274     108         STA     OUTOA   ; STORE ALONG WITH TRAINLINE
2028 2F         109         CMA             ;     DATA.
2029 D30A       110         OUT     0AH     ; OUTPUT DATA TO TRAINLINES.
202B C9         111         RET             ; EXIT SPEED REG. ROUTINE.
202C F3         112 AUTO:   DI              ;DISABLE INTERRUPTS
202D 3A7C75     113         LDA     REFOA   ; SAVE PREVIOUS STATUS OF
2030 F6C0       114         ORI     0C0H    ;     PROGRAM STOP FLAGS.
2032 47         115         MOV     B,A     ; SAVE DATA FOR LATER MASKING.
2033 3A0274     116         LDA     OUTOA   ; GET TRAINLINE STATUS.
2036 F63F       117         ORI     3FH     ; MASK OFF APPROPIATE BITS.
2038 A0         118         ANA     B       ; "AND" WITH PROGRAM STOP BITS.
2039 327C75     119         STA     REFOA   ; STORE IN REFRESH AND OUTPUT
203C 320274     120         STA     OUTOA   ;     BUFFERS.
203F 2A3675     121         LHLD    TREG    ;READ SHARED DATA
2042 222675     122         SHLD    TLMT    ;FROM MARKER PROCESSING
2045 223E75     123         SHLD    SPLMT   ; STORE AS SPEED LIMIT.
2048 2A3075     124         LHLD    TSPD    ;FROM TACH PROCESSING
2048 222075     125         SHLD    SPD     ;ACTUAL SPEED
204E 2A3875     126         LHLD    TTIME   ;TIMER FROM 10MSEC INTERRUPT
2051 222875     127         SHLD    TWAIT   ;DELAY TIMER
2054 3A3275     128         LDA     TPSTP   ;FROM MARKER PROCESSING
2057 322275     129         STA     PRSTP   ;PROGRAM STOP FLAG
205A 3A3375     130         LDA     TGRD    ;FROM MARKER PROCESSING
205D 322375     131         STA     PGRD    ;GRADE MARKER
2060 2A7A75     132         LHLD    TACC    ;FROM ACC PROCESSING
2063 227875     133         SHLD    ACC     ;TRUE ACCELERATION
2066 3A3475     134         LDA     TPWR    ;FROM SERIAL LINK
2069 322475     135         STA     HPWR    ;HALF POWER FLAG
206C FB         136         EI              ;ENABLE INTERRUPTS
206D 2A3E75     137         LHLD    SPLMT   ; CHECK SPEED LIMIT FOR BEING
2070 7C         138         MOV     A,H     ;     ZERO.
2071 B5         139         ORA     L       ; THIS IS TWO BYTES.
2072 CA5D21     140         JZ      OVER    ; IF ZERO, OVERSPEED.
2075 CDAA27     141         CALL    GRDET   ; DETERMINE GRADE QUANTIZED
                142                         ;     LEVEL.
2078 2A2075     143         LHLD    SPD     ;SPD .LE. 23MPH?
207B EB         144         XCHG            ;DE=SPD
207C 21B800     145         LXI     H,SP23  ;23MPH X  8BITS/MPH
207F CD2727     146         CALL    DNEG    ;SPD - 23MPH = H,L
2082 DA9D20     147         JC      DEL1    ;YES SPD => 23MPH
2085 219D01     148         LXI     H,SP50  ;50MPH X  8 BITS/MPH
2088 CD2727     149         CALL    DNEG    ;SPD - 50MPH = H,L
208B DAAC20     150         JC      DEL2    ;YES SPD => 50MPH
208E 21002F     151         LXI     H,TAB50 ; LOAD DELAY MATRIX FROM ROM TO
2091 CD5B27     152         CALL    MATRX   ;     RAM FOR SPEEDS OF GREATER
                153                         ;     THAN 50 MPH.
2094 212128     154         LXI     H,DEL50-TABEN   ; POINT TO DELAY TABLES
                155                         ;     FOR SPEEDS OVER 50 MPH.
2097 CD6B27     156         CALL    MATR1   ; GET GRADE FACTORS FROM TABLE.
209A C3B820     157         JMP     CPWR    ;JUMP TO CHECK GRADE
209D 21002D     158 DEL1:   LXI     H,TAB00 ; LOAD DELAY MATRIX FROM ROM TO
20A0 CD5B27     159         CALL    MATRX   ;     RAM FOR SPEEDS UP TO 23
                160                         ;     MPH.
20A3 21F02A     161         LXI     H,DEL00-TABEN   ; POINT TO DELAY TABLES
                162                         ;     FOR SPEEDS UNDER 23 MPH.
20A6 CD6B27     163         CALL    MATR1   ; GET GRADE FACTORS FROM TABLE.
20A9 C3B820     164         JMP     CPWR    ;JUMP TO CHECK GRADE
20AC 21002E     165 DEL2:   LXI     H,TAB23 ; LOAD DELAY MATRIX FROM ROM TO
20AF CD5B27     166         CALL    MATRX   ;     RAM FOR SPEEDS BETWEEN 23
                167                         ;     AND 50 MPH.
20B2 210F2B     168         LXI     H,DEL23-TABEN   ; POINT TO DELAY TABLES
                169                         ;     FOR SPEEDS FROM 23 TO 50
                170                         ;     MPH.
20B5 CD6B27     171         CALL    MATR1   ; GET GRADE FACTORS FROM TABLE.
20B8 3A2475     172 CPWR:   LDA     HPWR    ;CHECK FOR HALF POWER
20BB A7         173         ANA     A       ;HALF POWER FLAG SET?
20BC CADA20     174         JZ      PSS     ;NO SKIP
20BF AF         175         XRA     A       ;CLEAR CARRY
20C0 3A4175     176         LDA     TRNLN   ;GET PRESENT STATE
20C3 FE06       177         CPI     6       ;IS STATE 6,7,OR 8?
```

```
LOC  OBJ        LINE        SOURCE STATEMENT

20C5 CAD220     178         JZ      SWC     ;YES JUMP
20C8 FE07       179         CPI     7       ;CHECK 7
20CA CAD220     180         JZ      SWC     ;YES JUMP
20CD FE08       181         CPI     8       ;CHECK 8
20CF C2DA20     182         JNZ     PSS     ;NO JUMP
20D2 AF         183 SWC:    XRA     A       ;YES GO TO COAST
20D3 324075     184         STA     TM      ;NEXT STATE IS COAST
20D6 CD5725     185         CALL    PCHG    ;SUBROUTINE TO CHANGE STATES
20D9 C9         186         RET             ;RETURN
20DA 3A2275     187 PSS:    LDA     PRSTP   ;CHECK FOR PROGRAM STOP MARKER
20DD A7         188         ANA     A       ;FLAG SET?
20DE CA0521     189         JZ      PSS1    ;JUMP NOT IN PSTOP
20E1 3A5B75     190         LDA     FPS     ; BEGUN PROCESSING PROGRAM
20E4 A7         191         ANA     A       ;     STOP?
20E5 C2EF20     192         JNZ     PSS2    ; YES.
20E8 3AEB75     193         LDA     MARKUP  ; NO, CHECK FOR MARKER UPDATE.
20EB A7         194         ANA     A       ; FLAG SET?
20EC C20521     195         JNZ     PSS1    ; NO.
20EF 3A862B     196 PSS2:   LDA     PSUP    ; LOAD IN UPPER SPEED
20F2 329775     197         STA     UPB     ;     MAINTAINING LIMIT FOR
20F5 329375     198         STA     UPM     ;     PROGRAM STOP.
20F8 3A882B     199         LDA     PSLW    ; LOAD IN LOWER SPEED MAIN-
20FB 329975     200         STA     LWB     ;     TAINING LIMIT FOR PROGRAM
20FE 329D75     201         STA     LWM     ;     STOP.
2101 CDEA22     202         CALL    PSTOP   ;CALL PROGRAM STOP
2104 C9         203         RET             ;RETURN
2105 AF         204 PSS1:   XRA     A       ;RESET PSTOP FLAGS
2106 325B75     205         STA     FPS     ;ACC OR DEC FLAG
2109 325A75     206         STA     CTF     ;FLARE-OUT COUNTER
210C 325C75     207         STA     FCHK    ;TRANSITION TO PSLMT FLAG
210F 329F75     208         STA     FLOUT   ; IN FLARE-OUT RPOTINE FLAG.
2112 3A802B     209         LDA     SPUP    ; LOAD IN UPPER SPEED MAIN-
2115 329775     210         STA     UPB     ;     TAINING LIMIT FOR SPEED
2118 329B75     211         STA     UPM     ;     MAINTAINING.
211B 3A822B     212         LDA     SPLWB   ; LOAD IN LOWER LIMITS FOR
211E 329975     213         STA     LWB     ;     SPEED BAND AND SPEED
2121 3A842B     214         LDA     SPLW    ;     MARGIN FOR SPEED MAIN-
2124 329D75     215         STA     LWM     ;     TAINING.
2127 CD2B21     216         CALL    SPMAT   ;CALL SPEED MAINTAINING
212A C9         217         RET             ;RETURN
                218 $EJECT
                219 ;----------SPEED MAINTAINING ROUTINE----------
                220 ;SUBROUTINE SPMAT
                221 ;DETERMINES WHETHER WITHIN THE SPEED BAND OR
                222 ;OVER/UNDERSPEED.
                223 ;
212B 2A3E75     224 SPMAT:  LHLD    SPLMT   ;SPLMT-UPB
212E EB         225         XCHG            ;DE=SPLMT
212F 2A9775     226         LHLD    UPB     ;HL=UPB
2132 CD2727     227         CALL    DNEG    ; SPLMT-UPDB.
2135 F23B21     228         JP      UNFL1   ; UNDERFLOW?
2138 210000     229         LXI     H,0     ; YES, SET TO 0.
213B EB         230 UNFL1:  XCHG            ;DE=SPLMT-UPB
213C 2A2075     231         LHLD    SPD     ;HL=SPD
213F CD2727     232         CALL    DNEG    ;SPLMT-UPB-SPD<0?
2142 FA5D21     233         JM      OVER    ;YES OVERSPEED
2145 2A3E75     234         LHLD    SPLMT   ;CHECK FOR UNDERSPEED
2148 EB         235         XCHG            ;DE=SPLMT
2149 2A9975     236         LHLD    LWB     ;HL=LWB
214C CD2727     237         CALL    DNEG    ;SPLMT-LWB
214F EB         238         XCHG            ;DE=SPLMT-LWB
2150 2A2075     239         LHLD    SPD     ;READ SPEED
2153 CD2727     240         CALL    DNEG    ;SPLMT-LWB-SPD>=0?
2156 F26521     241         JP      UNDER   ;YES UNDERSPEED
2159 CD8121     242         CALL    BAND    ;WITHIN SPEED BAND
215C C9         243         RET             ;RETURN
215D 3E0C       244 OVER:   MVI     A,12    ;OVERSPEED
215F 324075     245         STA     TM      ;SET NEW TRAINLINE TO FULL BRAKE
2162 C37421     246         JMP     TLS     ; GO AND OUTPUT NEW TRAINLINE.
2165 3A2475     247 UNDER:  LDA     HPWR    ;UNDERSPEED
2168 A7         248         ANA     A       ;HALF POWER FLAG SET?
2169 C27121     249         JNZ     TLS1    ;YES JUMP
216C 3E08       250         MVI     A,8     ;FULL PROPULSION
```

```
LOC  OBJ        LINE        SOURCE STATEMENT

216E C37421     251         JMP     TLS     ;JUMP
2171 3A802B     252 TLS1:   LDA     HSTAT   ;DEFAULT HALF POWER STATE
2174 324075     253 TLS:    STA     TH      ;STORE NEW TRAINLINE
2177 210000     254         LXI     H,0     ; CLEAR NEW STATE DELAY
217A 224E75     255         SHLD    MDEL    ; PREVENTS WAITING OUT TTIME.
217D CD5626     256         CALL    CHG     ;OUTPUT NEW TL
2180 C9         257         RET             ;RETURN
                258 ;
                259 $EJECT


                260 ;----------------------SPEED BAND SUBROUTINE---------
                261 ;SUBROUTINE BAND
                262 ;CALLED BY SPEED MAINTAINING OR PROGRAM STOP
                263 ;
2181 3A5B75     264 BAND:   LDA     FPS     ;IN PROGRAM STOP?
2184 A7         265         ANA     A       ;SET FLAGS
2185 CA9A21     266         JZ      NORM    ;NO JUMP
2188 FE01       267         CPI     1       ;ACC IN PROG STOP?
218A CAD621     268         JZ      ACCP    ;YES JUMP
218D 21602C     269         LXI     H,PSDC  ; CALCULATE PERMISSION VECTOR
2190 AF         270         XRA     A       ;     FOR DECELERATING IN
2191 3A4175     271         LDA     TRNLN   ;     PROGRAM STOP.
2194 CD5027     272         CALL    VECT    ; VECTOR = PSDC(2*TRNLN).
2197 C3B821     273         JMP     BDEC    ; JUMP TO STORE AS PVEC.
219A 3A7975     274 NORM:   LDA     ACC+1   ;ACC .GE. 0?
219D A7         275         ANA     A       ;SET FLAGS
219E FAAE21     276         JM      B1      ;NO JUMP
21A1 21002C     277         LXI     H,PACC  ; CALCULATE PERMISSION VECTOR
21A4 AF         278         XRA     A       ;     FOR ACCELERATING IN SPEED
21A5 3A4175     279         LDA     TRNLN   ;     MAINTAINING.
21A8 CD5027     280         CALL    VECT    ; VECTOR = PACC(2*TRNLN).
21AB C3E021     281         JMP     BACC    ; JUMP TO STORE AS PVEC.
21AE 21202C     282 B1:     LXI     H,DACC  ; CALCULATE PERMISSION VECTOR
21B1 AF         283         XRA     A       ;     FOR DECELERATING IN SPEED
21B2 3A4175     284         LDA     TRNLN   ;     MAINTAINING.
21B5 CD5027     285         CALL    VECT    ; VECTOR = DACC(2*TRNLN).
21B8 224475     286 BDEC:   SHLD    PVEC    ; STORE PERMISSION VECTOR.
21BB 2A9D75     287         LHLD    LWM     ;DETERMINE STTL
21BE EB         288         XCHG            ;DE=LWM
21BF 2A3E75     289         LHLD    SPLMT   ;HL=SPLMT
21C2 CD2727     290         CALL    DNEG    ;LWM-SPLMT
21C5 FACB21     291         JM      UNFL3   ; OVERFLOW?
21C8 210000     292         LXI     H,0     ; YES, SET TO 0.
21CB EB         293 UNFL3:  XCHG            ;DE=LWM-SPLMT
21CC 2A2075     294         LHLD    SPD     ;HL=SPD
21CF 19         295         DAD     D       ;SPD-SPLMT+LWM
21D0 224675     296         SHLD    STTL    ;STORE
21D3 C3F021     297         JMP     CALC    ;JUMP
21D6 21402C     298 ACCP:   LXI     H,PSAC  ; CALCULATE PERMISSION VECTOR
21D9 AF         299         XRA     A       ;     FOR ACCELERATING IN
21DA 3A4175     300         LDA     TRNLN   ;     PROGRAM STOP.
21DD CD5027     301         CALL    VECT    ; VECTOR = PSAC(2*TRNLN).
21E0 224475     302 BACC:   SHLD    PVEC    ;STORE PERMISSION VECTOR
21E3 2A3E75     303         LHLD    SPLMT   ;DETERMINE STTL
21E6 EB         304         XCHG            ;DE=SPLMT
21E7 2A9B75     305         LHLD    UPM     ;HL=UPM
21EA CD2727     306         CALL    DNEG    ;SPLMT-UPM
21ED F2F321     307         JP      UNFL4   ; UNDERFLOW?
21F0 210000     308         LXI     H,0     ; YES, SET TO 0.
21F3 EB         309 UNFL4:  XCHG            ;DE=SPLMT-UPM
21F4 2A2075     310         LHLD    SPD     ;HL=SPD
21F7 CD2727     311         CALL    DNEG    ;SPLMT-UPM-SPD
21FA 224675     312         SHLD    STTL    ;STORE
21FD AF         313 CALC:   XRA     A       ;INITIALIZE LOOP
21FE 324375     314         STA     CNT     ;ZERO LOOP COUNTER
2201 2A4475     315         LHLD    PVEC    ;HL=PERMISSION VECTOR
                316                         ;ROTATE PERMISSION VECTOR
2204 7C         317 LP:     MOV     A,H     ;ROTATE MSB (STATES 8-15)
2205 1F         318         RAR             ;ROTATE RIGHT THROUGH CARRY
2206 67         319         MOV     H,A     ;SAVE.
2207 7D         320         MOV     A,L     ; ROTATE LSB (STATES 0-7)
2208 1F         321         RAR             ; ROTATE RIGHT THROUGH CARRY.
```

```
LOC  OBJ        LINE        SOURCE STATEMENT

2209 6F         322         MOV     L,A     ; SAVE DATA. CARRY SET?
220A E5         323         PUSH    H       ; SAVE PVEC ON STACK.
220B D21422     324         JNC     NC      ;NO. JUMP
220E CD8F26     325         CALL    TTL     ;CALCULATE TIME-TO-LIMIT
2211 C32322     326         JMP     SKIP    ;JUMP
2214 210075     327 NC:     LXI     H,TTRAN ; CALCULATE LOCATION IN TIME-TO-
2217 AF         328         XRA     A       ;       LIMIT TABLE TO ZERO FOR
2218 3A4375     329         LDA     CNT     ;       NON-PERMITTED TRANSITION.
221B CD5027     330         CALL    VECT    ; VECTOR IS USED AS POINTER.
221E 3E00       331         MVI     A,0     ;ZERO PLACE IN TRANSITION VECTOR
2220 12         332         STAX    D       ;CLEAR MSB
2221 13         333         INX     D       ;INCREMENT POINTER
2222 12         334         STAX    D       ;CLEAR LSB
2223 3A4375     335 SKIP:   LDA     CNT     ;CHECK LOOP COUNTER
2226 3C         336         INR     A       ;INCREMENT
2227 324375     337         STA     CNT     ;STORE
222A 47         338         MOV     B,A     ;STORE TO COMPARE
222B 3A8C28     339         LDA     NSTAT   ;READ DEFAULT STATE
222E B8         340         CMP     B       ;CHECKED ALL STATES?
222F E1         341         POP     H       ; RESTORE PVEC.
2230 C20422     342         JNZ     LP      ; NO. JUMP TO BEGINNING OF LOOP
2233 AF         343 ACT:    XRA     A       ;INITIALIZE LOOP
2234 324375     344         STA     CNT     ;ZERO LOOP COUNTER
2237 3A4175     345         LDA     TRNLN   ;READ PRESENT TRAINLINE
223A 324075     346         STA     TH      ;INITIALIZE TH=TRNLN
223D 2A8E28     347         LHLD    DMAX    ;READ MAX TRANSITION PENALTY
2240 224A75     348         SHLD    CTTL    ;INITIALIZE CTTL=DMAX
2243 210075     349 LP1:    LXI     H,TTRAN ; GET TIME-TO-LIMIT VALUE FOR
2246 AF         350         XRA     A       ;       A PERMITTED TRANSITION
2247 3A4375     351         LDA     CNT     ;       STATE ALLOWED BY PVEC.
224A CD5027     352         CALL    VECT    ; VECTOR = TTRAN(2*VECT).
224D 224C75     353         SHLD    TRANS   ;STORE
2250 7C         354         MOV     A,H     ;CHECK SIGN OF MSB
2251 A7         355         ANA     A       ;SET FLAGS
2252 DA7022     356         JC      LP2     ;TRANS >0?
2255 B5         357         ORA     L       ; CHECK FOR ZERO RESULT.
2256 CA7022     358         JZ      LP2     ;NO JUMP
2259 EB         359         XCHG            ;DE=TRANS
225A 2A4A75     360         LHLD    CTTL    ;TRANS<CTTL?
225D EB         361         XCHG            ;DE=CTTL,HL=TRANS
225E CD2727     362         CALL    DNEG    ;CTTL-TRANS
2261 FA7022     363         JM      LP2     ;NO JUMP
2264 2A4C75     364         LHLD    TRANS   ;SET CTTL=TRANS
2267 224A75     365         SHLD    CTTL    ;STORE
226A 3A4375     366         LDA     CNT     ;SET TH=CNT
226D 324075     367         STA     TH      ;STORE
2270 3A4375     368 LP2:    LDA     CNT     ;READ LOOP COUNTER
2273 3C         369         INR     A       ;INCREMENT
2274 324375     370         STA     CNT     ;STORE
2277 47         371         MOV     B,A     ;STORE TO COMPARE
2278 3A8C28     372         LDA     NSTAT   ;READ DEFAULT STATE
227B B8         373         CMP     B       ;HAVE CHECKED ALL STATES?
227C C24322     374         JNZ     LP1     ;NO GO TO BEGINNING OF LOOP
227F 3A2475     375 CKPWR:  LDA     HPWR    ;HALF POWER?
2282 A7         376         ANA     A       ;CHECK
2283 CA9E22     377         JZ      CHK     ;NO JUMP
2286 3A4075     378         LDA     TH      ;NEW STATE = 6,7,OR8?
2289 FE06       379         CPI     6       ;CHECK 6
228B CA9822     380         JZ      CK2     ;YES JUMP
228E FE07       381         CPI     7       ;CHECK 7
2290 CA9822     382         JZ      CK2     ;YES JUMP
2293 FE08       383         CPI     8       ;CHECK 8
2295 C29E22     384         JNZ     CHK     ;NO JUMP
2298 3A8D23     385 CK2:    LDA     HSTAT   ;READ DEFAULT HALF POWER STATE
229B 324075     386         STA     TH      ;STORE
229E 3A4075     387 CHK:    LDA     TH      ;TH=TRNLN?
22A1 47         388         MOV     B,A     ;B=TH
22A2 3A4175     389         LDA     TRNLN   ;A=TRNLN
22A5 B8         390         CMP     B       ;COMPARE
22A6 CAD722     391         JZ      DON     ;YES DONE
22A9 3A2875     392         LDA     TWAIT   ; GET MSB OF TWAIT.
22AC A7         393         ANA     A       ; TWAIT=0?
22AD C2D722     394         JNZ     DON     ;NO, JUMP
22B0 3A2975     395         LDA     TWAIT+1 ; GET LSB OF TWAIT.
```

```
LOC  OBJ        LINE        SOURCE STATEMENT

22B3 A7          396         ANA     A          ; TWAIT=0?
22B4 C2D722      397         JNZ     DON        ; NO, JUMP.
                 398         GETD    TRNLN,TH           ;READ DT(TRNLN,TH)
22B7 210076      399+        LXI     H,DT       ;GET ADDRESS OF DELAY MATRIX
22BA 3A4175      400+        LDA     TRNLN      ;GET ROW NUMBER
22BD 07          401+        RLC                ;DETERMINE ROW OFFSET
22BE 07          402+        RLC                ;OFFSET = 16*PTL
22BF 07          403+        RLC                ;MULTIPLY BY 16 =
22C0 07          404+        RLC                ;4 SHIFTS LEFT
22C1 E6F0        405+        ANI     0F0H       ;CLEAR LOWER 4 BITS
22C3 5F          406+        MOV     E,A        ;E= ROW OFFSET
22C4 3A4075      407+        LDA     TH         ;GET COLUMN OFFSET
22C7 83          408+        ADD     E          ;ADD TO ROW OFFSET
22C8 5F          409+        MOV     E,A        ;STORE TOTAL OFFSET IN DE
22C9 1600        410+        MVI     D,0        ;CLEAR D
22CB 19          411+        DAD     D          ;ADD OFFSET TO BASE
22CC 7E          412+        MOV     A,M        ;READ MATRIX VALUE INDIRECT
22CD 6F          413         MOV     L,A        ; STORE DT IN NDEL.
22CE 2600        414         MVI     H,0        ; PLACE ZERO IN MSB OF NDEL.
22D0 224E75      415         SHLD    NDEL       ;STORE NEW DELAY TIMER VALUE
22D3 CD5626      416         CALL    CHG        ;CHANGE OUTPUT AND TIMER
22D6 C9          417 CK1:    RET                ;RETURN
22D7 3A7D75      418 DON:    LDA     REF6A      ;REFRESH OUTPUT
22DA 320B74      419         STA     OUT6A      ; STORE IN I/O BUFFER.
22DD 2F          420         CMA                ;INVERSE LOGIC
22DE D36A        421         OUT     6AH        ;OUTPUT TO PORT
22E0 3A7C75      422         LDA     REF0A      ;REFRESH OUTPUT
22E3 320274      423         STA     OUT0A      ; STORE IN I/O BUFFER.
22E6 2F          424         CMA                ;INVERSE LOGIC
22E7 D30A        425         OUT     0AH        ;OUTPUT TO PORT
22E9 C9          426         RET                ;RETURN
                 427 ;
                 428 $EJECT
                 429 ;----------------PROGRAM STOP SUBROUTINE----------
                 430 ;SUBROUTINE PSTOP
                 431 ;CALLED WHEN PROGRAM STOP FLAG PRSTP SET
                 432 ;DETERMINES PROGRAM STOP SPEED LIMIT AND WHEN TO USE IT
                 433 ;
22EA CD7224      434 PSTOP:  CALL    SEEK       ;DETERMINE PSLMT
22ED 2A2675      435         LHLD    TLMT       ;TLMT .GE. PSLMT ?
22F0 EB          436         XCHG               ;DE=TLMT
22F1 2A5075      437         LHLD    PSLMT      ;HL=PSLMT
22F4 CD2727      438         CALL    DNEG       ;TLMT - PSLMT
22F7 FA0C23      439         JM      SPMTN      ;NO, TLMT .LE. PSLMT
22FA AF          440         XRA     A          ;CLEAR A
22FB 325C75      441         STA     FCHK       ;CLEAR FLAG
22FE 2A5075      442         LHLD    PSLMT      ;USE PSLMT AS SPEED LIMIT
2301 223E75      443         SHLD    SPLMT      ;SPLMT = PSLMT
                 444                            ;SPLMT-UPB OVERSPEED?
2304 EB          445         XCHG               ;DE=SPLMT
2305 AF          446         XRA     A          ; CLEAR FLAG FOR USING PROGRAM
2306 329675      447         STA     FLWT       ;     STOP SPEED LIMIT AS THE
2309 C31123      448         JMP     PSMTN      ;     CONTROLLING LIMITER.
230C 3E01        449 SPMTN:  MVI     A,1        ; SET FLAG FOR USING TRACK SPEED
230E 329675      450         STA     FLWT       ;     LIMIT AS CONTROLLING
                 451                            ;     LIMITER.
2311 2A9775      452 PSMTN:  LHLD    UPB        ;HL=UPB
2314 CD2727      453         CALL    DNEG       ;DE-HL=HL
2317 EB          454         XCHG               ;DE=SPLMT-UPB
2318 2A2075      455         LHLD    SPD        ;HL=SPD SPEED
231B EB          456         XCHG               ;SWITCH SPD-(SPLMT-UPB)
231C CD2727      457         CALL    DNEG       ;SPD.GE.SPLMT-UPB?
231F F2B123      458         JP      POVER      ;YES OVERSPEED JUMP
2322 2A942B      459         LHLD    LSP        ;SPD < LSP? FLARE-OUT CHECK
2325 CD2727      460         CALL    DNEG       ;SPD-LSP
2328 F23C23      461         JP      NF         ;NO JUMP
232B 2A5075      462         LHLD    PSLMT      ;READ PROGRAM STOP SPEED LIMIT
232E EB          463         XCHG               ;DE=PSLMT
232F 2A962B      464         LHLD    LPS        ;PSLMT<LPS?
2332 CD2727      465         CALL    DNEG       ;PSLMT-LPS
2335 F23C23      466         JP      NF         ;NO JUMP
2338 CD1E25      467         CALL    FLARE      ;CALL FLARE-OUT
233B C9          468         RET                ;RETURN
                 469                            ;IS SPLMT BELOW PSLMT ?
```

```
LOC  OBJ        LINE        SOURCE STATEMENT

233C 2A3E75     470 NF:     LHLD    SPLMT   ; HL = SPLMT.
233F EB         471         XCHG            ;DE=SPLMT
2340 2A8A2B     472         LHLD    DRP     ;RETURN TO PROPULSION?
2343 CD2727     473         CALL    DNEG    ;SPLMT-DRP
2346 EB         474         XCHG            ;DE=SPLMT-DRP
2347 2A2075     475         LHLD    SPD     ;SPD.LE.SPLMT_DRP?
234A CD2727     476         CALL    DNEG    ;SPLMT-DRP-SPD
234D FA5423     477         JM      CTT     ;NO CONTINUE
2350 CD2B21     478         CALL    SPWAT   ;YES RETURN TO PROPULSION
2353 C9         479         RET             ; DONE.
2354 3A9675     480 CTT:    LDA     FLWT    ; USING TLMT AS SPLMT?
2357 A7         481         ANA     A       ; SET FLAGS.
2358 C2CC23     482         JNZ     WAIT    ; YES.
235B 3A7975     483 NF1:    LDA     ACC+1   ; CHECK SIGN OF ACC.
235E A7         484         ANA     A       ; SET FLAGS.
235F F28D23     485         JP      PAC     ; POSITIVE JUMP.
2362 3A7875     486         LDA     ACC     ;READ ACCELERATION
2365 FEE1       487         CPI     ACM2    ;ACC .GE. -2 MPH/SEC?
2367 F28D23     488         JP      PAC     ;YES ACC RELATIVE TO PSTOP
236A 3E02       489         MVI     A,2     ;SET FLAG FOR DEC IN PSTOP
236C 325875     490         STA     FPS     ;STORE
236F 3A4175     491         LDA     TRNLN   ;SYSYTEM IN COAST ?
2372 A7         492         ANA     A       ;SET FLAGS
2373 CA7A23     493         JZ      LD1     ;YES JUMP TO DONE
2376 CD8121     494         CALL    BAND    ;SPEED MAINTAIN WITH PSLMT
2379 C9         495         RET             ;RETURN
237A 3A7D75     496 LD1:    LDA     REF6A   ;REFRESH OUTPUT
237D 320B74     497         STA     OUT6A   ; STORE IN I/O BUFFER.
2380 2F         498         CMA             ;INVERSE LOGIC
2381 D36A       499         OUT     6AH     ;OUTPUT TO PORT
2383 3A7C75     500         LDA     REF0A   ;REFRESH OUTPUT
2386 320274     501         STA     OUT0A   ; STORE IN I/O BUFFER.
2389 2F         502         CMA             ;INVERSE LOGIC
238A D30A       503         OUT     0AH     ;OUTPUT TO PORT
238C C9         504         RET             ;RETURN
238D 3E01       505 PAC:    MVI     A,1     ;ACC IN PSTOP
238F 325875     506         STA     FPS     ;SET FLAG
2392 3A4175     507         LDA     TRNLN   ;IN EMERGENCY BRAKING ?
2395 FE0D       508         CPI     13      ;COMPARE.
2397 CA9E23     509         JZ      LA2     ;YES JUMP TO DONE
239A CD8121     510         CALL    BAND    ;SPEED MAINTAIN WITH PSLMT
239D C9         511         RET             ;RETURN
239E 3A7D75     512 LA2:    LDA     REF6A   ;REFRESH OUTPUT
23A1 320B74     513         STA     OUT6A   ; STORE IN I/O BUFFER.
23A4 2F         514         CMA             ;INVERSE LOGIC
23A5 D36A       515         OUT     6AH     ;OUTPUT TO PORT
23A7 3A7C75     516         LDA     REF0A   ;REFRESH OUTPUT
23AA 320274     517         STA     OUT0A   ; STORE IN OUTPUT BUFFER.
23AD 2F         518         CMA             ;INVERSE LOGIC
23AE D30A       519         OUT     0AH     ;OUTPUT TO PORT
23B0 C9         520         RET             ;RETURN
                521                         ;PROGRAM STOP OVERSPEED
23B1 3A9F75     522 POVER:  LDA     FLOUT   ; GET FLARE-OUT FLAG.
23B4 A7         523         ANA     A       ; IN FLARE-OUT ROUTINE?
23B5 C21E25     524         JNZ     FLARE   ; YES, GO TO FLARE-OUT ROUTINE.
23B8 3A9675     525         LDA     FLWT    ; GET SPEED LIMIT CONTROL FLAG.
23BB A7         526         ANA     A       ; USING PROGRAM STOP SPEED
                527                         ;      LIMIT.
23BC CA5B23     528         JZ      NF1     ; YES, CHECK FOR SPECIAL TTL.
23BF AF         529         XRA     A       ;CLEAR A
23C0 325C75     530         STA     FCHK    ;CLEAR FLAG
23C3 3E0C       531         MVI     A,12    ;SWITCH TO FULL SERVICE BRAKE
23C5 324075     532         STA     TH      ;TH=12
23C8 CD5725     533         CALL    PCHG    ;CHANGE STATES IMMEDIATELY
23CB C9         534         RET             ;RETURN
                535                         ;SPEED LIMIT BELOW PROGRAM
                536                         ;      STOP SPEED LIMIT?
23CC 3A5C75     537 WAIT:   LDA     FCHK    ;ALREADY MADE TRANSITION TO 9?
23CF FE01       538         CPI     1       ;FCHK SET ?
23D1 C2E723     539         JNZ     WTT     ;NO JUMP
23D4 3A7D75     540         LDA     REF6A   ;REFRESH OUTPUT
23D7 320B74     541         STA     OUT6A   ; STORE IN I/O BUFFER.
23DA 2F         542         CMA             ;INVERSE LOGIC
```

```
LOC  OBJ        LINE        SOURCE STATEMENT

23DB D36A        543         OUT     6AH       ;OUTPUT TO PORT
23DD 3A7C75      544         LDA     REFOA     ;REFRESH OUTPUT
23E0 320274      545         STA     OUTOA     ; STORE IN I/O BUFFER.
23E3 2F          546         CMA               ;INVERSE LOGIC
23E4 D30A        547         OUT     0AH       ;OUTPUT TO PORT
23E6 C9          548         RET               ;RETURN
23E7 3A7975      549 WTT:    LDA     ACC+1     ; GET SIGN OF ACCELERATION.
23EA A7          550         ANA     A         ; SET FLAGS.
23EB F2FE23      551         JP      NTTL      ; POSITIVE, CAL. SPECIAL TTL
23EE 3A7875      552         LDA     ACC       ;READ ACCELERATION
23F1 FEE1        553         CPI     ACM2      ;ACC .GE. -2 MPH/SEC ?
23F3 F2FE23      554         JP      NTTL      ;YES CALCULATE SPECIAL TTL
23F6 AF          555         XRA     A         ;NO CLEAR A
23F7 325875      556         STA     FPS       ;SET FLAG TO NOT USING PSLMT
23FA CD2B21      557         CALL    SPMAT     ;SPEED MAINTAIN AS NORMAL
23FD C9          558         RET               ;RETURN
23FE 2A3E75      559 NTTL:   LHLD    SPLMT     ; HL=SPLMT.
2401 EB          560         XCHG              ; DE=SPLMT.
2402 2A9975      561         LHLD    LWB       ; HL=LWB.
2405 CD2727      562         CALL    DNEG      ; HL=SPLMT-LWB.
2408 EB          563         XCHG              ; DE=SPLMT-LWB.
2409 2A2075      564         LHLD    SPD       ; HL=SPD.
240C CD2727      565         CALL    DNEG      ; HL=SPLMT-LWB-SPD.
240F F26A24      566         JP      NRED      ; NOT IN BAND, DON'T DO SPECAIL
                 567                           ;      TTL CALCULATION.
2412 2A5075      568         LHLD    PSLMT     ;SPECIAL TTL CALCULATION
2415 EB          569         XCHG              ;DE = PSLMT
2416 2A2075      570         LHLD    SPD       ;HL=SPD
2419 CD2727      571         CALL    DNEG      ;PSLMT-SPD
241C 225675      572         SHLD    PSDIF     ;STORE VELOCITY ERROR
241F EB          573         XCHG              ;DE=PSDIF
2420 3E64        574         MVI     A,100     ;SCALE FACTOR
2422 CD2E27      575         CALL    DMULT     ;100*PSDIF = HL
2425 227275      576         SHLD    TTLP      ;TEMPORARY STORAGE
                 577         GETD    TRNLN,BSTAT      ;READ DT(TRNLN,BSTAT)
2428 210076      578+        LXI     H,DT      ;GET ADDRESS OF DELAY MATRIX
242B 3A4175      579+        LDA     TRNLN     ;GET ROW NUMBER
242E 07          580+        RLC               ;DETERMINE ROW OFFSET
242F 07          581+        RLC               ;OFFSET = 16*PTL
2430 07          582+        RLC               ;MULTIPLY BY 16 =
2431 07          583+        RLC               ;4 SHIFTS LEFT
2432 E6F0        584+        ANI     0F0H      ;CLEAR LOWER 4 BITS
2434 5F          585+        MOV     E,A       ;E= ROW OFFSET
2435 3A902B      586+        LDA     BSTAT     ;GET COLUMN OFFSET
2438 83          587+        ADD     E         ;ADD TO ROW OFFSET
2439 5F          588+        MOV     E,A       ;STORE TOTAL OFFSET IN DE
243A 1600        589+        MVI     D,0       ;CLEAR D
243C 19          590+        DAD     D         ;ADD OFFSET TO BASE
243D 7E          591+        MOV     A,M       ;READ MATRIX VALUE INDIRECT
243E 5F          592         MOV     E,A       ;E=DT(TRNLN,BSTAT)
243F 1600        593         MVI     D,0       ;CLEAR D
2441 2A6475      594         LHLD    FF        ;READ DELAY DUE TO GRADE
2444 19          595         DAD     D         ;ADD FF+DT
2445 EB          596         XCHG              ;DE = DEL+FF
2446 3A7875      597         LDA     ACC       ;ADJUST ACCELERATION FOR PSTOP
2449 C61F        598         ADI     ACP2      ;ADD 2 MPH/SEC
244B CD2E27      599         CALL    DMULT     ;(DEL+FF)*(ACC+2)=HL
244E EB          600         XCHG              ;DE = RESULT
244F 2A7275      601         LHLD    TTLP      ;READ PSLMT-SPD
2452 CD2727      602         CALL    DNEG      ;((DEL+FF)*(ACC+2))-(PSLMT-SPD)
2455 225875      603         SHLD    TTLC      ;STORE SPECIAL TTL
2458 FA6A24      604         JM      NRED      ;IF NEGATIVE DON'T SWITCH
245B 3E01        605         MVI     A,1       ;A=1
245D 325C75      606         STA     FCHK      ;SET FLAG TO INDICATE SWITCH
2460 3A902B      607         LDA     BSTAT     ;GET DEFAULT SYSTEM BRAKE STATE
2463 324075      608         STA     TH        ;STORE
2466 CD5725      609         CALL    PCHG      ;ELSE CHANGE STATES
2469 C9          610         RET               ;RETURN
246A AF          611 NRED:   XRA     A         ;SPEED MAINTAIN AS NORMAL
246B 325B75      612         STA     FPS       ;CLEAR NOT USING PSLMT FLAG
246E CD2B21      613         CALL    SPMAT     ;CALL SPEED MAINTAINING ROUTINE
2471 C9          614         RET               ;RETURN
                 615 ;
                 615 $EJECT
```

```
LOC  OBJ        LINE        SOURCE STATEMENT

                617 ;-------------TABLE SEARCH SUBROUTINE-----------
                618 ;SUBROUTINE SEEK
                619 ;SEARCHES PROGRAM STOP SPEED LIMIT TABLE BASED ON LOWER
                620 ;TWO BYTES OF THE DISTANCE-TO-GO COUNTER.
                621 ;THE HIGHEST BYTE OF THE 3 BYTE COUNTER IS USED
                622 ;TO CHOOSE ONE OF FOUR TABLES IN ROM. NOTE EACH TABLE
                623 ;IS ASSUMED TO BEGIN AND END WITH 0000H AND FFFFH
                624 ;RESPECTIVELY.
                625 ;
2472 F3         626 SEEK:   DI                  ;DISABLE INTERRUPTS TO READ DATA
2473 3A3C75     627         LDA     DTG+2       ;READ MSBS OF DTG COUNTER
2476 322C75     628         STA     MDTG        ;STORE
2479 2A3A75     629         LHLD    DTG         ;READ LSBS OF DTG COUNTER
247C 222A75     630         SHLD    LDTG        ;STORE
247F FB         631         EI                  ;ENABLE INTERRUPTS
2480 3A2C75     632         LDA     MDTG        ;GET THIRD BYTE OF DTG COUNTER
2483 47         633         MOV     B,A         ;MOVE TO REGISTER B
2484 3A2F75     634         LDA     PDTG        ;MDTG=PDTG?
2487 B8         635         CMP     B           ;COMPARE
2488 CAAB24     636         JZ      SE1         ;YES JUMP
248B 78         637         MOV     A,B         ;A=MDTG+1
248C FE00       638         CPI     0           ;MDTG=0?
248E CAB424     639         JZ      SE2         ;YES JUMP
2491 FE01       640         CPI     1           ;MDTG=1?
2493 CABA24     641         JZ      SE3         ;YES JUMP
2496 FE02       642         CPI     2           ;MTDG=2?
2498 CAC024     643         JZ      SE4         ;YES JUMP
249B AF         644         XRA     A           ;DEFAULT MDTG
249C 322C75     645         STA     MDTG        ; STORE ZERO IN ALL THREE BYTES
249F 210000     646         LXI     H,0         ;     OF DISTANCE TO GO COUNTER
24A2 222A75     647         SHLD    LDTG        ;     LOCATED IN RAM.
24A5 210028     648         LXI     H,TAB0      ;DEFAULT PTR=TAB3
24A8 C3C324     649         JMP     SE5         ;JUMP
24AB 2A5475     650 SE1:    LHLD    PPTR        ;READ OLD TABLE POINTER
24AE 225275     651         SHLD    PTR         ;USE AS NEW PTR
24B1 C3C624     652         JMP     STOR        ;JUMP
24B4 210028     653 SE2:    LXI     H,TAB0      ;PTR=TAB0
24B7 C3C324     654         JMP     SE5         ;JUMP
24BA 21802A     655 SE3:    LXI     H,TAB1      ;PTR=TAB1
24BD C3C324     656         JMP     SE5         ;JUMP
24C0 21E02A     657 SE4:    LXI     H,TAB2      ;PTR=TAB2
24C3 225275     658 SE5:    SHLD    PTR         ;STORE NEW POINTER
24C6 3A2C75     659 STOR:   LDA     MDTG        ;SET PDTG=MDTG
24C9 322F75     660         STA     PDTG        ;STORE MDTG FOR NEXT TIME
24CC 2A2A75     661         LHLD    LDTG        ;INITIALIZE THE LOOP
24CF EB         662         XCHG                ;DE=LDTG
24D0 2A5275     663         LHLD    PTR         ;HL=POINTER
24D3 23         664 FIST:   INX     H           ; INCREMENT DISTANCE POINTER.
24D4 7E         665         MOV     A,M         ;GET MSB OF LDTG
24D5 47         666         MOV     B,A         ;STORE IN B FOR LATER COMPARISON
24D6 BA         667         CMP     D           ;COMPARE WITH MSB OF LDTG
24D7 2B         668         DCX     H           ; DECREMENT PTR NO FLAGS
                669                             ;     AFFECTED
24D8 C2E424     670         JNZ     SE6         ;NOT EQUAL JUMP
24DB 7E         671         MOV     A,M         ;CHECK LSB OF LDTG FOR EQUALITY
24DC 6F         672         MOV     L,A         ;STORE FOR LATER COMPARISON
24DD BB         673         CMP     E           ;COMPARE
24DE CA0125     674         JZ      GET         ;IF EQUAL GO AND GET
24E1 C3E624     675         JMP     SE7         ;IF NOT JUMP
24E4 7E         676 SE6:    MOV     A,M         ;SINCE NOT EQUAL
24E5 6F         677         MOV     L,A         ;GET LOWER BYTE
24E6 60         678 SE7:    MOV     H,B         ;LDTG>DTG (@PTR)?
24E7 CD2727     679         CALL    DNEG        ;LDTG-DTG (@PTR)=HL
24EA D21125     680         JNC     BK1         ;YES BACKUP
24ED 2A5275     681 SE8:    LHLD    PTR         ;GO FORWARD
24F0 23         682         DCX     H           ;PTR=PTR+4
24F1 2B         683         DCX     H           ;INCREMENT
24F2 2B         684         DCX     H           ;BY 3
24F3 2B         685         DCX     H           ;BY 4
24F4 225275     686         SHLD    PTR         ;STORE
24F7 46         687 S2ND:   MOV     B,M         ; B=TEMPORARY STORE.
```

```
LOC  OBJ        LINE        SOURCE STATEMENT

24F8 23          688         INX     H       ;INCREMENT
24F9 66          689         MOV     H,M     ;STORE
24FA 68          690         MOV     L,B     ;HL = VALUE FROM MEMORY
24FB CD2727      691         CALL    DNEG    ;LDTG .GE. DTG(@PTR) ?
24FE FAED24      692         JM      SE8     ;NO JMP TO GO FORWARD
2501 2A5275      693 GET:    LHLD    PTR     ;YES GET PSLMT
2504 225475      694         SHLD    PPTR    ;STORE PTR FOR NEXT TIME
2507 23          695         INX     H       ;PSLMT = @(PTR+2)
2508 23          696         INX     H       ;INCREMENT BY 2
2509 5E          697         MOV     E,M     ;READ LSB INDIRECT
250A 23          698         INX     H       ;INCREMENT PTR
250B 56          699         MOV     D,M     ;READ MSB INDIRECT
250C EB          700         XCHG            ;HL = PSLMT
250D 225075      701         SHLD    PSLMT   ;STORE
2510 C9          702         RET             ;RETURN
2511 2A5275      703 BK1:    LHLD    PTR     ;BACKUP
2514 23          704         INX     H       ;PTR=PTR-4
2515 23          705         INX     H       ;DECREMENT PTR 4 TIMES
2516 23          706         INX     H       ;BY 3
2517 23          707         INX     H       ;BY 4
2518 225275      708         SHLD    PTR     ;STORE
251B C3D324      709         JMP     F1ST    ;JUMP TO F1ST LOOP
                 710 $EJECT

                 711 ;--------------FLARE-OUT SUBROUTINE-------------
                 712 ;SUBROUTINE FLARE
                 713 ;CALLED BY PSTOP WHEN SPD < LSP AND PSLMT < LPS.
                 714 ;HLDS SYSTEM IN COAST FOR FTIM PROGRAM LOOPS THEN
                 715 ;APPLIES FULL BRAKE.
                 716 ;
251E 3E01        717 FLARE:  MVI     A,1     ; SET IN FLARE-OUT ROUTINE
2520 329F75      718         STA     FLOUT   ;     FLAG.
2523 AF          719         XRA     A       ;CLEAR A
2524 324075      720         STA     TH      ;GO TO COAST TH=0
2527 3A5A75      721         LDA     CTF     ;CHECK TIME IN COAST
252A 3C          722         INR     A       ;INCREMENT COUNTER
252B 325A75      723         STA     CTF     ;STORE  COUNTER
252E 47          724         MOV     B,A     ;STORE TO COMPARE
252F 3A912B      725         LDA     FTIM    ;READ DEFAULT LOOP COUNT
2532 B8          726         CMP     B       ;COMPARE CTF>=FTIM?
2533 CA3925      727         JZ      FDD     ;YES JUMP
2536 F25325      728         JP      FDC     ;NO JUMP
2539 3A5175      729 FDD:    LDA     PSLMT+1 ; PROGRAM STOP SPEED LIMIT
253C A7          730         ANA     A       ;     BELOW 32 MPH.?
253D C25325      731         JNZ     FDC     ; NO.
2540 3A5075      732         LDA     PSLMT   ; PROGRAM STOP SPEED LIMIT
2543 FE18        733         CPI     18H     ;     BELOW 5 MPH.?
2545 F25325      734         JP      FDC     ; NO.
2548 3A912B      735 FDD1:   LDA     FTIM    ; GET TIMER CHECK DATA.
254B 325A75      736         STA     CTF     ;SET CTF (RESET BY PSTOP)
254E 3E0C        737         MVI     A,12    ;YES SET NEW TRAINLINE
2550 324075      738         STA     TH      ;STORE TH=12
2553 CD5725      739 FDC:    CALL    PCHG    ;CHANGE STATES
2556 C9          740         RET             ;RETURN
                 741 ;
                 742 $EJECT
                 743 ;----------CHANGE STATES IMMEDIATELY SUBROUTINE-------
                 744 ;SUBROUTINE PCHG
                 745 ;CALLED FOR ALL IMMEDIATE STATE CHANGES.
                 746 ;RESETS TIMER AND CALLS CHG.
                 747 ;
2557 3A4075      748 PCHG:   LDA     TH      ;READ DESIRED TL
255A 47          749         MOV     B,A     ;MOVE TO COMPARE
255B 3A4175      750         LDA     TRNLN   ;TH=TRNLN ??
255E B8          751         CMP     B       ;COMPARE
255F C27525      752         JNZ     PC1     ;NO JUMP
2562 3A7D75      753         LDA     REF6A   ;REFRESH OUTPUT
2565 320B74      754         STA     OUT6A   ; STORE IN I/O BUFFER.
2568 2F          755         CMA             ;INVERSE LOGIC
2569 D36A        756         OUT     6AH     ;OUTPUT TO PORT
256B 3A7C75      757         LDA     REF0A   ;REFRESH OUTPUT
```

```
LOC  OBJ        LINE        SOURCE STATEMENT

256E 320274     758         STA     OUTOA     ; STORE IN I/O BUFFER.
2571 2F         759         CMA               ;INVERSE LOGIC
2572 D30A       760         OUT     0AH       ;OUTPUT TO PORT
2574 C9         761         RET               ;RETURN
                762 PC1:    GETD    TRNLN,TH          ;READ DT(TRNLN,TH)
2575 210076     763+        LXI     H,DT      ;GET ADDRESS OF DELAY MATRIX
2578 3A4175     764+        LDA     TRNLN     ;GET ROW NUMBER
257B 07         765+        RLC               ;DETERMINE ROW OFFSET
257C 07         766+        RLC               ;OFFSET = 16*PTL
257D 07         767+        RLC               ;MULTIPLY BY 16 =
257E 07         768+        RLC               ;4 SHIFTS LEFT
257F E6F0       769+        ANI     0F0H      ;CLEAR LOWER 4 BITS
2581 5F         770+        MOV     E,A       ;E= ROW OFFSET
2582 3A4075     771+        LDA     TH        ;GET COLUMN OFFSET
2585 83         772+        ADD     E         ;ADD TO ROW OFFSET
2586 5F         773+        MOV     E,A       ;STORE TOTAL OFFSET IN DE
2587 1600       774+        MVI     D,0       ;CLEAR D
2589 19         775+        DAD     D         ;ADD OFFSET TO BASE
258A 7E         776+        MOV     A,M       ;READ MATRIX VALUE INDIRECT
258B 6F         777         MOV     L,A       ; STORE DT IN DEL.
258C 2600       778         MVI     H,0       ; ZERO MSB OF DEL.
258E 226675     779         SHLD    DEL       ;STORE
                780         DIRM    TH2,TRNLN         ;FROM TH2 TO TRNLN
2591 3A4175     781+        LDA     TRNLN     ;GET TO STATE
2594 FE09       782+        CPI     9         ;IN PROPULSION?
2596 F2B125     783+        JP      ??0002    ;NO IN BRAKE
2599 3A4275     784+        LDA     TH2       ;FROM AND TO STATES IN PROP?
259C FE09       785+        CPI     9         ;COMPARE
259E F2C425     786+        JP      ??0003    ;YES SET FLAG TO ZERO
25A1 47         787+        MOV     B,A       ;TO >= FROM?
25A2 3A4175     788+        LDA     TRNLN     ;GET TO STATE
25A5 90         789+        SUB     B         ;TO STATE - FROM STATE
25A6 F2C425     790+        JP      ??0003    ;YES SET FLAG TO ZERO
25A9 3E01       791+??0001: MVI     A,1       ;MOVING DOWN
25AB 326875     792+        STA     UPDN      ;SET UPDN FLAG
25AE C3C825     793+        JMP     ??0004    ;DONE
25B1 3A4275     794+??0002: LDA     TH2       ;IN BRAKE CHECK FROM STATE
25B4 FE09       795+        CPI     9         ;IN PROPULSION?
25B6 FAA925     796+        JM      ??0001    ;YES SET FLAG TO ONE
25B9 3A4175     797+        LDA     TRNLN     ;FROM >= TO?
25BC 47         798+        MOV     B,A       ;B=TSTA
25BD 3A4275     799+        LDA     TH2       ;A=FSTA
25C0 90         800+        SUB     B         ;FROM - TO
25C1 FAA925     801+        JM      ??0001    ;NO SET FLAG TO ONE
25C4 AF         802+??0003: XRA     A         ;MOVING UP
25C5 326875     803+        STA     UPDN      ;ZERO FLAG
                804+??0004:                   ;DONE
25C8 3A6875     805         LDA     UPDN      ;READ FLAG
25CB 327475     806         STA     DIR1      ;STORE
                807         DIRM    TRNLN,TH          ;FROM TH TO TRNLN
25CE 3A4075     808+        LDA     TH        ;GET TO STATE
25D1 FE09       809+        CPI     9         ;IN PROPULSION?
25D3 F2EE25     810+        JP      ??0006    ;NO IN BRAKE
25D6 3A4175     811+        LDA     TRNLN     ;FROM AND TO STATES IN PROP?
25D9 FE09       812+        CPI     9         ;COMPARE
25DB F20126     813+        JP      ??0007    ;YES SET FLAG TO ZERO
25DE 47         814+        MOV     B,A       ;TO >= FROM?
25DF 3A4075     815+        LDA     TH        ;GET TO STATE
25E2 90         816+        SUB     B         ;TO STATE - FROM STATE
25E3 F20126     817+        JP      ??0007    ;YES SET FLAG TO ZERO
25E6 3E01       818+??0005: MVI     A,1       ;MOVING DOWN
25E8 326875     819+        STA     UPDN      ;SET UPDN FLAG
25EB C30526     820+        JMP     ??0008    ;DONE
25EE 3A4175     821+??0006: LDA     TRNLN     ;IN BRAKE CHECK FROM STATE
25F1 FE09       822+        CPI     9         ;IN PROPULSION?
25F3 FAE625     823+        JM      ??0005    ;YES SET FLAG TO ONE
25F6 3A4075     824+        LDA     TH        ;FROM >= TO?
25F9 47         825+        MOV     B,A       ;B=TSTA
25FA 3A4175     826+        LDA     TRNLN     ;A=FSTA
25FD 90         827+        SUB     B         ;FROM - TO
25FE FAE625     828+        JM      ??0005    ;NO SET FLAG TO ONE
2601 AF         829+??0007: XRA     A         ;MOVING UP
2602 326875     830+        STA     UPDN      ;ZERO FLAG
```

```
LOC  OBJ        LINE        SOURCE STATEMENT

                831+??0008:                     ;DONE
2605 3A6875     832         LDA     UPDN        ;READ FLAG
2608 47         833         MOV     B,A         ;STORE IN B
2609 3A7475     834         LDA     DIR1        ;SAME DIRECTION
260C B8         835         CMP     B           ;COMPARE
260D CA4426     836         JZ      CADD        ;YES ADD
2610 2A6675     837 CSUB:   LHLD    DEL         ;GET DELAY
2613 EB         838         XCHG                ;DE = DEL
2614 2A2875     839         LHLD    TWAIT       ;HL = TWAIT
2617 CD2727     840         CALL    DNEG        ;DEL - TWAIT
261A FA3726     841         JM      ABSS        ;IF NEG FIND ABS
261D 224E75     842 ANS:    SHLD    NDEL        ;STORE ADJUSTED DELAY
2620 EB         843         XCHG                ;DE = NDEL
2621 2A9228     844         LHLD    MDEL        ;MAXIMUM DELAY
2624 CD2727     845         CALL    DNEG        ;NDEL - MDEL
2627 FA3326     846         JM      ANZ1        ;IF NEG SET DEFAULT
262A CA3326     847         JZ      ANZ1        ;IF ZERO SET DEFAULT
262D 2A9228     848         LHLD    MDEL        ;SET DEFAULT
2630 224E75     849         SHLD    NDEL        ;STORE
2633 CD5626     850 ANZ1:   CALL    CHG         ;RESET TIMER
2636 C9         851         RET                 ;RETURN
2637 7D         852 ABSS:   MOV     A,L         ;2'S COMPLEMENT
2638 2F         853         CMA                 ;COMPLEMENT
2639 6F         854         MOV     L,A         ;RESTORE
263A 7C         855         MOV     A,H         ;MSB
263B 2F         856         CMA                 ;COMPLEMENT
263C 67         857         MOV     H,A         ;RESTORE
263D 110100     858         LXI     D,1         ;ADD 1
2640 19         859         DAD     D           ;ADD
2641 C31D26     860         JMP     ANS         ;JUMP
2644 AF         861 CADD:   XRA     A           ;CLEAR CARRY
2645 2A2875     862         LHLD    TWAIT       ;READ REMAINING TIME
2648 EB         863         XCHG                ;DE=TWAIT
2649 2A6675     864         LHLD    DEL         ;HL=DELAY DUE TO NEW TRANSITION
264C 19         865         DAD     D           ;ADD DELAYS
264D D21D26     866         JNC     ANS         ;JUMP IF NO OVERFLOW
2650 21FFFF     867         LXI     H,0FFFFH            ;SET TO MAX VALUE
2653 C31D26     868         JMP     ANS         ;JUMP
                869 ;
                870 $EJECT
                871 ;-----------------TRAINLINE OUTPUT SUBROUTINE--------
                872 ;SUBROUTINE CHG
                873 ;RESETS DELAY TIMER TO NDEL
                874 ;STORES PREVIOUS TRAINLINE,OUTPUTS NEW TRAINLINE
                875 ;AND STORES PRESENT TRAINLINE.
                876 ;CALLED FROM BAND OR PCHG.
                877 ;NDEL PASSED TO TTIME IN HL REGISTER.
                878 ;
2656 F3         879 CHG:    DI                  ;DISABLE INTERRUPTS
2657 2A4E75     880         LHLD    NDEL        ;TTIME=NDEL
265A 223875     881         SHLD    TTIME       ;RESET TIMER
265D FB         882         EI                  ;ENABLE INTERRUPTS
265E 3A4175     883         LDA     TRNLN       ;STORE PRESENT TL
2661 324275     884         STA     TH2         ;PREVIOUS TL
2664 3A4075     885         LDA     TH          ;STORE NEW TL
2667 324175     886         STA     TRNLN       ;PRESENT TL
266A 21802C     887         LXI     H,TLO       ; GET TRAINLINE OUTPUT DATA FOR
266D AF         888         XRA     A           ;     OUTPUT PORTS FOR A DESIRED
266E 3A4175     889         LDA     TRNLN       ;     TRAINLINE.
2671 CD5027     890         CALL    VECT        ; VECTOR = TLO(2*TRNLN).
2674 7C         891         MOV     A,H         ;MOVE MSB TO A
2675 320B74     892         STA     OUT6A       ; STORE IN I/O BUFFER.
2678 327D75     893         STA     REF6A       ; STORE IN REFRESH BUFFER.
267B 2F         894         CMA                 ;REVERSE LOGIC
267C D36A       895         OUT     06AH        ;OUTPUT
267E 45         896         MOV     B,L         ;MOVE LSB TO B
267F 3A0274     897         LDA     OUT0A       ;MASK UPPER TWO BITS
2682 F63F       898         ORI     3FH         ;     FOR PROGRAM STOP BITS.
2684 A0         899         ANA     B           ;AND WITH OUTPUT
2685 320274     900         STA     OUT0A       ; STORE IN I/O BUFFER.
2688 327C75     901         STA     REF0A       ; STORE IN REFRESH BUFFER.
268B 2F         902         CMA                 ;REVERSE LOGIC
```

```
LOC  OBJ        LINE        SOURCE STATEMENT

268C D30A        903          OUT     0AH     ;OUTPUT
268E C9          904          RET             ;RETURN
                 905 ;
                 906 $EJECT

                 907 ;-----------------TIME-TO-LIMIT SUBROUTINE-----------
                 908 ;SUBROUTINE TTL
                 909 ;SUBROUTINE TO CALCULATE TIME-TO-LIMIT FOR A
                 910 ;TRANSITION AND STORES RESULT IN TTRAN VECTOR.
                 911 ;VALUE TO INDEX DELAY PASSED IN CNT .
                 912 ;
                 913 TTL:     GETD    TRNLN,CNT       ;GET DT(TRNLN,CNT)=A
268F 210076      914+         LXI     H,DT    ;GET ADDRESS OF DELAY MATRIX
2692 3A4175      915+         LDA     TRNLN   ;GET ROW NUMBER
2695 07          916+         RLC             ;DETERMINE ROW OFFSET
2696 07          917+         RLC             ;OFFSET = 16*PTL
2697 07          918+         RLC             ;MULTIPLY BY 16 =
2698 07          919+         RLC             ;4 SHIFTS LEFT
2699 E6F0        920+         ANI     0F0H    ;CLEAR LOWER 4 BITS
269B 5F          921+         MOV     E,A     ;E= ROW OFFSET
269C 3A4375      922+         LDA     CNT     ;GET COLUMN OFFSET
269F 83          923+         ADD     E       ;ADD TO ROW OFFSET
26A0 5F          924+         MOV     E,A     ;STORE TOTAL OFFSET IN DE
26A1 1600        925+         MVI     D,0     ;CLEAR D
26A3 19          926+         DAD     D       ;ADD OFFSET TO BASE
26A4 7E          927+         MOV     A,M     ;READ MATRIX VALUE INDIRECT
26A5 5F          928          MOV     E,A     ;STORE DT(TRNLN,CNT) IN DE
26A6 1600        929          MVI     D,0     ;CLEAR D
26A8 3A5B75      930          LDA     FPS     ;NOT IN PSTOP?
26AB A7          931          ANA     A       ;SET FLAGS
26AC CAD626      932          JZ      MSP     ;YES NOT IN PSTOP JUMP
26AF FE01        933          CPI     1       ;ACC OR DEC?
26B1 CAC626      934          JZ      ACCPS   ;JUMP IF ACC
26B4 2A6475      935 DECPS:   LHLD    FF      ;READ DELAY DUE TO GRADE
26B7 19          936          DAD     D       ;DT(TRNLN,CNT)+FF
26B8 EB          937          XCHG            ;DE =LIMIT
26B9 3A7875      938          LDA     ACC     ;READ NEGATIVE ACC
26BC 2F          939          CMA             ;ABS VALUE OF ACC
26BD 3C          940          INR     A       ;2'S COMPLEMENT
26BE DE1F        941          SBI     ACP2    ;ABS(ACC)-2 MPH/SEC
26C0 CD2E27      942          CALL    DMULT   ;ADJUSTED ACC*LIMIT
26C3 C3F826      943          JMP     STR     ;JUMP
26C6 2A6475      944 ACCPS:   LHLD    FF      ;READ DELAY DUE TO GRADE
26C9 19          945          DAD     D       ;DT(TRNLN,CNT)+FF
26CA EB          946          XCHG            ;DE=LIMIT
26CB 3A7875      947          LDA     ACC     ;READ POSITIVE ACC
26CE C61F        948          ADI     ACP2    ;ACC = ACC+2 MPH/SEC
26D0 CD2E27      949          CALL    DMULT   ;ADJUSTED ACC*LIMIT
26D3 C3F826      950          JMP     STR     ;JUMP
26D6 3A7975      951 MSP:     LDA     ACC+1   ;NOT IN PSTOP
26D9 A7          952          ANA     A       ;ACC.GE.0?
26DA F2ED26      953          JP      ACCSP   ;YES JUMP
26DD 2A6275      954          LHLD    EE      ;GET DELAY DUE TO GRADE
26E0 19          955          DAD     D       ;DT(TRNLN,CNT)+EE
26E1 EB          956          XCHG            ;DE=LIMIT
26E2 3A7875      957          LDA     ACC     ; GET VALUE FOR ACCELERATION.
26E5 2F          958          CMA             ;ABS VALUE OF ACC
26E6 3C          959          INR     A       ;2'S COMPLEMENT
26E7 CD2E27      960          CALL    DMULT   ;ACC*LIMIT
26EA C3F826      961          JMP     STR     ;JUMP
26ED 2A6075      962 ACCSP:   LHLD    DD      ;NOT IN PSTOP
26F0 19          963          DAD     D       ;DT(TRNLN,CNT)+DD
26F1 EB          964          XCHG            ;DE = LIMIT
26F2 3A7875      965          LDA     ACC     ;READ POSITIVE ACCELRATION
26F5 CD2E27      966          CALL    DMULT   ;ACC*LIMIT
26F8 227075      967 STR:     SHLD    TTLT    ;TEMPORARY STORAGE
26FB 2A4675      968          LHLD    STTL    ;GET VELOCITY ERROR
26FE EB          969          XCHG            ;DE=STTL
26FF 3E64        970          MVI     A,100   ;SCALE FACTOR
2701 CD2E27      971          CALL    DMULT   ;STTL*100
2704 EB          972          XCHG            ;DE=STTL*100
2705 2A7075      973          LHLD    TTLT    ;GET ACC*LIMIT
```

```
LOC  OBJ        LINE        SOURCE STATEMENT

2708 EB          974         XCHG              ;SWITCH
2709 CD2727      975         CALL    DNEG      ;(LIMIT*ACC)-STTL
270C F21227      976         JP      NDN       ; RESULT LT. 0?
270F 210000      977         LXI     H,0       ; YES. SET TIME-TO-LIMIT TO 0.
2712 224875      978 NDN:    SHLD    TTLV      ;STORE TIME TO LIMIT
2715 210075      979         LXI     H,TTRAN   ; POINT TO TIME-TO-LIMIT TABLE
2718 AF          980         XRA     A         ;     TO STORE VALUES FOR THE
2719 3A4375      981         LDA     CNT       ;     TRAINLINE PRESENTLY AT.
271C CD5027      982         CALL    VECT      ; VECTOR = TTRAN(2*CNT).
271F 2A4875      983         LHLD    TTLV      ;RESTORE TTLV
2722 EB          984         XCHG              ;HL=POINTER,DE=TTLV
2723 73          985         MOV     M,E       ;STORE MSB
2724 23          986         INX     H         ;INCREMENT POINTER
2725 72          987         MOV     M,D       ;STORE LSB
2726 C9          988         RET
                 989 ;
                 990 $EJECT
                 991 ;*****  SUBROUTINE TO DO DOUBLE BYTE SUBTRACTION
                 992 ;       VALUES PASSED ARE FIRST AND SECOND TERMS IN
                 993 ;       DE AND HL RESPECTFULLY
                 994 ;       RESULT RETURNED IN HL REGISTERS
                 995 ;       PERFORMS DE - HL = HL.
                 996 ;
                 997 ;
2727 7B          998 DNEG:   MOV     A,E       ; SUBTRACT LSB
2728 95          999         SUB     L         ;E-L=L
2729 6F         1000         MOV     L,A       ;STORE
272A 7A         1001         MOV     A,D       ;SUBTRACT MSB WITH BORROW
272B 9C         1002         SBB     H         ;D-H=H
272C 67         1003         MOV     H,A       ;STORE
272D C9         1004         RET               ;END SUBROUTINE.
                1005         ;
                1006 $EJECT
                1007 ;*****  SUBROUTINE TO DO WORD MULTIPLICATION
                1008 ;       PERFORMS (A)÷(DE)=(HL)
                1009 ;       ASSUMES NO OVERFLOW BUT SETS AN ERROR
                1010 ;       FLAG IF OCCURS.# OF LEADING ZEROS OF MULTIPLIER
                1011 ;       MUST BE .GE. # OF LEADING ZEROS IN MULTIPLICAND
                1012 ;       FOR NO OVERFLOW.
                1013 ;
272E 210000     1014 DMULT: LXI     H,0       ;CLEAR RESULT
2731 0E08       1015        MVI     C,8       ;INITIALIZE COUNTER
2733 1F         1016 ML1:   RAR               ;ROTATE MULTIPLIER
2734 D23B27     1017        JNC     ML3       ;IF NO CARRY JUMP
2737 19         1018        DAD     D         ;ADD TO RESULT
2738 DA4527     1019        JC      OVRF      ;JUMP IF OVERFLOW
273B EB         1020 ML3:   XCHG              ; SET UP ADDITION NUMBER.
273C 29         1021        DAD     H         ; ROUTINE USES FOR A BIT 1 IN A
273D EB         1022        XCHG              ;     ALGORITHM NEW=OLD+ADDITION
                1023                          ;     NUMBER.
273E 0D         1024        DCR     C         ;DECREMENT COUNTER
273F C23327     1025        JNZ     ML1       ;JUMP FOR NEXT BIT CHECK.
2742 C34F27     1026        JMP     DON1      ; DONE. EXIT SUBROUTINE.
2745 47         1027 OVRF:  MOV     B,A       ;STORE MULTIPLIER
2746 3E01       1028        MVI     A,1       ;SET ERROR FLAG
2748 325D75     1029        STA     OVFL      ;STORE
274B 78         1030        MOV     A,B       ;RESTORE MULTIPLIER
274C C33B27     1031        JMP     ML3       ;CONTINUE
274F C9         1032 DON1:  RET               ;END SUBROUTINE.
                1033 ;
                1034 $EJECT
                1035 ;*****  SUBROUTINE TO READ A 16 BIT VALUE FROM A
                1036 ;       VECTOR. VALUES PASSED ARE THE VECTOR NAME
                1037 ;       AND INDEX. VALUES RETURNED ARE NAM(2*IND) IN
                1038 ;       HL AND POINTER TO THE INDEXED VALUE IN DE
                1039 ;
2750 07         1040 VECT:  RLC               ;INDEX * 2
2751 5F         1041        MOV     E,A       ;E= OFFSET
2752 1600       1042        MVI     D,0       ;CLEAR D
2754 19         1043        DAD     D         ;HL = BASE + OFFSET
2755 5E         1044        MOV     E,M       ;READ LSB INDIRECT
```

```
LOC  OBJ        LINE        SOURCE STATEMENT

2756 23         1045         INX     H        ;INCREMENT POINTER
2757 56         1046         MOV     D,M      ;READ MSB INDIRECT
2758 2B         1047         DCX     H        ;DECREMENT POINTER
2759 EB         1048         XCHG             ;HL=VALUE,DE=POINTER
275A C9         1049         RET              ;END SUBROUTINE CALL.
                1050 ;
                1051 $EJECT
                1052 ;*****  SUBROUTINE TO UPDATE DELAY MATRIX FROM ROM TO
                1053 ;       RAM VALUE PASSED IS THE ROM TABLE ADDRESS
                1054 ;       RESULT IS AN UPDATED DELAY MATRIX IN RAM
                1055 ;       BASED ON SPEED.
                1056 ;
275B 0600       1057 MATRX:  MVI     B,0      ;CLEAR COUNTER
275D 110076     1058         LXI     D,DT     ;DE=ADDRESS OF DELAY MATRIX
2760 7E         1059 LOOP:   MOV     A,M      ;MOVE ROM VALUE TO A
2761 EB         1060         XCHG             ;CHANGE POINTERS
2762 77         1061         MOV     M,A      ;MOVE A TO RAM
2763 EB         1062         XCHG             ;RESET POINTERS
2764 23         1063         INX     H        ;INCREMENT ROM POINTER
2765 13         1064         INX     D        ;INCREMENT RAM POINTER
2766 05         1065         DCR     B        ;DECREMENT COUNTER
2767 C26027     1066         JNZ     LOOP     ;JUMP IF COUNT NE 256
276A C9         1067         RET              ;END SUBROUTINE CALL.
                1068 ;
                1069 ;
                1070 $EJECT
                1071 ;       THIS SUBROUTINE WILL GET THE GRADE CORRECTION
                1072 ;            FACTORS FOR SPEED MAINTAINING AND STORE
                1073 ;            THESE FACTORS IN THE RAM FOR USE IN THE
                1074 ;            PROGRAM TO KEEP WITHIN THE BAND.
                1075 ;
276B 110300     1076 MATR1:  LXI     D,TABEN  ; LOAD NUMBER OF ENTRIES PER
                1077                          ;     GRADE.
276E AF         1078         XRA     A        ; CLEAR CARRY FLAG.
276F 326175     1079         STA     DD+1     ; CLEAR UPPER BYTES OF THE
2772 326375     1080         STA     EE+1     ;     THREE GRADE FACTORS FOR
2775 326575     1081         STA     FF+1     ;     SPEED MAINTAINING.
2778 3A9575     1082         LDA     DGRD     ; GET GRADE INFORMATION.
277B F620       1083         ORI     20H      ; SET DEFAULT BIT.
277D 19         1084 NXTCH:  DAD     D        ; INCREMENT DATA POINTER.
277E 1F         1085         RAR              ; CHECK FOR GRADE BIT SET.
277F D27D27     1086         JNC     NXTCH    ; NO BIT SET. CHECK NEXT BIT.
2782 7E         1087         MOV     A,M      ; GET GRADE FACTOR DD —
2783 326075     1088         STA     DD       ;     ACCELERATING.
2786 A7         1089         ANA     A        ; CHECK FOR NEGATIVE GRADE
                1090                          ;     FACTOR.
2787 F28F27     1091         JP      EE1      ; NO.
278A 3EFF       1092         MVI     A,0FFH   ; MAKE GRADE FACTOR A NEGATIVE.
278C 326175     1093         STA     DD+1     ;     NUMBER.
278F 23         1094 EE1:    INX     H        ; POINT TO NEXT LOCATION.
2790 7E         1095         MOV     A,M      ; GET GRADE FACTOR EE —
2791 326275     1096         STA     EE       ;     DECELERATING.
2794 A7         1097         ANA     A        ; CHECK FOR NEGATIVE GRADE
                1098                          ;     FACTOR.
2795 F29D27     1099         JP      FF1      ; NO.
2798 3EFF       1100         MVI     A,0FFH   ; MAKE GRADE FACTOR A NEGATIVE
279A 326375     1101         STA     EE+1     ;     NUMBER.
279D 23         1102 FF1:    INX     H        ; POINT TO NEXT LOCATION.
279E 7E         1103         MOV     A,M      ; GET GRADE FACTOR FF — DECEL-
279F 326475     1104         STA     FF       ;     ERATING IN PROGRAM STOP.
27A2 A7         1105         ANA     A        ; CHECK FOR NEGATIVE F.F.
27A3 F0         1106         RP               ; NO.
27A4 3EFF       1107         MVI     A,0FFH   ; MAKE GRADE FACTOR A NEGATIVE
27A6 326575     1108         STA     FF+1     ;     NUMBER.
27A9 C9         1109         RET              ; END OF SUBROUTINE.
                1110 $EJECT
                1111 ;       THIS SUBROUTINE RECEIVES THE ACCELERATION
                1112 ;            DUE TO GRADE FROM THE TACH ROUTINE AND
                1113 ;            CALCULATES WHAT LEVEL OF GRADE VALUES
                1114 ;            IT FALLS INTO.
                1115 ;
27AA 3A9375     1116 GRDET:  LDA     ACCGR    ; GET ACCELERATION DUE TO
                1117                          ;     GRADE FROM TACH ROUTINE.
```

```
LOC  OBJ        LINE        SOURCE STATEMENT

27AD FE0A       1118          CPI     0AH      ; GRADE GREATER THAN 2.5%?
27AF FAB727     1119          JM      INTP     ; NO.
27B2 3E01       1120          MVI     A,1      ; YES, INDICATE THAT GRADE IS
                1121                           ;     MAXIMUM.
27B4 C3D727     1122          JMP     STORE    ; JUMP TO END.
27B7 FE04       1123 INTP:    CPI     4        ; GRADE GREATER THAN .75%?
27B9 FAC127     1124          JM      LEVL     ; NO.
27BC 3E02       1125          MVI     A,2      ; YES, GRADE IS IN INTERMED-
                1126                           ;     IATE RANGE FOR UPHILL.
27BE C3D727     1127          JMP     STORE    ; JUMP TO END.
27C1 FEFC       1128 LEVL:    CPI     0FCH     ; GRADE GREATER THAN -0.75%?
27C3 FACB27     1129          JM      INTD     ; NO.
27C6 3E04       1130          MVI     A,4      ; YES, ON LEVEL GRADE.
27C8 C3D727     1131          JMP     STORE    ; JUMP TO END.
27CB FEF6       1132 INTD:    CPI     0F6H     ; GRADE GREATER THAN -2.5%?
27CD FAD527     1133          JM      MAXD     ; NO.
27D0 3E08       1134          MVI     A,8      ; YES, GRADE IS IN INTERMED-
                1135                           ;     IATE RANGE FOR DOWNHILL.
27D2 C3D727     1136          JMP     STORE    ; JUMP TO END.
27D5 3E10       1137 MAXD:    MVI     A,10H    ; OTHERWISE, GRADE IS IN MAX-
                1138                           ;     IMUM DOWNHILL RANGE.
27D7 329575     1139 STORE:   STA     DGRD     ; STORE GRADE RANGE FOR GRADE
27DA C9         1140          RET              ;     FACTOR DETERMINATON.
                1141 $EJECT
                1142 ;        THIS TABLE CONTAINS THE GRADE FACTORS USED
                1143 ;             IN SPEED MAINTINING. VALUES ARE AR-
                1144 ;             RANGED FROM STEEPEST UPHILL GRADE TO
                1145 ;             STEEPEST DOWNHILL GRADE AND FROM LOWER
                1146 ;             SPEED TO HIGHER SPEEDS.
                1147 ;
2B00            1148          ORG     2B00H
                1149 ;
2B00 FA         1150 DEL00:   DB      -6       ; NEGATIVE DELAY OF .12 SEC.
                1151                           ;     -- MAX UPGRADE.
2B01 2D         1152          DB      45       ; DELAY OF 0.9 SEC.
2B02 0A         1153          DB      10       ; DELAY OF 0.2 SEC.
2B03 0A         1154          DB      10       ; DELAY OF 0.2 SEC -- INTER.
                1155                           ;     UPGRADE.
2B04 1E         1156          DB      30       ; DELAY OF 0.6 SEC.
2B05 0A         1157          DB      10       ; DELAY OF 0.2 SEC.
2B06 28         1158          DB      40       ; DELAY OF 0.8 SEC - LEVEL.
2B07 19         1159          DB      25       ; DELAY OF 0.5 SEC.
2B08 1E         1160          DB      30       ; DELAY OF 0.6 SEC.
2B09 1E         1161          DB      30       ; DELAY OF 0.6 SEC. - INTER
                1162                           ;     DOWNGRADE.
2B0A 19         1163          DB      25       ; DELAY OF 0.5 SEC.
2B0B 1E         1164          DB      30       ; DELAY OF 0.6 SEC.
2B0C 3C         1165          DB      60       ; DELAY OF 1.2 SEC. - MAX.
                1166                           ;     DOWNGRADE.
2B0D 0A         1167          DB      10       ; DELAY OF 0.2 SEC.
2B0E 37         1168          DB      55       ; DELAY OF 1.1 SEC.
2B0F 0A         1169          DB      10       ; DELAY OF 0.2 SEC. -- DE-
                1170                           ;     FAULT.
2B10 1E         1171          DB      30       ; DELAY OF 0.6 SEC.
2B11 0A         1172          DB      10       ; DELAY OF 0.2 SEC.
2B12 F1         1173 DEL23:   DB      -15      ; NEGATIVE DELAY OF .30 SEC.
                1174                           ;     -- MAX UPGRADE.
2B13 55         1175          DB      85       ; DELAY OF 1.70 SEC.
2B14 0A         1176          DB      10       ; DELAY OF 0.2 SEC.
2B15 F8         1177          DB      -8       ; NEGATIVE DELAY OF -0.16 SEC.
                1178                           ;     -- INTER. UPGR.
2B16 3C         1179          DB      60       ; DELAY OF 1.2 SEC.
2B17 0A         1180          DB      10       ; DELAY OF 0.2 SEC.
2B18 28         1181          DB      40       ; DELAY OF 0.8 SEC. - LEVEL.
2B19 2C         1182          DB      44       ; DELAY OF 0.88 SEC.
2B1A 1E         1183          DB      30       ; DELAY OF 0.6 SEC.
2B1B 28         1184          DB      40       ; DELAY OF 0.8 SEC. - IN-
                1185                           ;     TER. DOWNGRADE.
2B1C 1E         1186          DB      30       ; DELAY OF 0.6 SEC.
2B1D 28         1187          DB      40       ; DELAY OF 0.4 SEC.
2B1E 45         1188          DB      69       ; DELAY OF 1.38 SEC. - MAX.
                1189                           ;     DOWNGRADE.
2B1F 14         1190          DB      20       ; DELAY OF 0.4 SEC.
```

```
LOC  OBJ        LINE        SOURCE STATEMENT

2B20 4A         1191        DB      74      ; DELAY OF 1.48 SEC.
2B21 0A         1192        DB      10      ; DELAY OF 0.2 SEC. -- DE-
                1193                        ;     FAULT.
2B22 1E         1194        DB      30      ; DELAY OF 0.6 SEC.
2B23 0A         1195        DB      10      ; DELAY OF 0.2 SEC.
2B24 00         1196 DEL50: DB      0       ; NO DELAY -- MAX UPGRADE.
2B25 4F         1197        DB      79      ; DELAY OF 1.58 SEC.
2B26 0A         1198        DB      10      ; DELAY OF 0.2 SEC.
2B27 14         1199        DB      20      ; DELAY OF 0.4 SEC. -- IN-
                1200                        ;     TER. UPGRADE.
2B28 41         1201        DB      65      ; DELAY OF 1.3 SEC.
2B29 0A         1202        DB      10      ; DELAY OF 0.2 SEC.
2B2A 23         1203        DB      35      ; DELAY OF 0.7 SEC. - LEVEL.
2B2B 37         1204        DB      55      ; DELAY OF 1.1 SEC.
2B2C 23         1205        DB      35      ; DELAY OF 0.7 SEC.
2B2D 1E         1206        DB      30      ; DELAY OF 0.6 SEC. - IN-
                1207                        ;     TER. DOWNGRADE.
2B2E 19         1208        DB      25      ; DELAY OF 0.5 SEC.
2B2F 1E         1209        DB      30      ; DELAY OF 0.6 SEC.
2B30 41         1210        DB      65      ; DELAY OF 1.3 SEC. - MAX.
                1211                        ;     DOWNGRADE.
2B31 14         1212        DB      20      ; DELAY OF 0.4 SEC.
2B32 41         1213        DB      65      ; DELAY OF 1.3 SEC.
2B33 0A         1214        DB      10      ; DELAY OF 0.2 SEC. -- DE-
                1215                        ;     FAULT.
2B34 1E         1216        DB      30      ; DELAY OF 0.6 SEC.
2B35 0A         1217        DB      10      ; DELAY OF 0.2 SEC.
                1218 $EJECT
                1219
                1220 ;          RAM MEMORY MAP FOR PAGE 7500H
                1221 ;
7500            1222 TTRAN      EQU     7500H   ; CALCULATED TIME-TO-LIMIT
                1223                            ;     TRANSITION VECTOR.
7520            1224 SPD        EQU     7520H   ; SPEED FROM TACH ROUTINE.
7522            1225 PRSTP      EQU     7522H   ; PROGRAM STOP INDICATION FROM
                1226                            ;     MARKER ROUTINE.
7523            1227 PGRD       EQU     7523H   ; GRADE INDICAITON FROM MARKER
                1228                            ;     ROUTINE.
7524            1229 HPWR       EQU     7524H   ; HALF POWER MODE FLAG.
7578            1230 ACC        EQU     7578H   ; TRUE ACCELERATION FROM
                1231                            ;     ACCELERATION ROUTINE.
7526            1232 TLMT       EQU     7526H   ; COMMANDED SPEED LIMIT.
7528            1233 TWAIT      EQU     7528H   ; VALUE OF DELAY TIMER FOR TIME-
                1234                            ;     TO-LIMIT CALCULATIONS.
752A            1235 LDTG       EQU     752AH   ; LSB OF DISTANCE-TO-GO COUNTER
                1236                            ;     FOR PROGRAM STOP.
752C            1237 HDTG       EQU     752CH   ; MSB OF DISTANCE-TO-GO COUNT-
                1238                            ;     ER FOR PROGRAM STOP.
752F            1239 PDTG       EQU     752FH   ; PREVIOUS MSB OF DISTANCE-TO-GO
                1240                            ;     COUNTER.
7530            1241 TSPD       EQU     7530H   ; TACH VALUE USED FOR CALCULA-
                1242                            ;     TIONS IN THIS ROUTINE.
7532            1243 TPSTP      EQU     7532H   ; PROGRAM STOP INDICATION FOR
                1244                            ;     USE IN THIS ROUTINE.
7533            1245 TGRD       EQU     7533H   ; GRADE INDICATION USED FOR
                1246                            ;     CALCULATIONS THIS ROUTINE.
7534            1247 TPWR       EQU     7534H   ; HALF POWER FLAG USED IN THIS
                1248                            ;     ROUTINE.
757A            1249 TACC       EQU     757AH   ; ACCELERATION VALUE USED IN
                1250                            ;     THIS ROUTINE.
7536            1251 TREG       EQU     7536H   ; COMMANDED SPEED LIMIT USED IN
                1252                            ;     THIS ROUTINE.
7538            1253 TTIME      EQU     7538H   ; VALUE OF DELAY TIMER USED IN
                1254                            ;     THE ROUTINE.
753A            1255 DTG        EQU     753AH   ; MSB OF DISTANCE-TO-GO COUNTER
                1256                            ;     USED IN THE ROUTINE.
753E            1257 SPLMT      EQU     753EH   ; SPEED LIMIT TO CALCULATE THE
                1258                            ;     TTL WHEN WITHIN THE SPEED
                1259                            ;     BAND.
7540            1260 TH         EQU     7540H   ; NEW DESIRED TRAINLINE.
7541            1261 TRNLN      EQU     7541H   ; PRESENT TRAINLINE.
7542            1262 TH2        EQU     7542H   ; PREVIOUS TRAINLINE.
```

```
LOC  OBJ        LINE        SOURCE STATEMENT

7543            1263 CNT     EQU     7543H   ; SYSTEM STATE COUNTER FOR
                1264                         ;     PROGRAM LOOPS.
7544            1265 PVEC    EQU     7544H   ; TRANSITION PERMISSION VECTOR
                1266                         ;     TAKEN FROM PACC, DACC,
                1267                         ;     PSAC, AND PSDC VECTORS.
7546            1268 STTL    EQU     7546H   ; VELOCITY ERROR USED IN TTL
                1269                         ;     CALCULATIONS.
7548            1270 TTLV    EQU     7548H   ; TTL FOR A GIVEN TRANSITION
                1271                         ;     WHEN WITHIN THE SPEED
                1272                         ;     BAND.
754A            1273 CTTL    EQU     754AH   ; USED TO DETERMINE MOST
                1274                         ;     RESTRICTIVE TRANSITION OF
                1275                         ;     TRRAN VECTOR.
754C            1276 TRANS   EQU     754CH   ; TIME-TO-LIMIT FOR A SPECIFIC
                1277                         ;     TRANSITION STORED IN TTRAN
                1278                         ;     VECTOR.
754E            1279 NDEL    EQU     754EH   ; TOTAL DELAY REQUIRED FOR
                1280                         ;     TRANSITION.
7550            1281 PSLMT   EQU     7550H   ; PROGRAM STOP SPEED LIMIT.
7552            1282 PTR     EQU     7552H   ; POINTER TO PROGRAM STOP SPEED
                1283                         ;     LIMIT TABLE.
7554            1284 PPTR    EQU     7554H   ; PREVIOUS POINTER TO PROGRAM
                1285                         ;     STOP SPEED LIMIT TABLE.
7556            1286 PSDIF   EQU     7556H   ; DIFFERENCE BETWEEN PROGRAM
                1287                         ;     STOP SPEED LIMIT AND TACH
                1288                         ;     WHEN SPEED LIMIT IS BELOW
                1289                         ;     PROGRAM STOP SPEED LIMIT.
7558            1290 TTLC    EQU     7558H   ; TIME-TO-LIMIT CALCULATED WHEN
                1291                         ;     SPEED LIMIT IS BELOW
                1292                         ;     PROGRAM STOP SPEED LIMIT.
755A            1293 CTF     EQU     755AH   ; COUNTER FOR TIME IN COAST
                1294                         ;     DURING PROGRAM STOP
                1295                         ;     FLARE-OUT.
755B            1296 FPS     EQU     755BH   ; FLAG TO INDICATE WHETHER USING
                1297                         ;     COMMANDED SPEED LIMIT OR
                1298                         ;     PROGRAM STOP SPEED LIMIT
                1299                         ;     OR WHEN USING PROGRAM STOP
                1300                         ;     SPEED LIMIT, WHETHER
                1301                         ;     ACCELERATING OR DECELERAT-
                1302                         ;     ING.
755C            1303 FCHK    EQU     755CH   ; FLAG USED TO HOLD TRAINLINE TO
                1304                         ;     9 WHEN TTL INDICATES WHEN
                1305                         ;     SPEED LIMIT IS BELOW
                1306                         ;     PROGRAM STOP SPEED LIMIT.
755D            1307 OVFL    EQU     755DH   ; OVERFLOW FLAG USED IN MULTI-
                1308                         ;     PLIER MACRO.
755E            1309 EGRAD   EQU     755EH   ; DIAGNOSTIC FLAG USED TO
                1310                         ;     INDICATE ILLEGAL GRADE
                1311                         ;     INPUTTED.
7560            1312 DD      EQU     7560H   ; GRADE COMPENSATION DELAY WHEN
                1313                         ;     ACCELERATING IN SPEED
                1314                         ;     MAINTAINING.
7562            1315 EE      EQU     7562H   ; GRADE COMPENSATION DELAY WHEN
                1316                         ;     DECELERATING IN SPEED
                1317                         ;     MAINTAINING.
7564            1318 FF      EQU     7564H   ; GRADE COMPENSATION DELAY USED
                1319                         ;     DURING PROGRAM STOP.
7566            1320 DEL     EQU     7566H   ; TIME DELAY REQUIRED FOR
                1321                         ;     TRANSITION TAKEN FROM
                1322                         ;     DELAY MATRIX DT.
7568            1323 UPDN    EQU     7568H   ; FLAG INDICATING MOVING UP OR
                1324                         ;     MOVING DOWN IN TRAINLINE
                1325                         ;     WITH RESPECT TO LAST
                1326                         ;     STATE.
7570            1327 TTLT    EQU     7570H   ; TEMPORARY RESULT IN TTL
                1328                         ;     CALCULATION.
7572            1329 TTLP    EQU     7572H   ; TEMPORARY RESULT USED IN
                1330                         ;     PROGRAM STOP TTL
                1331                         ;     CALCULATION.
7574            1332 DIR1    EQU     7574H   ; FLAG USED TO INDICATE TRANSI-
                1333                         ;     TION DIRECTION FROM TH2 TO
                1334                         ;     TRNLN.
757C            1335 REFOA   EQU     757CH   ; BUFFERS USED TO REFRESH TRAIN-
```

```
LOC  OBJ        LINE        SOURCE STATEMENT

757D            1336 REF6A   EQU     757DH   ;     LINE BUFFERS.
75EB            1337 MARKUP  EQU     75EBH   ; DTG DATA NEEDS TO BE UPDATED.
7593            1338 ACCGR   EQU     7593H   ; 2-BYTE WORD CONTAINING VALUE
                1339                         ;     OF ACCELERATION DUE TO
                1340                         ;     GRADE.
7595            1341 DGRD    EQU     7595H   ; GRADE RANGE VALUE.
7596            1342 FLWT    EQU     7596H   ; FLAG
7597            1343 UPB     EQU     7597H   ; UPPER SPEED BAND VALUE.
7599            1344 LWB     EQU     7599H   ; LOWER SPEED BAND VALUE.
759B            1345 UPM     EQU     759BH   ; UPPER SPEED BAND VALUE USED IN
                1346                         ;     SPEED ERROR CALCULATION.
759D            1347 LWM     EQU     759DH   ; LOWER SPEED BAND VALUE USED IN
                1348                         ;     SPEED ERROR CALCULATION.
759F            1349 FLOUT   EQU     759FH   ; FLARE OUT ROUTINE FLAG.
                1350 $EJECT
2B80            1351         ORG     2B80H
                1352                         ; CONSTANT DEFINITIONS.
2B80 0000       1353 SPUP:   DW      0       ; UPPER SPEED BAND VALUE USED
                1354                         ;     IN SPEED MAINTAINING.
2B82 2800       1355 SPLWB:  DW      40      ; LOWER SPEED BAND VALUES USED
2B84 2400       1356 SPLW:   DW      36      ;     IN SPEED MAINTAINING.
2B86 0000       1357 PSUP:   DW      0       ; UPPER SPEED BAND VALUE USED IN
                1358                         ;     PROGRAM STOP.
2B88 2400       1359 PSLW:   DW      36      ; LOWER SPEED BAND VALUE USED IN
                1360                         ;     PROGRAM STOP.
2B8A 4000       1361 DRP:    DW      64      ; VALUE BELOW SPLMT WHICH RETURN
                1362                         ;     TO PROPULSION CAN BE DONE
                1363                         ;     WHEN USING PROGRAM STOP
                1364                         ;     SPEED LIMIT.
2B8C 0E         1365 NSTAT:  DB      14      ; TOTAL NUMBER OF SYSTEM STATES.
2B8D 05         1366 HSTAT:  DB      5       ; HALF POWER DEFAULT SYSTEM
                1367                         ;     STATE.
2B8E FF7F       1368 DMAX:   DW      7FFFH   ; MAXIMUM POSSIBLE STATE
                1369                         ;     TRANSITION DELAY.
2B90 09         1370 BSTAT:  DB      9       ; STATE USED IN TTL CALCULATION
                1371                         ;     FOR SPEED LIMIT BELOW
                1372                         ;     PROGRAM STOP SPEED LIMIT.
2B91 14         1373 FTIM:   DB      20      ; NUMBER OF PROGRAM LOOPS IN
                1374                         ;     COAST DURING FLARE-OUT
                1375                         ;     ROUTINE.
                1376 ;
740B            1377 OUT6A   EQU     740BH   ; MEMORY BUFFER FOR PORT 6AH
                1378                         ;     (TRAINLINE).
7402            1379 OUT0A   EQU     7402H   ; MEMORY BUFFER FOR PORT 0AH
                1380                         ;     (TRAINLINE).
                1381 ;
2B92 FF06       1382 MDEL:   DW      06FFH   ; MAXIMUM DELAY USED IN TWAIT
                1383                         ;     CALCULATIONS.
2B94 1800       1384 LSP:    DW      24      ; SPEED BELOW WHICH FLARE-OUT
                1385                         ;     ROUTINE IS CALLED.
2B96 4400       1386 LPS:    DW      68      ; PROGRAM STOP SPEED LIMIT FOR
                1387                         ;     WHICH FLARE-OUT ROUTINE IS
                1388                         ;     CALLED.
0088            1389 SP23    EQU     184     ; 23 MPH AT 8 BITS PER MPH.
0190            1390 SP50    EQU     400     ; 50 MPH AT 8 BITS PER MPH.
FFE1            1391 ACM2    EQU     -31     ; -2 MPHPS AT 16 BIT PER MPHPS.
001F            1392 ACP2    EQU     31      ; 2 MPHPS AT 16 BITS PER MPHPS.
0003            1393 TABEN   EQU     3       ; NUMBER OF TABLE ENTRIES PER
                1394                         ;     GRADE.
                1395 ;
                1396 $EJECT
                1397 ;DELAY MATRIX IN RAM
                1398 ;
7600            1399         ORG     7600H
7600 0000       1400 DT:     DW      0       ;DELAY MATRIX
                1401 ;
                1402 ;EPROM VECTOR AND MATRIX ADDRESSES
                1403 ;
2800            1404 TAB0    EQU     2800H   ;ROM VECTORS AND MATRICES
2A80            1405 TAB1    EQU     2A80H   ;PROGRAM STOP TABLES
2AE0            1406 TAB2    EQU     2AE0H   ;FORMAT: DTG MSB
2AF0            1407 TAB3    EQU     2AF0H   ;        DTG LSB
```

```
LOC  OBJ        LINE        SOURCE STATEMENT

                1408                          ;        PSLMT MSB
                1409                          ;        PSLMT LSB
2C00            1410 PACC    EQU     2C00H    ;PERMISSION VECTORS
2C20            1411 DACC    EQU     2C20H    ;STATES 15......0
2C40            1412 PSAC    EQU     2C40H    ;        MSB    LSB
2C60            1413 PSDC    EQU     2C60H    ; DOUBLE BYTE DATA.
2C80            1414 TLO     EQU     2C80H    ;TRAINLINE OUTPUT VECTOR
                1415                          ;CODED OUT6A MSB OUTDA LSB
                1416 ;DELAY MATRICES BASED ON SPEED
2D00            1417 TAB00   EQU     2D00H    ;DELAYS FOR 0 TO 23 MPH
2E00            1418 TAB23   EQU     2E00H    ;DELAYS FOR 23 TO 50 MPH
2F00            1419 TAB50   EQU     2F00H    ;DELAYS FOR ABOVE 50 MPH
                1420 ;
                1421 $EJECT
                1422                 END
```

PUBLIC SYMBOLS

EXTERNAL SYMBOLS

USER SYMBOLS

| | | | | | | | |
|---|---|---|---|---|---|---|---|
| ABSS | A 2637 | ACC | A 7578 | ACCGR | A 7593 | ACCP | A 21D6 |
| ACCPS | A 26C6 | ACCSP | A 26ED | ACM2 | A FFE1 | ACP2 | A 001F |
| ACT | A 2233 | ANS | A 261D | ANZ1 | A 2633 | AUTD | A 202C |
| B1 | A 21AE | BACC | A 21E0 | BAND | A 2181 | BDEC | A 2138 |
| BK1 | A 2511 | BSTAT | A 2B90 | CADD | A 2644 | CALC | A 21FD |
| CHG | A 2656 | CHK | A 229E | CK1 | A 22D6 | CK2 | A 2298 |
| CKPWR | A 227F | CNT | A 7543 | CPWR | A 20BB | CSUB | A 2610 |
| CTF | A 755A | CTT | A 2354 | CTTL | A 754A | DACC | A 2C20 |
| DD | A 7560 | DECPS | A 26B4 | DEL | A 7566 | DEL00 | A 2B00 |
| DEL1 | A 209D | DEL2 | A 20AC | DEL23 | A 2B12 | DEL50 | A 2B24 |
| DGRD | A 7595 | DIR1 | A 7574 | DIRM | + 0004 | DMAX | A 2B8E |
| DMJLT | A 272E | DNEG | A 2727 | DON | A 22D7 | DON1 | A 274F |
| DRP | A 2B8A | DT | A 7600 | DTG | A 753A | EE | A 7562 |
| EE1 | A 278F | EGRAD | A 755E | F1ST | A 24D3 | FCHK | A 755C |
| FDC | A 2553 | FDD | A 2539 | FDD1 | A 2548 | FF | A 7564 |
| FF1 | A 279D | FLARE | A 251E | FLOUT | A 759F | FLWT | A 7596 |
| FPS | A 755B | FTIM | A 2B91 | GET | A 2501 | GETD | + 0000 |
| GRDET | A 27AA | HPWR | A 7524 | HSTAT | A 2B8D | INTD | A 27CB |
| INTP | A 27B7 | LA2 | A 239E | LD1 | A 237A | LDTG | A 752A |
| LEVL | A 27C1 | LDDP | A 2760 | LP | A 2204 | LP1 | A 2243 |
| LP2 | A 2270 | LPS | A 2B96 | LSP | A 2B94 | LWB | A 7599 |
| LWM | A 759D | MARKUP | A 75EB | MATR1 | A 276B | MATRX | A 275B |
| MAXD | A 27D5 | MDEL | A 2B92 | MDTG | A 752C | ML1 | A 2733 |
| ML3 | A 2738 | MSP | A 26D6 | NC | A 2214 | NDEL | A 754E |
| NF | A 233C | NF1 | A 235B | NON | A 2712 | NORM | A 219A |
| NRED | A 246A | NSTAT | A 2B8C | NTTL | A 23FE | NXTCH | A 277D |
| OUTDA | A 7402 | OUT6A | A 740B | OVER | A 215D | OVFL | A 755D |
| OVRF | A 2745 | PAC | A 238D | PACC | A 2C00 | PC1 | A 2575 |
| PCHG | A 2557 | PDTG | A 752F | PGRD | A 7523 | POVER | A 2381 |
| PPTR | A 7554 | PRSTP | A 7522 | PSAC | A 2C40 | PSDC | A 2C60 |
| PSDIF | A 7556 | PSLMT | A 7550 | PSLW | A 2888 | PSMTN | A 2311 |
| PSS | A 20DA | PSS1 | A 2105 | PSS2 | A 20EF | PSTOP | A 22EA |
| PSUP | A 2B86 | PTR | A 7552 | PVEC | A 7544 | REF0A | A 757C |
| REF6A | A 757D | S2ND | A 24F7 | SBASE | A 2010 | SE1 | A 24AB |
| SE2 | A 24B4 | SE3 | A 248A | SE4 | A 24C0 | SE5 | A 24C3 |
| SE6 | A 24E4 | SE7 | A 24E6 | SE8 | A 24ED | SEEK | A 2472 |
| SKIP | A 2223 | SP23 | A 00B8 | SP50 | A 0190 | SPD | A 7520 |
| SPLMT | A 753E | SPLW | A 2B84 | SPLWB | A 2B82 | SPMAT | A 212B |
| SPMTN | A 230C | SPREG | A 2D10 | SPUP | A 2B80 | STOR | A 24C6 |
| STORE | A 27D7 | STR | A 26F8 | STTL | A 7546 | SWC | A 20D2 |
| TA50 | A 2800 | TAB00 | A 2D00 | TAB1 | A 2A80 | TAB2 | A 2AE0 |
| TAB23 | A 2E00 | TAB3 | A 2AF0 | TAB50 | A 2F00 | TABEN | A 0003 |

```
ISIS-II 8080/8085 MACRO ASSEMBLER, V3.0          SPREG    PAGE   40
WMATA SPEED REGULATION ROUTINE

TACC    A 757A    TGRD    A 7533    TH      A 7540    TH2     A 7542
TLMT    A 7526    TLO     A 2C80    TLS     A 2174    TLS1    A 2171
TPSTP   A 7532    TPWR    A 7534    TRANS   A 754C    TREG    A 7536
TRNLN   A 7541    TSPD    A 7530    TTIME   A 7538    TTL     A 268F
TTLC    A 7558    TTLP    A 7572    TTLT    A 7570    TTLV    A 7548
TTRAN   A 7500    TWAIT   A 7528    UNDER   A 2165    UNFL1   A 213B
UNFL3   A 21CB    UNFL4   A 21F3    UPB     A 7597    UPDN    A 7568
UPM     A 7598    VECT    A 2750    WAIT    A 23CC    WTT     A 23E7

ASSEMBLY COMPLETE,   NO ERRORS

ISIS-II ASSEMBLER SYMBOL CROSS REFERENCE, V2.1                    PAGE   1

??0001   791#   796    801
??0002   783    794#
??0003   786    790    802#
??0004   793    804#
??0005   818#   823    828
??0006   810    821#
??0007   813    817    829#
??0008   820    831#
ABSS     841    852#
ACC      133    274    483    486    549    552    597    938    947    951
         957    965    1230#
ACCGR   1116   1338#
ACCP     268    298#
ACCPS    934    944#
ACCSP    953    962#
ACM2     487    553    1391#
ACP2     598    941    948    1392#
ACT      343#
ANS      842#   860    866    868
ANZ1     846    847    850#
AUTO     100    112#
B1       276    282#
BACC     281    302#
BAND     242    264#   494    510
BDEC     273    286#
BK1      680    703#
BSTAT    586    607    1370#
CADD     836    861#
CALC     297    313#
CHG      256    416    850    879#
CHK      377    384    387#
CK1      417#
CK2      380    382    385#
CKPWR    375#
CNT      314    329    335    337    344    351    366    368    370    922
         981    1263#
CPWR     157    164    172#
CSUB     837#
CTF      206    721    723    736    1293#
CTT      477    480#
CTTL     348    360    365    1273#
DACC     282    1411#
DD       962    1079   1088   1093   1312#
DECPS    935#
DEL      779    837    864    1320#
DEL00    161    1150#
DEL1     147    158#
DEL2     150    165#
DEL23    168    1173#
DEL50    154    1196#
DGRD    1082    1139   1341#
DIR1     806    834    1332#
DIRM      52#   780    807
DMAX     347    1368#
```

ISIS-II ASSEMBLER SYMBOL CROSS REFERENCE, V2.1 PAGE 2

| | | | | | | | | | | |
|---|---|---|---|---|---|---|---|---|---|---|
| DMJLT | 575 | 599 | 942 | 949 | 960 | 966 | 971 | 1014# | | |
| DNEG | 146 | 149 | 227 | 232 | 237 | 240 | 290 | 306 | 311 | 362 |
| | 438 | 453 | 457 | 460 | 465 | 473 | 476 | 562 | 565 | 571 |
| | 602 | 679 | 691 | 840 | 845 | 975 | 998# | | | |
| DON | 391 | 394 | 397 | 418# | | | | | | |
| DON1 | 1026 | 1032# | | | | | | | | |
| DRP | 472 | 1361# | | | | | | | | |
| DT | 399 | 578 | 763 | 914 | 1058 | 1400# | | | | |
| DTG | 627 | 629 | 1255# | | | | | | | |
| EE | 954 | 1080 | 1096 | 1101 | 1315# | | | | | |
| EE1 | 1091 | 1094# | | | | | | | | |
| EGRAD | 1309# | | | | | | | | | |
| FIST | 664# | 709 | | | | | | | | |
| FCHK | 207 | 441 | 530 | 537 | 606 | 1303# | | | | |
| FDC | 728 | 731 | 734 | 739# | | | | | | |
| FDD | 727 | 729# | | | | | | | | |
| FDD1 | 735# | | | | | | | | | |
| FF | 594 | 935 | 944 | 1081 | 1104 | 1108 | 1318# | | | |
| FF1 | 1099 | 1102# | | | | | | | | |
| FLARE | 467 | 524 | 717# | | | | | | | |
| FLOUT | 208 | 522 | 718 | 1349# | | | | | | |
| FLWT | 447 | 450 | 480 | 525 | 1342# | | | | | |
| FPS | 190 | 205 | 264 | 490 | 506 | 556 | 612 | 930 | 1296# | |
| FTIM | 725 | 735 | 1373# | | | | | | | |
| GET | 674 | 693# | | | | | | | | |
| GETD | 25# | 338 | 577 | 762 | 913 | | | | | |
| GRDET | 141 | 1116# | | | | | | | | |
| HPWR | 135 | 172 | 247 | 375 | 1229# | | | | | |
| HSTAT | 252 | 385 | 1366# | | | | | | | |
| INTD | 1129 | 1132# | | | | | | | | |
| INTP | 1119 | 1123# | | | | | | | | |
| LA2 | 509 | 512# | | | | | | | | |
| LD1 | 493 | 496# | | | | | | | | |
| LDTG | 630 | 647 | 661 | 1235# | | | | | | |
| LEVL | 1124 | 1128# | | | | | | | | |
| LOOP | 1059# | 1066 | | | | | | | | |
| LP | 317# | 342 | | | | | | | | |
| LP1 | 349# | 374 | | | | | | | | |
| LP2 | 356 | 358 | 363 | 368# | | | | | | |
| LPS | 464 | 1386# | | | | | | | | |
| LSP | 459 | 1384# | | | | | | | | |
| LWB | 200 | 213 | 236 | 561 | 1344# | | | | | |
| LWM | 201 | 215 | 287 | 1347# | | | | | | |
| MARKUP | 193 | 1337# | | | | | | | | |
| MATR1 | 156 | 163 | 171 | 1076# | | | | | | |
| MATRX | 152 | 159 | 166 | 1057# | | | | | | |
| MAXD | 1133 | 1137# | | | | | | | | |
| MDEL | 844 | 848 | 1382# | | | | | | | |
| MDTG | 628 | 632 | 645 | 659 | 1237# | | | | | |
| ML1 | 1016# | 1025 | | | | | | | | |
| ML3 | 1017 | 1020# | 1031 | | | | | | | |
| MSP | 932 | 951# | | | | | | | | |
| NC | 324 | 327# | | | | | | | | |
| NDEL | 255 | 415 | 842 | 849 | 880 | 1279# | | | | |
| NF | 461 | 466 | 470# | | | | | | | |
| NF1 | 483# | 528 | | | | | | | | |
| NOV | 976 | 978# | | | | | | | | |
| NORM | 266 | 274# | | | | | | | | |
| NRED | 566 | 604 | 611# | | | | | | | |
| NSTAT | 339 | 372 | 1365# | | | | | | | |
| NTTL | 551 | 554 | 559# | | | | | | | |
| NXTCH | 1084# | 1086 | | | | | | | | |
| OUTOA | 106 | 108 | 116 | 120 | 423 | 501 | 517 | 545 | 758 | 897 |
| | 900 | 1379# | | | | | | | | |
| OUT6A | 103 | 419 | 497 | 513 | 541 | 754 | 892 | 1377# | | |
| OVER | 140 | 233 | 244# | | | | | | | |
| OVFL | 1029 | 1307# | | | | | | | | |
| OVRF | 1019 | 1027# | | | | | | | | |
| PAC | 485 | 488 | 505# | | | | | | | |
| PACC | 277 | 1410# | | | | | | | | |
| PC1 | 752 | 762# | | | | | | | | |
| PCHG | 185 | 533 | 609 | 739 | 748# | | | | | |

ISIS-II ASSEMBLER SYMBOL CROSS REFERENCE, V2.1

| | | | | | | | | | | |
|---|---|---|---|---|---|---|---|---|---|---|
| PDTG | 634 | 660 | 1239# | | | | | | | |
| PGRD | 131 | 1227# | | | | | | | | |
| POVER | 458 | 522# | | | | | | | | |
| PPTR | 650 | 694 | 1284# | | | | | | | |
| PRSTP | 129 | 187 | 1225# | | | | | | | |
| PSAC | 298 | 1412# | | | | | | | | |
| PSDC | 269 | 1413# | | | | | | | | |
| PSDIF | 572 | 1286# | | | | | | | | |
| PSLMT | 437 | 442 | 462 | 568 | 701 | 729 | 732 | 1281# | | |
| PSLW | 199 | 1359# | | | | | | | | |
| PSMTN | 448 | 452# | | | | | | | | |
| PSS | 174 | 182 | 187# | | | | | | | |
| PSS1 | 189 | 195 | 204# | | | | | | | |
| PSS2 | 192 | 196# | | | | | | | | |
| PSTOP | 202 | 434# | | | | | | | | |
| PSUP | 196 | 1357# | | | | | | | | |
| PTR | 651 | 658 | 663 | 681 | 686 | 693 | 703 | 708 | 1282# | |
| PVEC | 286 | 302 | 315 | 1265# | | | | | | |
| REFOA | 113 | 119 | 422 | 500 | 516 | 544 | 757 | 901 | 1335# | |
| REF6A | 418 | 496 | 512 | 540 | 753 | 893 | 1336# | | | |
| S2ND | 687# | | | | | | | | | |
| SBASE | 87# | 88 | | | | | | | | |
| SE1 | 636 | 650# | | | | | | | | |
| SE2 | 639 | 653# | | | | | | | | |
| SE3 | 641 | 655# | | | | | | | | |
| SE4 | 643 | 657# | | | | | | | | |
| SE5 | 649 | 654 | 656 | 658# | | | | | | |
| SE6 | 670 | 676# | | | | | | | | |
| SE7 | 675 | 678# | | | | | | | | |
| SE8 | 681# | 692 | | | | | | | | |
| SEEK | 434 | 626# | | | | | | | | |
| SKIP | 326 | 335# | | | | | | | | |
| SP23 | 145 | 1389# | | | | | | | | |
| SP50 | 148 | 1390# | | | | | | | | |
| SPD | 125 | 143 | 231 | 239 | 294 | 310 | 455 | 475 | 564 | 570 |
| | 1224# | | | | | | | | | |
| SPLMT | 123 | 137 | 224 | 234 | 289 | 303 | 443 | 470 | 559 | 1257# |
| SPLW | 214 | 1356# | | | | | | | | |
| SPLWB | 212 | 1355# | | | | | | | | |
| SPMAT | 216 | 224# | 478 | 557 | 613 | | | | | |
| SPMTN | 439 | 449# | | | | | | | | |
| SPREG | 6 | 96# | | | | | | | | |
| SPUP | 209 | 1353# | | | | | | | | |
| STOR | 652 | 659# | | | | | | | | |
| STORE | 1122 | 1127 | 1131 | 1136 | 1139# | | | | | |
| STR | 943 | 950 | 961 | 967# | | | | | | |
| STTL | 296 | 312 | 968 | 1268# | | | | | | |
| SWC | 178 | 180 | 183# | | | | | | | |
| TAB0 | 648 | 653 | 1404# | | | | | | | |
| TAB00 | 158 | 1417# | | | | | | | | |
| TAB1 | 655 | 1405# | | | | | | | | |
| TAB2 | 657 | 1406# | | | | | | | | |
| TAB23 | 165 | 1418# | | | | | | | | |
| TAB3 | 1407# | | | | | | | | | |
| TAB50 | 151 | 1419# | | | | | | | | |
| TABEN | 154 | 161 | 168 | 1076 | 1393# | | | | | |
| TACC | 132 | 1249# | | | | | | | | |
| TGRD | 130 | 1245# | | | | | | | | |
| TH | 184 | 245 | 253 | 346 | 367 | 378 | 386 | 387 | 407 | 532 |
| | 608 | 720 | 738 | 748 | 771 | 808 | 815 | 824 | 885 | 1260# |
| TH2 | 784 | 794 | 799 | 884 | 1262# | | | | | |
| TLMT | 122 | 435 | 1232# | | | | | | | |
| TLO | 887 | 1414# | | | | | | | | |
| TLS | 246 | 251 | 253# | | | | | | | |
| TLS1 | 249 | 252# | | | | | | | | |
| TPSTP | 128 | 1243# | | | | | | | | |
| TPWR | 134 | 1247# | | | | | | | | |
| TRANS | 353 | 364 | 1276# | | | | | | | |
| TREG | 121 | 1251# | | | | | | | | |
| TRNLN | 176 | 271 | 279 | 284 | 300 | 345 | 389 | 400 | 491 | 507 |
| | 579 | 750 | 764 | 781 | 788 | 797 | 811 | 821 | 826 | 883 |

```
ISIS-II ASSEMBLER SYMBOL CROSS REFERENCE, V2.1

        886    889    915    1261#
TSPD    124    1241#
TTIME   126    881    1253#
TTL     325    913#
TTLC    603    1290#
TTLP    576    601    1329#
TTLT    967    973    1327#
TTLV    978    983    1270#
TTRAN   327    349    979    1222#
TWAIT   127    392    395    839    862    1233#
UNDER   241    247#
UNFL1   228    230#
UNFL3   291    293#
UNFL4   307    309#
UPB     197    210    226    452    1343#
UPDN    792    803    805    819    830    832    1323#
UPM     198    211    305    1345#
VECT    272    280    285    301    330    352    890    982    1040#
WAIT    482    537#
WTT     539    549#

CROSS REFERENCE COMPLETE
```

```
ISIS-II 8080/8085 MACRO ASSEMBLER, V3.0          SPTB      PAGE    1
WMATA SPEED REGULATION ROUTINE TABLES

 LOC  OBJ          LINE        SOURCE STATEMENT

                     1 $MACROFILE
                     2 $PAGEWIDTH(80)
                     3 $PAGELENGTH(63)
                     4 $XREF
                     5 $        TITLE('WMATA SPEED REGULATION ROUTINE TABLES')
                     6          NAME    SPTB
                     7 ;06/04/82        CREATION BY K. W. CLAWSON
                     8 ;
                     9 ;        THIS CONTAINS THE TRANSITION DELAY MATICES
                    10 ;              CALCULATED FOR A MINIMUM OF 0.1 SEC.
                    11 ;
                    12 ;
                    13 ;
                    14 ;EPROM VECTOR AND MATRIX ADDRESSES
                    15 ;
 2800               16 TAB0    EQU     2800H   ;ROM VECTORS AND MATRICES
 2A80               17 TAB1    EQU     2A80H   ;PROGRAM STOP TABLES
 2AE0               18 TAB2    EQU     2AE0H   ;FORMAT: DTG MSB
 2AF0               19 TAB3    EQU     2AF0H   ;        DTG LSB
                    20                         ;        PSLMT MSB
                    21                         ;        PSLMT LSB
 2C00               22 PACC    EQU     2C00H   ;PERMISSION VECTORS
 2C20               23 DACC    EQU     2C20H   ;STATES 15......0
 2C40               24 PSAC    EQU     2C40H   ;       MSB    LSB
 2C60               25 PSDC    EQU     2C60H
 2C80               26 TLD     EQU     2C80H   ;TRAINLINE OUTPUT VECTOR
                    27                         ;CODED OUT6A MSB OUT0A LSB
                    28 ;DELAY MATRICES BASED ON SPEED
 2D00               29 TAB00   EQU     2D00H   ;DELAYS FOR 0 TO 23 MPH
 2E00               30 TAB23   EQU     2E00H   ;DELAYS FOR 23 TO 50 MPH
 2F00               31 TAB50   EQU     2F00H   ;DELAYS FOR ABOVE 50 MPH
                    32 ;
                    33 $EJECT

                    34 ;PROGRAM STOP SPEED LIMIT TABLES BASED ON DTG
                    35 ;FOUR TABLES INDEXED BY 3RD BYTE OF DTG COUNTER
                    36 ;
 2800               37         ORG     TAB0    ;CLOSEST TO STOPPING
 2800 0000          38         DW      0H      ; AT DISTANCE OF 0 FEET,
 2802 0000          39         DW      0H      ;      SPEED SHOULD BE 0 MPH.
 2804 0100          40         DW      1H      ; AT DISTANCE OF .0229167 FEET,
 2806 0200          41         DW      2H      ;      SPEED SHOULD BE .25 MPH.
```

ISIS-II 8080/8085 MACRO ASSEMBLER, V3.0 SPREG
WMATA SPEED REGULATION ROUTINE

| LOC | OBJ | LINE | SOURCE STATEMENT | | |
|---|---|---|---|---|---|
| 2808 | 0500 | 42 | DW | 5H | ; AT DISTANCE OF .0916667 FEET, |
| 280A | 0400 | 43 | DW | 4H | ; SPEED SHOULD BE .5 MPH. |
| 280C | 0800 | 44 | DW | 0BH | ; AT DISTANCE OF .20625 FEET, |
| 280E | 0600 | 45 | DW | 6H | ; SPEED SHOULD BE .75 MPH. |
| 2810 | 1400 | 46 | DW | 14H | ; AT DISTANCE OF .366667 FEET, |
| 2812 | 0800 | 47 | DW | 8H | ; SPEED SHOULD BE 1 MPH. |
| 2814 | 1F00 | 48 | DW | 1FH | ; AT DISTANCE OF .572917 FEET, |
| 2816 | 0A00 | 49 | DW | 0AH | ; SPEED SHOULD BE 1.25 MPH. |
| 2818 | 2D00 | 50 | DW | 2DH | ; AT DISTANCE OF .825 FEET, |
| 281A | 0C00 | 51 | DW | 0CH | ; SPEED SHOULD BE 1.5 MPH. |
| 281C | 3D00 | 52 | DW | 3DH | ; AT DISTANCE OF 1.12292 FEET, |
| 281E | 0E00 | 53 | DW | 0EH | ; SPEED SHOULD BE 1.75 MPH. |
| 2820 | 5000 | 54 | DW | 50H | ; AT DISTANCE OF 1.46667 FEET, |
| 2822 | 1000 | 55 | DW | 10H | ; SPEED SHOULD BE 2 MPH. |
| 2824 | 6500 | 56 | DW | 65H | ; AT DISTANCE OF 1.85625 FEET, |
| 2826 | 1200 | 57 | DW | 12H | ; SPEED SHOULD BE 2.25 MPH. |
| 2828 | 7D00 | 58 | DW | 7DH | ; AT DISTANCE OF 2.29167 FEET, |
| 282A | 1400 | 59 | DW | 14H | ; SPEED SHOULD BE 2.5 MPH. |
| 282C | 9700 | 60 | DW | 97H | ; AT DISTANCE OF 2.77292 FEET, |
| 282E | 1600 | 61 | DW | 16H | ; SPEED SHOULD BE 2.75 MPH. |
| 2830 | B400 | 62 | DW | 0B4H | ; AT DISTANCE OF 3.3 FEET, |
| 2832 | 1800 | 63 | DW | 18H | ; SPEED SHOULD BE 3 MPH. |
| 2834 | D300 | 64 | DW | 0D3H | ; AT DISTANCE OF 3.87292 FEET, |
| 2836 | 1A00 | 65 | DW | 1AH | ; SPEED SHOULD BE 3.25 MPH. |
| 2838 | F500 | 66 | DW | 0F5H | ; AT DISTANCE OF 4.49167 FEET, |
| 283A | 1C00 | 67 | DW | 1CH | ; SPEED SHOULD BE 3.5 MPH. |
| 283C | 1901 | 68 | DW | 119H | ; AT DISTANCE OF 5.15625 FEET, |
| 283E | 1E00 | 69 | DW | 1EH | ; SPEED SHOULD BE 3.75 MPH. |
| 2840 | 4001 | 70 | DW | 14DH | ; AT DISTANCE OF 5.86667 FEET, |
| 2842 | 2000 | 71 | DW | 20H | ; SPEED SHOULD BE 4 MPH. |
| 2844 | 6901 | 72 | DW | 169H | ; AT DISTANCE OF 6.62292 FEET, |
| 2846 | 2200 | 73 | DW | 22H | ; SPEED SHOULD BE 4.25 MPH. |
| 2848 | 9501 | 74 | DW | 195H | ; AT DISTANCE OF 7.425 FEET, |
| 284A | 2400 | 75 | DW | 24H | ; SPEED SHOULD BE 4.5 MPH. |
| 284C | C301 | 76 | DW | 1C3H | ; AT DISTANCE OF 8.27292 FEET, |
| 284E | 2600 | 77 | DW | 26H | ; SPEED SHOULD BE 4.75 MPH. |
| 2850 | F401 | 78 | DW | 1F4H | ; AT DISTANCE OF 9.16667 FEET, |
| 2852 | 2800 | 79 | DW | 28H | ; SPEED SHOULD BE 5 MPH. |
| 2854 | 2702 | 80 | DW | 227H | ; AT DISTANCE OF 10.1063 FEET, |
| 2856 | 2A00 | 81 | DW | 2AH | ; SPEED SHOULD BE 5.25 MPH. |
| 2858 | 5D02 | 82 | DW | 25DH | ; AT DISTANCE OF 11.0917 FEET, |
| 285A | 2C00 | 83 | DW | 2CH | ; SPEED SHOULD BE 5.5 MPH. |
| 285C | 9602 | 84 | DW | 296H | ; AT DISTANCE OF 12.1229 FEET, |
| 285E | 2E00 | 85 | DW | 2EH | ; SPEED SHOULD BE 5.75 MPH. |
| 2860 | D002 | 86 | DW | 2D0H | ; AT DISTANCE OF 13.2 FEET, |
| 2862 | 3000 | 87 | DW | 30H | ; SPEED SHOULD BE 6 MPH. |
| 2864 | 0E03 | 88 | DW | 30EH | ; AT DISTANCE OF 14.3229 FEET, |
| 2866 | 3200 | 89 | DW | 32H | ; SPEED SHOULD BE 6.25 MPH. |
| 2868 | 4D03 | 90 | DW | 34DH | ; AT DISTANCE OF 15.4917 FEET, |
| 286A | 3400 | 91 | DW | 34H | ; SPEED SHOULD BE 6.5 MPH. |
| 286C | 9003 | 92 | DW | 390H | ; AT DISTANCE OF 16.7063 FEET, |
| 286E | 3600 | 93 | DW | 36H | ; SPEED SHOULD BE 6.75 MPH. |
| 2870 | D403 | 94 | DW | 3D4H | ; AT DISTANCE OF 17.9667 FEET, |
| 2872 | 3800 | 95 | DW | 38H | ; SPEED SHOULD BE 7 MPH. |
| 2874 | 1C04 | 96 | DW | 41CH | ; AT DISTANCE OF 19.2729 FEET, |
| 2876 | 3A00 | 97 | DW | 3AH | ; SPEED SHOULD BE 7.25 MPH. |
| 2878 | 6504 | 98 | DW | 465H | ; AT DISTANCE OF 20.625 FEET, |
| 287A | 3C00 | 99 | DW | 3CH | ; SPEED SHOULD BE 7.5 MPH. |
| 287C | B204 | 100 | DW | 4B2H | ; AT DISTANCE OF 22.0229 FEET, |
| 287E | 3E00 | 101 | DW | 3EH | ; SPEED SHOULD BE 7.75 MPH. |
| 2880 | 0105 | 102 | DW | 501H | ; AT DISTANCE OF 23.4667 FEET, |
| 2882 | 4000 | 103 | DW | 40H | ; SPEED SHOULD BE 8 MPH. |
| 2884 | 5205 | 104 | DW | 552H | ; AT DISTANCE OF 24.9563 FEET, |
| 2886 | 4200 | 105 | DW | 42H | ; SPEED SHOULD BE 8.25 MPH. |
| 2888 | A605 | 106 | DW | 5A6H | ; AT DISTANCE OF 26.4917 FEET, |
| 288A | 4400 | 107 | DW | 44H | ; SPEED SHOULD BE 8.5 MPH. |
| 288C | FC05 | 108 | DW | 5FCH | ; AT DISTANCE OF 28.0729 FEET, |
| 288E | 4600 | 109 | DW | 46H | ; SPEED SHOULD BE 8.75 MPH. |
| 2890 | 5506 | 110 | DW | 655H | ; AT DISTANCE OF 29.7 FEET, |
| 2892 | 4800 | 111 | DW | 48H | ; SPEED SHOULD BE 9 MPH. |

ISIS-II 8080/8085 MACRO ASSEMBLER, V3.0 SPTB PAGE 3
WMATA SPEED REGULATION ROUTINE TABLES

| LOC | OBJ | LINE | SOURCE STATEMENT | | |
|---|---|---|---|---|---|
| 2894 | B006 | 112 | DW | 6B0H | ; AT DISTANCE OF 31.3729 FEET, |
| 2896 | 4A00 | 113 | DW | 4AH | ; SPEED SHOULD BE 9.25 MPH. |
| 2898 | 0E07 | 114 | DW | 70EH | ; AT DISTANCE OF 33.0917 FEET, |
| 289A | 4C00 | 115 | DW | 4CH | ; SPEED SHOULD BE 9.5 MPH. |
| 289C | 6E07 | 116 | DW | 76EH | ; AT DISTANCE OF 34.8563 FEET, |
| 289E | 4E00 | 117 | DW | 4EH | ; SPEED SHOULD BE 9.75 MPH. |
| 28A0 | D107 | 118 | DW | 7D1H | ; AT DISTANCE OF 36.6667 FEET, |
| 28A2 | 5000 | 119 | DW | 50H | ; SPEED SHOULD BE 10 MPH. |
| 28A4 | 3608 | 120 | DW | 836H | ; AT DISTANCE OF 38.5229 FEET, |
| 28A6 | 5200 | 121 | DW | 52H | ; SPEED SHOULD BE 10.25 MPH. |
| 28A8 | 9E08 | 122 | DW | 89EH | ; AT DISTANCE OF 40.425 FEET, |
| 28AA | 5400 | 123 | DW | 54H | ; SPEED SHOULD BE 10.5 MPH. |
| 28AC | 0809 | 124 | DW | 908H | ; AT DISTANCE OF 42.3729 FEET, |
| 28AE | 5600 | 125 | DW | 56H | ; SPEED SHOULD BE 10.75 MPH. |
| 28B0 | 7509 | 126 | DW | 975H | ; AT DISTANCE OF 44.3667 FEET, |
| 28B2 | 5800 | 127 | DW | 58H | ; SPEED SHOULD BE 11 MPH. |
| 28B4 | E409 | 128 | DW | 9E4H | ; AT DISTANCE OF 46.4063 FEET, |
| 28B6 | 5A00 | 129 | DW | 5AH | ; SPEED SHOULD BE 11.25 MPH. |
| 28B8 | 560A | 130 | DW | 0A56H | ; AT DISTANCE OF 48.4917 FEET, |
| 28BA | 5C00 | 131 | DW | 5CH | ; SPEED SHOULD BE 11.5 MPH. |
| 28BC | CA0A | 132 | DW | 0ACAH | ; AT DISTANCE OF 50.6229 FEET, |
| 28BE | 5E00 | 133 | DW | 5EH | ; SPEED SHOULD BE 11.75 MPH. |
| 28C0 | 410B | 134 | DW | 0B41H | ; AT DISTANCE OF 52.8 FEET, |
| 28C2 | 6000 | 135 | DW | 60H | ; SPEED SHOULD BE 12 MPH. |
| 28C4 | BA0B | 136 | DW | 0BBAH | ; AT DISTANCE OF 55.0229 FEET, |
| 28C6 | 6200 | 137 | DW | 62H | ; SPEED SHOULD BE 12.25 MPH. |
| 28C8 | 360C | 138 | DW | 0C36H | ; AT DISTANCE OF 57.2917 FEET, |
| 28CA | 6400 | 139 | DW | 64H | ; SPEED SHOULD BE 12.5 MPH. |
| 28CC | B50C | 140 | DW | 0CB5H | ; AT DISTANCE OF 59.6063 FEET, |
| 28CE | 6600 | 141 | DW | 66H | ; SPEED SHOULD BE 12.75 MPH. |
| 28D0 | 350D | 142 | DW | 0D35H | ; AT DISTANCE OF 61.9667 FEET, |
| 28D2 | 6800 | 143 | DW | 68H | ; SPEED SHOULD BE 13 MPH. |
| 28D4 | B90D | 144 | DW | 0D89H | ; AT DISTANCE OF 64.3729 FEET, |
| 28D6 | 6A00 | 145 | DW | 6AH | ; SPEED SHOULD BE 13.25 MPH. |
| 28D8 | 3E0E | 146 | DW | 0E3EH | ; AT DISTANCE OF 66.825 FEET, |
| 28DA | 6C00 | 147 | DW | 6CH | ; SPEED SHOULD BE 13.5 MPH. |
| 28DC | C70E | 148 | DW | 0EC7H | ; AT DISTANCE OF 69.3229 FEET, |
| 28DE | 6E00 | 149 | DW | 6EH | ; SPEED SHOULD BE 13.75 MPH. |
| 28E0 | 520F | 150 | DW | 0F52H | ; AT DISTANCE OF 71.8667 FEET, |
| 28E2 | 7000 | 151 | DW | 70H | ; SPEED SHOULD BE 14 MPH. |
| 28E4 | DF0F | 152 | DW | 0FDFH | ; AT DISTANCE OF 74.4563 FEET, |
| 28E6 | 7200 | 153 | DW | 72H | ; SPEED SHOULD BE 14.25 MPH. |
| 28E8 | 6F10 | 154 | DW | 106FH | ; AT DISTANCE OF 77.0917 FEET, |
| 28EA | 7400 | 155 | DW | 74H | ; SPEED SHOULD BE 14.5 MPH. |
| 28EC | 0111 | 156 | DW | 1101H | ; AT DISTANCE OF 79.7729 FEET, |
| 28EE | 7600 | 157 | DW | 76H | ; SPEED SHOULD BE 14.75 MPH. |
| 28F0 | 9611 | 158 | DW | 1196H | ; AT DISTANCE OF 82.5 FEET, |
| 28F2 | 7800 | 159 | DW | 78H | ; SPEED SHOULD BE 15 MPH. |
| 28F4 | 2D12 | 160 | DW | 122DH | ; AT DISTANCE OF 85.2729 FEET, |
| 28F6 | 7A00 | 161 | DW | 7AH | ; SPEED SHOULD BE 15.25 MPH. |
| 28F8 | C712 | 162 | DW | 12C7H | ; AT DISTANCE OF 88.0917 FEET, |
| 28FA | 7C00 | 163 | DW | 7CH | ; SPEED SHOULD BE 15.5 MPH. |
| 28FC | 6313 | 164 | DW | 1363H | ; AT DISTANCE OF 90.9563 FEET, |
| 28FE | 7E00 | 165 | DW | 7EH | ; SPEED SHOULD BE 15.75 MPH. |
| 2900 | 0214 | 166 | DW | 1402H | ; AT DISTANCE OF 93.8667 FEET, |
| 2902 | 8000 | 167 | DW | 80H | ; SPEED SHOULD BE 16 MPH. |
| 2904 | A314 | 168 | DW | 14A3H | ; AT DISTANCE OF 96.8229 FEET, |
| 2906 | 8200 | 169 | DW | 82H | ; SPEED SHOULD BE 16.25 MPH. |
| 2908 | 4715 | 170 | DW | 1547H | ; AT DISTANCE OF 99.825 FEET, |
| 290A | 8400 | 171 | DW | 84H | ; SPEED SHOULD BE 16.5 MPH. |
| 290C | EE15 | 172 | DW | 15EEH | ; AT DISTANCE OF 102.873 FEET, |
| 290E | 8600 | 173 | DW | 86H | ; SPEED SHOULD BE 16.75 MPH. |
| 2910 | 9616 | 174 | DW | 1696H | ; AT DISTANCE OF 105.967 FEET, |
| 2912 | 8800 | 175 | DW | 88H | ; SPEED SHOULD BE 17 MPH. |
| 2914 | 4217 | 176 | DW | 1742H | ; AT DISTANCE OF 109.106 FEET, |
| 2916 | 8A00 | 177 | DW | 8AH | ; SPEED SHOULD BE 17.25 MPH. |
| 2918 | EF17 | 178 | DW | 17EFH | ; AT DISTANCE OF 112.292 FEET, |
| 291A | 8C00 | 179 | DW | 8CH | ; SPEED SHOULD BE 17.5 MPH. |
| 291C | A018 | 180 | DW | 18A0H | ; AT DISTANCE OF 115.523 FEET, |
| 291E | 8E00 | 181 | DW | 8EH | ; SPEED SHOULD BE 17.75 MPH. |

ISIS-II 8080/8085 MACRO ASSEMBLER, V3.0 SPTB
WMATA SPEED REGULATION ROUTINE TABLES

| LOC | OBJ | LINE | SOURCE STATEMENT | | |
|---|---|---|---|---|---|
| 2920 | 5319 | 182 | DW | 1953H | ; AT DISTANCE OF 118.8 FEET, |
| 2922 | 9000 | 183 | DW | 90H | ; SPEED SHOULD BE 18 MPH. |
| 2924 | 081A | 184 | DW | 1A08H | ; AT DISTANCE OF 122.123 FEET, |
| 2926 | 9200 | 185 | DW | 92H | ; SPEED SHOULD BE 18.25 MPH. |
| 2928 | C01A | 186 | DW | 1AC0H | ; AT DISTANCE OF 125.492 FEET, |
| 292A | 9400 | 187 | DW | 94H | ; SPEED SHOULD BE 18.5 MPH. |
| 292C | 7A1B | 188 | DW | 1B7AH | ; AT DISTANCE OF 128.906 FEET, |
| 292E | 9600 | 189 | DW | 96H | ; SPEED SHOULD BE 18.75 MPH. |
| 2930 | 371C | 190 | DW | 1C37H | ; AT DISTANCE OF 132.367 FEET, |
| 2932 | 9800 | 191 | DW | 98H | ; SPEED SHOULD BE 19 MPH. |
| 2934 | F61C | 192 | DW | 1CF6H | ; AT DISTANCE OF 135.873 FEET, |
| 2936 | 9A00 | 193 | DW | 9AH | ; SPEED SHOULD BE 19.25 MPH. |
| 2938 | B81D | 194 | DW | 1DB8H | ; AT DISTANCE OF 139.425 FEET, |
| 293A | 9C00 | 195 | DW | 9CH | ; SPEED SHOULD BE 19.5 MPH. |
| 293C | 7C1E | 196 | DW | 1E7CH | ; AT DISTANCE OF 143.023 FEET, |
| 293E | 9E00 | 197 | DW | 9EH | ; SPEED SHOULD BE 19.75 MPH. |
| 2940 | 431F | 198 | DW | 1F43H | ; AT DISTANCE OF 146.667 FEET, |
| 2942 | A000 | 199 | DW | 0A0H | ; SPEED SHOULD BE 20 MPH. |
| 2944 | D820 | 200 | DW | 2008H | ; AT DISTANCE OF 154.092 FEET, |
| 2946 | A400 | 201 | DW | 0A4H | ; SPEED SHOULD BE 20.5 MPH. |
| 2948 | 7822 | 202 | DW | 2278H | ; AT DISTANCE OF 161.7 FEET, |
| 294A | A800 | 203 | DW | 0A8H | ; SPEED SHOULD BE 21 MPH. |
| 294C | 2124 | 204 | DW | 2421H | ; AT DISTANCE OF 169.492 FEET, |
| 294E | AC00 | 205 | DW | 0ACH | ; SPEED SHOULD BE 21.5 MPH. |
| 2950 | D425 | 206 | DW | 25D4H | ; AT DISTANCE OF 177.467 FEET, |
| 2952 | B000 | 207 | DW | 0B0H | ; SPEED SHOULD BE 22 MPH. |
| 2954 | 9127 | 208 | DW | 2791H | ; AT DISTANCE OF 185.625 FEET, |
| 2956 | B400 | 209 | DW | 0B4H | ; SPEED SHOULD BE 22.5 MPH. |
| 2958 | 5829 | 210 | DW | 2958H | ; AT DISTANCE OF 193.967 FEET, |
| 295A | B800 | 211 | DW | 0B8H | ; SPEED SHOULD BE 23 MPH. |
| 295C | 292B | 212 | DW | 2B29H | ; AT DISTANCE OF 202.492 FEET, |
| 295E | BC00 | 213 | DW | 0BCH | ; SPEED SHOULD BE 23.5 MPH. |
| 2960 | 052D | 214 | DW | 2D05H | ; AT DISTANCE OF 211.2 FEET, |
| 2962 | C000 | 215 | DW | 0C0H | ; SPEED SHOULD BE 24 MPH. |
| 2964 | EA2E | 216 | DW | 2EEAH | ; AT DISTANCE OF 220.092 FEET, |
| 2966 | C400 | 217 | DW | 0C4H | ; SPEED SHOULD BE 24.5 MPH. |
| 2968 | D930 | 218 | DW | 30D9H | ; AT DISTANCE OF 229.167 FEET, |
| 296A | C800 | 219 | DW | 0C8H | ; SPEED SHOULD BE 25 MPH. |
| 296C | D232 | 220 | DW | 32D2H | ; AT DISTANCE OF 238.425 FEET, |
| 296E | CC00 | 221 | DW | 0CCH | ; SPEED SHOULD BE 25.5 MPH. |
| 2970 | D534 | 222 | DW | 34D5H | ; AT DISTANCE OF 247.867 FEET, |
| 2972 | D000 | 223 | DW | 0D0H | ; SPEED SHOULD BE 26 MPH. |
| 2974 | E336 | 224 | DW | 36E3H | ; AT DISTANCE OF 257.492 FEET, |
| 2976 | D400 | 225 | DW | 0D4H | ; SPEED SHOULD BE 26.5 MPH. |
| 2978 | FA38 | 226 | DW | 38FAH | ; AT DISTANCE OF 267.3 FEET, |
| 297A | D800 | 227 | DW | 0D8H | ; SPEED SHOULD BE 27 MPH. |
| 297C | 1B3B | 228 | DW | 3B1BH | ; AT DISTANCE OF 277.292 FEET, |
| 297E | DC00 | 229 | DW | 0DCH | ; SPEED SHOULD BE 27.5 MPH. |
| 2980 | 463D | 230 | DW | 3D46H | ; AT DISTANCE OF 287.467 FEET, |
| 2982 | E000 | 231 | DW | 0E0H | ; SPEED SHOULD BE 28 MPH. |
| 2984 | 7C3F | 232 | DW | 3F7CH | ; AT DISTANCE OF 297.825 FEET, |
| 2986 | E400 | 233 | DW | 0E4H | ; SPEED SHOULD BE 28.5 MPH. |
| 2988 | BB41 | 234 | DW | 41BBH | ; AT DISTANCE OF 308.367 FEET, |
| 298A | E800 | 235 | DW | 0E8H | ; SPEED SHOULD BE 29 MPH. |
| 298C | 0444 | 236 | DW | 4404H | ; AT DISTANCE OF 319.092 FEET, |
| 298E | EC00 | 237 | DW | 0ECH | ; SPEED SHOULD BE 29.5 MPH. |
| 2990 | 5746 | 238 | DW | 4657H | ; AT DISTANCE OF 330 FEET, |
| 2992 | F000 | 239 | DW | 0F0H | ; SPEED SHOULD BE 30 MPH. |
| 2994 | B448 | 240 | DW | 48B4H | ; AT DISTANCE OF 341.092 FEET, |
| 2996 | F400 | 241 | DW | 0F4H | ; SPEED SHOULD BE 30.5 MPH. |
| 2998 | 1C4B | 242 | DW | 4B1CH | ; AT DISTANCE OF 352.367 FEET, |
| 299A | F800 | 243 | DW | 0F8H | ; SPEED SHOULD BE 31 MPH. |
| 299C | 8D4D | 244 | DW | 4D8DH | ; AT DISTANCE OF 363.825 FEET, |
| 299E | FC00 | 245 | DW | 0FCH | ; SPEED SHOULD BE 31.5 MPH. |
| 29A0 | 0850 | 246 | DW | 5008H | ; AT DISTANCE OF 375.467 FEET, |
| 29A2 | 0001 | 247 | DW | 10DH | ; SPEED SHOULD BE 32 MPH. |
| 29A4 | 8E52 | 248 | DW | 528EH | ; AT DISTANCE OF 387.292 FEET, |
| 29A6 | 0401 | 249 | DW | 104H | ; SPEED SHOULD BE 32.5 MPH. |

ISIS-II 8080/8085 MACRO ASSEMBLER, V3.0 SPTB
WMATA SPEED REGULATION ROUTINE TABLES

| LOC | OBJ | LINE | SOURCE STATEMENT | | |
|---|---|---|---|---|---|
| 29A8 | 1D55 | 250 | DW | 551DH | ; AT DISTANCE OF 399.3 FEET, |
| 29AA | 0801 | 251 | DW | 108H | ; SPEED SHOULD BE 33 MPH. |
| 29AC | B657 | 252 | DW | 5786H | ; AT DISTANCE OF 411.492 FEET, |
| 29AE | 0C01 | 253 | DW | 10CH | ; SPEED SHOULD BE 33.5 MPH. |
| 29B0 | 595A | 254 | DW | 5A59H | ; AT DISTANCE OF 423.867 FEET, |
| 29B2 | 1001 | 255 | DW | 110H | ; SPEED SHOULD BE 34 MPH. |
| 29B4 | 075D | 256 | DW | 5D07H | ; AT DISTANCE OF 436.425 FEET, |
| 29B6 | 1401 | 257 | DW | 114H | ; SPEED SHOULD BE 34.5 MPH. |
| 29B8 | BE5F | 258 | DW | 5FBEH | ; AT DISTANCE OF 449.167 FEET, |
| 29BA | 1801 | 259 | DW | 118H | ; SPEED SHOULD BE 35 MPH. |
| 29BC | 7F62 | 260 | DW | 627FH | ; AT DISTANCE OF 462.092 FEET, |
| 29BE | 1C01 | 261 | DW | 11CH | ; SPEED SHOULD BE 35.5 MPH. |
| 29C0 | 4A65 | 262 | DW | 654AH | ; AT DISTANCE OF 475.2 FEET, |
| 29C2 | 2001 | 263 | DW | 120H | ; SPEED SHOULD BE 36 MPH. |
| 29C4 | 2068 | 264 | DW | 6820H | ; AT DISTANCE OF 488.492 FEET, |
| 29C6 | 2401 | 265 | DW | 124H | ; SPEED SHOULD BE 36.5 MPH. |
| 29C8 | FF6A | 266 | DW | 6AFFH | ; AT DISTANCE OF 501.967 FEET, |
| 29CA | 2801 | 267 | DW | 128H | ; SPEED SHOULD BE 37 MPH. |
| 29CC | E86D | 268 | DW | 6DE8H | ; AT DISTANCE OF 515.625 FEET, |
| 29CE | 2C01 | 269 | DW | 12CH | ; SPEED SHOULD BE 37.5 MPH. |
| 29D0 | DC70 | 270 | DW | 70DCH | ; AT DISTANCE OF 529.467 FEET, |
| 29D2 | 3001 | 271 | DW | 130H | ; SPEED SHOULD BE 38 MPH. |
| 29D4 | D973 | 272 | DW | 73D9H | ; AT DISTANCE OF 543.492 FEET, |
| 29D6 | 3401 | 273 | DW | 134H | ; SPEED SHOULD BE 38.5 MPH. |
| 29D8 | E076 | 274 | DW | 76E0H | ; AT DISTANCE OF 557.7 FEET, |
| 29DA | 3801 | 275 | DW | 138H | ; SPEED SHOULD BE 39 MPH. |
| 29DC | F279 | 276 | DW | 79F2H | ; AT DISTANCE OF 572.092 FEET, |
| 29DE | 3C01 | 277 | DW | 13CH | ; SPEED SHOULD BE 39.5 MPH. |
| 29E0 | 0D7D | 278 | DW | 7D0DH | ; AT DISTANCE OF 586.667 FEET, |
| 29E2 | 4001 | 279 | DW | 140H | ; SPEED SHOULD BE 40 MPH. |
| 29E4 | 6283 | 280 | DW | 8362H | ; AT DISTANCE OF 616.367 FEET, |
| 29E6 | 4801 | 281 | DW | 148H | ; SPEED SHOULD BE 41 MPH. |
| 29E8 | DE89 | 282 | DW | 89DEH | ; AT DISTANCE OF 646.8 FEET, |
| 29EA | 5001 | 283 | DW | 150H | ; SPEED SHOULD BE 42 MPH. |
| 29EC | 8390 | 284 | DW | 9083H | ; AT DISTANCE OF 677.967 FEET, |
| 29EE | 5801 | 285 | DW | 158H | ; SPEED SHOULD BE 43 MPH. |
| 29F0 | 5097 | 286 | DW | 9750H | ; AT DISTANCE OF 709.867 FEET, |
| 29F2 | 6001 | 287 | DW | 160H | ; SPEED SHOULD BE 44 MPH. |
| 29F4 | 449E | 288 | DW | 9E44H | ; AT DISTANCE OF 742.5 FEET, |
| 29F6 | 6801 | 289 | DW | 168H | ; SPEED SHOULD BE 45 MPH. |
| 29F8 | 61A5 | 290 | DW | 0A561H | ; AT DISTANCE OF 775.867 FEET, |
| 29FA | 7001 | 291 | DW | 170H | ; SPEED SHOULD BE 46 MPH. |
| 29FC | A6AC | 292 | DW | 0ACA6H | ; AT DISTANCE OF 809.967 FEET, |
| 29FE | 7801 | 293 | DW | 178H | ; SPEED SHOULD BE 47 MPH. |
| 2A00 | 13B4 | 294 | DW | 0B413H | ; AT DISTANCE OF 844.8 FEET, |
| 2A02 | 8001 | 295 | DW | 180H | ; SPEED SHOULD BE 48 MPH. |
| 2A04 | A7B8 | 296 | DW | 0BBA7H | ; AT DISTANCE OF 880.367 FEET, |
| 2A06 | 8801 | 297 | DW | 188H | ; SPEED SHOULD BE 49 MPH. |
| 2A08 | 64C3 | 298 | DW | 0C364H | ; AT DISTANCE OF 916.667 FEET, |
| 2A0A | 9001 | 299 | DW | 190H | ; SPEED SHOULD BE 50 MPH. |
| 2A0C | 49CB | 300 | DW | 0CB49H | ; AT DISTANCE OF 953.7 FEET, |
| 2A0E | 9801 | 301 | DW | 198H | ; SPEED SHOULD BE 51 MPH. |
| 2A10 | 56D3 | 302 | DW | 0D356H | ; AT DISTANCE OF 991.467 FEET, |
| 2A12 | A001 | 303 | DW | 1A0H | ; SPEED SHOULD BE 52 MPH. |
| 2A14 | 88DB | 304 | DW | 0DB88H | ; AT DISTANCE OF 1029.97 FEET, |
| 2A16 | A801 | 305 | DW | 1A8H | ; SPEED SHOULD BE 53 MPH. |
| 2A18 | E7E3 | 306 | DW | 0E3E7H | ; AT DISTANCE OF 1069.2 FEET, |
| 2A1A | B001 | 307 | DW | 1B0H | ; SPEED SHOULD BE 54 MPH. |
| 2A1C | 6CEC | 308 | DW | 0EC6CH | ; AT DISTANCE OF 1109.17 FEET, |
| 2A1E | B801 | 309 | DW | 1B8H | ; SPEED SHOULD BE 55 MPH. |
| 2A20 | 19F5 | 310 | DW | 0F519H | ; AT DISTANCE OF 1149.87 FEET, |
| 2A22 | C001 | 311 | DW | 1C0H | ; SPEED SHOULD BE 56 MPH. |
| 2A24 | FEFD | 312 | DW | 0FDFEH | ; AT DISTANCE OF 1191.3 FEET, |
| 2A26 | C801 | 313 | DW | 1C8H | ; SPEED SHOULD BE 57 MPH. |
| 2A28 | FFFF | 314 | DW | 0FFFFH | ; AT DISTANCE OF 1200.99 FEET, |
| 2A2A | CA01 | 315 | DW | 1CAH | ; SPEED SHOULD BE 57.25 MPH. |
| | | 316 ; | | | |
| | | 317 $EJECT | | | |

```
ISIS-II 8080/8085 MACRO ASSEMBLER, V3.0          SPTB
WMATA SPEED REGULATION ROUTINE TABLES

LOC  OBJ          LINE        SOURCE STATEMENT

2A80              318         ORG     TAB1
2A80 0000         319         DW      0          ; AT DISTANCE OF 1201 FEET,
2A82 CA01         320         DW      1CAH       ;     SPEED SHOULD BE 57.25 MPH.
2A84 E806         321         DW      6E8H       ; AT DISTANCE OF 1233.47 FEET,
2A86 D001         322         DW      1D0H       ;     SPEED SHOULD BE 58 MPH.
2A88 1010         323         DW      1010H      ; AT DISTANCE OF 1276.37 FEET,
2A8A D801         324         DW      1D8H       ;     SPEED SHOULD BE 59 MPH.
2A8C 5D19         325         DW      195DH      ; AT DISTANCE OF 1320 FEET,
2A8E E001         326         DW      1E0H       ;     SPEED SHOULD BE 60 MPH.
2A90 D222         327         DW      22D2H      ; AT DISTANCE OF 1364.37 FEET,
2A92 E801         328         DW      1E8H       ;     SPEED SHOULD BE 61 MPH.
2A94 6F2C         329         DW      2C6FH      ; AT DISTANCE OF 1409.47 FEET,
2A96 F001         330         DW      1F0H       ;     SPEED SHOULD BE 62 MPH.
2A98 3436         331         DW      3634H      ; AT DISTANCE OF 1455.3 FEET,
2A9A F801         332         DW      1F8H       ;     SPEED SHOULD BE 63 MPH.
2A9C 2140         333         DW      4021H      ; AT DISTANCE OF 1501.87 FEET,
2A9E 0002         334         DW      200H       ;     SPEED SHOULD BE 64 MPH.
2AA0 364A         335         DW      4A36H      ; AT DISTANCE OF 1549.17 FEET,
2AA2 0802         336         DW      208H       ;     SPEED SHOULD BE 65 MPH.
2AA4 7354         337         DW      5473H      ; AT DISTANCE OF 1597.2 FEET,
2AA6 1002         338         DW      210H       ;     SPEED SHOULD BE 66 MPH.
2AA8 D85E         339         DW      5ED8H      ; AT DISTANCE OF 1645.97 FEET,
2AAA 1802         340         DW      218H       ;     SPEED SHOULD BE 67 MPH.
2AAC 6569         341         DW      6965H      ; AT DISTANCE OF 1695.47 FEET,
2AAE 2002         342         DW      220H       ;     SPEED SHOULD BE 68 MPH.
2AB0 1A74         343         DW      741AH      ; AT DISTANCE OF 1745.7 FEET,
2AB2 2802         344         DW      228H       ;     SPEED SHOULD BE 69 MPH.
2AB4 F77E         345         DW      7EF7H      ; AT DISTANCE OF 1796.67 FEET,
2AB6 3002         346         DW      230H       ;     SPEED SHOULD BE 70 MPH.
2AB8 FD89         347         DW      89FDH      ; AT DISTANCE OF 1848.37 FEET,
2ABA 3802         348         DW      238H       ;     SPEED SHOULD BE 71 MPH.
2ABC 2A95         349         DW      952AH      ; AT DISTANCE OF 1900.8 FEET,
2ABE 4002         350         DW      240H       ;     SPEED SHOULD BE 72 MPH.
2AC0 7FA0         351         DW      0A07FH     ; AT DISTANCE OF 1953.97 FEET,
2AC2 4802         352         DW      248H       ;     SPEED SHOULD BE 73 MPH.
2AC4 FCAB         353         DW      0A8FCH     ; AT DISTANCE OF 2007.87 FEET,
2AC6 5002         354         DW      250H       ;     SPEED SHOULD BE 74 MPH.
2AC8 A1B7         355         DW      0B7A1H     ; AT DISTANCE OF 2062.5 FEET,
2ACA 5802         356         DW      258H       ;     SPEED SHOULD BE 75 MPH.
2ACC FFFF         357         DW      0FFFFH     ; END OF TABLE.
2ACE 8002         358         DW      280H       ; SPEED OF 80 MPH.
                  359 ;
                  360 $EJECT
2AE0              361         ORG     TAB2
                  362 ;
2AE0 0000         363         DW      0          ; ABOVE RANGE.
2AE2 8002         364         DW      280H
2AE4 FFFF         365         DW      0FFFFH
2AE6 8002         366         DW      280H
                  367 ;
2AF0              368         ORG     TAB3
                  369 ;
2AF0 0000         370         DW      0          ; ABOVE RANGE.
2AF2 8002         371         DW      280H
2AF4 FFFF         372         DW      0FFFFH
2AF6 8002         373         DW      280H
                  374 ;
                  375 $EJECT

                  376 ;PERMISSION VECTORS
                  377 ;EACH WORD STATE 15.....8 7......0
                  378 ;1=ALLOWED 0=NO TRANSITION ALLOWED
2C00              379         ORG     PACC       ;ACCELERATING DURING SPMAT
                  380                            ;STATE FROM AND ALLOWED TO
2C00 0002         381         DW      0200H      ;STATE 0 TO 9
2C02 0100         382         DW      0001H      ;STATE 1 TO 0
2C04 0100         383         DW      0001H      ;STATE 2 TO 0
2C06 0100         384         DW      0001H      ;STATE 3 TO 0
```

```
ISIS-II 8080/8085 MACRO ASSEMBLER, V3.0          SPTB
WMATA SPEED REGULATION ROUTINE TABLES

LOC  OBJ        LINE        SOURCE STATEMENT

2C08 0100       385         DW      0001H   ;STATE 4 TO 0
2C0A 0100       386         DW      0001H   ;STATE 5 TO 0
2C0C 0100       387         DW      0001H   ;STATE 6 TO 0
2C0E 0100       388         DW      0001H   ;STATE 7 TO 0
2C10 0100       389         DW      0001H   ;STATE 8 TO 0
2C12 0004       390         DW      0400H   ;STATE 9 TO 10
2C14 0008       391         DW      0800H   ;STATE 10 TO 11
2C16 0010       392         DW      1000H   ;STATE 11 TO 12
2C18 0020       393         DW      2000H   ;STATE 12 TO 13
2C1A 0020       394         DW      2000H   ;STATE 13 TO 13
2C1C 0000       395         DW      0000H   ;NO STATE 14
2C1E 0000       396         DW      0000H   ;NO STATE 15
                397 ;
                398 $EJECT
2C20            399         ORG     DACC    ;DECELERATING DURING SPMAT
2C20 0200       400         DW      0002H   ;STATE 0 TO 1
2C22 0400       401         DW      0004H   ;STATE 1 TO 2
2C24 0800       402         DW      0008H   ;STATE 2 TO 3
2C26 1000       403         DW      0010H   ;STATE 3 TO 4
2C28 2000       404         DW      0020H   ;STATE 4 TO 5
2C2A 4000       405         DW      0040H   ;STATE 5 TO 6
2C2C 8000       406         DW      0080H   ;STATE 6 TO 7
2C2E 0001       407         DW      0100H   ;STATE 7 TO 8
2C30 0001       408         DW      0100H   ;STATE 8 TO 8
2C32 0100       409         DW      0001H   ;STATE 9 TO 0
2C34 0100       410         DW      0001H   ;STATE 10 TO 0
2C36 0100       411         DW      0001H   ;STATE 11 TO 0
2C38 0100       412         DW      0001H   ;STATE 12 TO 0
2C3A 0100       413         DW      0001H   ;STATE 13 TO 0
2C3C 0000       414         DW      0000H   ;NO STATE 14
2C3E 0000       415         DW      0000H   ;NO STATE 15
                416 ;
                417 $EJECT
2C40            418         ORG     PSAC    ;ACCELERATING DURING PSTOP
2C40 0002       419         DW      0200H   ;STATE 0 TO 9
2C42 0002       420         DW      0200H   ;STATE 1 TO 9
2C44 0002       421         DW      0200H   ;STATE 2 TO 9
2C46 0002       422         DW      0200H   ;STATE 3 TO 9
2C48 0002       423         DW      0200H   ;STATE 4 TO 9
2C4A 0002       424         DW      0200H   ;STATE 5 TO 9
2C4C 0002       425         DW      0200H   ;STATE 6 TO 9
2C4E 0002       426         DW      0200H   ;STATE 7 TO 9
2C50 0002       427         DW      0200H   ;STATE 8 TO 9
2C52 0004       428         DW      0400H   ;STATE 9 TO 10
2C54 0008       429         DW      0800H   ;STATE 10 TO 11
2C56 0010       430         DW      1000H   ;STATE 11 TO 12
2C58 0020       431         DW      2000H   ;STATE 12 TO 13
2C5A 0020       432         DW      2000H   ;STATE 13 TO 13
2C5C 0000       433         DW      0000H   ;NO STATE 14
2C5E 0000       434         DW      0000H   ;NO STATE 15
                435 ;
                436 $EJECT
2C60            437         ORG     PSDC    ;DECELERATING DURING PSTOP
2C60 0100       438         DW      0001H   ;STATE 0 TO 0
2C62 0100       439         DW      0001H   ;STATE 1 TO 0
2C64 0100       440         DW      0001H   ;STATE 2 TO 0
2C66 0100       441         DW      0001H   ;STATE 3 TO 0
2C68 0100       442         DW      0001H   ;STATE 4 TO 0
2C6A 0100       443         DW      0001H   ;STATE 5 TO 0
2C6C 0100       444         DW      0001H   ;STATE 6 TO 0
2C6E 0100       445         DW      0001H   ;STATE 7 TO 0
2C70 0100       446         DW      0001H   ;STATE 8 TO 0
2C72 0100       447         DW      0001H   ;STATE 9 TO 0
2C74 0002       448         DW      0200H   ;STATE 10 TO 9
2C76 0002       449         DW      0200H   ;STATE 11 TO 9
2C78 0002       450         DW      0200H   ;STATE 12 TO 9
2C7A 0002       451         DW      0200H   ;STATE 13 TO 9
2C7C 0000       452         DW      0000H   ;NO STATE 14
2C7E 0000       453         DW      0000H   ;NO STATE 15
                454 ;
                455 $EJECT
```

```
ISIS-II 8080/8085 MACRO ASSEMBLER, V3.0          SPTB      PAGE    14
WMATA SPEED REGULATION ROUTINE TABLES

 LOC  OBJ          LINE        SOURCE STATEMENT

                   456 ;ENCODED TRAINLINE OUTPUT VECTOR
 2C80              457         ORG     TLD
 2C80 C106         458         DW      06C1H     ;STATE 0
 2C82 C306         459         DW      06C3H     ;STATE 1
 2C84 CB07         460         DW      07CBH     ;STATE 2
 2C86 DB07         461         DW      07DBH     ;STATE 3
 2C88 FB07         462         DW      07FBH     ;STATE 4
 2C8A C707         463         DW      07C7H     ;STATE 5
 2C8C CF0F         464         DW      0FCFH     ;STATE 6
 2C8E DF0F         465         DW      0FDFH     ;STATE 7
 2C90 FF0F         466         DW      0FFFH     ;STATE 8
 2C92 C004         467         DW      04C0H     ;STATE 9
 2C94 C00C         468         DW      0CC0H     ;STATE 10
 2C96 C008         469         DW      08C0H     ;STATE 11
 2C98 C000         470         DW      00C0H     ;STATE 12
 2C9A C002         471         DW      02C0H     ;STATE 13
 2C9C C000         472         DW      00C0H     ;STATE 14
 2C9E C000         473         DW      00C0H     ;STATE 15
                   474 ;
                   475 $EJECT
                   476 ;DELAY MATRIX FOR SPEEDS LESS THAN 23 MPH
                   477 ;DELAYS ARE NUMBER OF 20 MSEC TO COUNT DOWN
                   478 ; MINIMUM DELAY IS 20 MSEC.
 2D00              479         ORG     TA300
 2D00 00           480         DB      0         ;0 TO 0
 2D01 1C           481         DB      28        ;0 TO 1
 2D02 23           482         DB      35        ;0 TO 2
 2D03 23           483         DB      35        ;0 TO 3
 2D04 23           484         DB      35        ;0 TO 4
 2D05 23           485         DB      35        ;0 TO 5
 2D06 45           486         DB      69        ;0 TO 6
 2D07 45           487         DB      69        ;0 TO 7
 2D08 45           488         DB      69        ;0 TO 8
 2D09 13           489         DB      19        ;0 TO 9
 2D0A 29           490         DB      41        ;0 TO 10
 2D0B 2E           491         DB      46        ;0 TO 11
 2D0C 37           492         DB      55        ;0 TO 12
 2D0D 45           493         DB      69        ;0 TO 13
 2D0E 00           494         DB      0         ;0 TO 14
 2D0F 00           495         DB      0         ;0 TO 15
 2D10 1C           496         DB      28        ;1 TO 0
 2D11 00           497         DB      00        ;1 TO 1
 2D12 12           498         DB      18        ;1 TO 2
 2D13 12           499         DB      18        ;1 TO 3
 2D14 12           500         DB      18        ;1 TO 4
 2D15 15           501         DB      21        ;1 TO 5
 2D16 3A           502         DB      58        ;1 TO 6
 2D17 34           503         DB      52        ;1 TO 7
 2D18 34           504         DB      52        ;1 TO 8
 2D19 23           505         DB      35        ;1 TO 9
 2D1A 3A           506         DB      58        ;1 TO 10
 2D1B 3F           507         DB      63        ;1 TO 11
 2D1C 44           508         DB      68        ;1 TO 12
 2D1D 56           509         DB      86        ;1 TO 13
 2D1E 00           510         DB      0         ;1 TO 14
 2D1F 00           511         DB      0         ;1 TO 15
 2D20 23           512         DB      35        ;2 TO 0
 2D21 12           513         DB      18        ;2 TO 1
 2D22 00           514         DB      0         ;2 TO 2
 2D23 0A           515         DB      10        ;2 TO 3
 2D24 0C           516         DB      12        ;2 TO 4
 2D25 0A           517         DB      10        ;2 TO 5
 2D26 2B           518         DB      43        ;2 TO 6
 2D27 23           519         DB      35        ;2 TO 7
 2D28 23           520         DB      35        ;2 TO 8
 2D29 34           521         DB      52        ;2 TO 9
 2D2A 4B           522         DB      75        ;2 TO 10
 2D2B 50           523         DB      80        ;2 TO 11
 2D2C 54           524         DB      84        ;2 TO 12
 2D2D 66           525         DB      102       ;2 TO 13
 2D2E 00           526         DB      0         ;2 TO 14
 2D2F 00           527         DB      0         ;2 TO 15
```

ISIS-II 8080/8085 MACRO ASSEMBLER, V3.0 SPTB
WMATA SPEED REGULATION ROUTINE TABLES

| LOC | OBJ | LINE | SOURCE STATEMENT | | |
|---|---|---|---|---|---|
| 2D30 | 23 | 528 | DB | 35 | ;3 TO 0 |
| 2D31 | 12 | 529 | DB | 18 | ;3 TO 1 |
| 2D32 | 0A | 530 | DB | 10 | ;3 TO 2 |
| 2D33 | 00 | 531 | DB | 0 | ;3 TO 3 |
| 2D34 | 0A | 532 | DB | 10 | ;3 TO 4 |
| 2D35 | 0B | 533 | DB | 11 | ;3 TO 5 |
| 2D36 | 30 | 534 | DB | 48 | ;3 TO 6 |
| 2D37 | 57 | 535 | DB | 87 | ;3 TO 7 |
| 2D38 | 23 | 536 | DB | 35 | ;3 TO 8 |
| 2D39 | 34 | 537 | DB | 52 | ;3 TO 9 |
| 2D3A | 4B | 538 | DB | 75 | ;3 TO 10 |
| 2D3B | 50 | 539 | DB | 80 | ;3 TO 11 |
| 2D3C | 54 | 540 | DB | 84 | ;3 TO 12 |
| 2D3D | 66 | 541 | DB | 102 | ;3 TO 13 |
| 2D3E | 00 | 542 | DB | 0 | ;3 TO 14 |
| 2D3F | 00 | 543 | DB | 0 | ;3 TO 15 |
| 2D40 | 23 | 544 | DB | 35 | ;4 TO 0 |
| 2D41 | 12 | 545 | DB | 18 | ;4 TO 1 |
| 2D42 | 0C | 546 | DB | 12 | ;4 TO 2 |
| 2D43 | 0A | 547 | DB | 10 | ;4 TO 3 |
| 2D44 | 00 | 548 | DB | 0 | ;4 TO 4 |
| 2D45 | 12 | 549 | DB | 18 | ;4 TO 5 |
| 2D46 | 37 | 550 | DB | 55 | ;4 TO 6 |
| 2D47 | 2E | 551 | DB | 46 | ;4 TO 7 |
| 2D48 | 27 | 552 | DB | 39 | ;4 TO 8 |
| 2D49 | 34 | 553 | DB | 52 | ;4 TO 9 |
| 2D4A | 4B | 554 | DB | 75 | ;4 TO 10 |
| 2D4B | 50 | 555 | DB | 80 | ;4 TO 11 |
| 2D4C | 54 | 556 | DB | 84 | ;4 TO 12 |
| 2D4D | 66 | 557 | DB | 102 | ;4 TO 13 |
| 2D4E | 00 | 558 | DB | 0 | ;4 TO 14 |
| 2D4F | 00 | 559 | DB | 0 | ;4 TO 15 |
| 2D50 | 23 | 560 | DB | 35 | ;5 TO 0 |
| 2D51 | 15 | 561 | DB | 21 | ;5 TO 1 |
| 2D52 | 0A | 562 | DB | 10 | ;5 TO 2 |
| 2D53 | 0B | 563 | DB | 11 | ;5 TO 3 |
| 2D54 | 12 | 564 | DB | 18 | ;5 TO 4 |
| 2D55 | 00 | 565 | DB | 0 | ;5 TO 5 |
| 2D56 | 25 | 566 | DB | 37 | ;5 TO 6 |
| 2D57 | 23 | 567 | DB | 35 | ;5 TO 7 |
| 2D58 | 23 | 568 | DB | 35 | ;5 TO 8 |
| 2D59 | 34 | 569 | DB | 52 | ;5 TO 9 |
| 2D5A | 4B | 570 | DB | 75 | ;5 TO 10 |
| 2D5B | 50 | 571 | DB | 80 | ;5 TO 11 |
| 2D5C | 54 | 572 | DB | 84 | ;5 TO 12 |
| 2D5D | 66 | 573 | DB | 102 | ;5 TO 13 |
| 2D5E | 00 | 574 | DB | 0 | ;5 TO 14 |
| 2D5F | 00 | 575 | DB | 0 | ;5 TO 15 |
| 2D60 | 45 | 576 | DB | 69 | ;6 TO 0 |
| 2D61 | 3A | 577 | DB | 58 | ;6 TO 1 |
| 2D62 | 28 | 578 | DB | 43 | ;6 TO 2 |
| 2D63 | 30 | 579 | DB | 48 | ;6 TO 3 |
| 2D64 | 37 | 580 | DB | 55 | ;6 TO 4 |
| 2D65 | 25 | 581 | DB | 37 | ;6 TO 5 |
| 2D66 | 00 | 582 | DB | 0 | ;6 TO 6 |
| 2D67 | 0A | 583 | DB | 10 | ;6 TO 7 |
| 2D68 | 10 | 584 | DB | 16 | ;6 TO 8 |
| 2D69 | 56 | 585 | DB | 86 | ;6 TO 9 |
| 2D6A | 6E | 586 | DB | 110 | ;6 TO 10 |
| 2D6B | 72 | 587 | DB | 114 | ;6 TO 11 |
| 2D6C | 77 | 588 | DB | 119 | ;6 TO 12 |
| 2D6D | 89 | 589 | DB | 137 | ;6 TO 13 |
| 2D6E | 00 | 590 | DB | 0 | ;6 TO 14 |
| 2D6F | 00 | 591 | DB | 0 | ;6 TO 15 |
| 2D70 | 45 | 592 | DB | 69 | ;7 TO 0 |
| 2D71 | 34 | 593 | DB | 52 | ;7 TO 1 |
| 2D72 | 23 | 594 | DB | 35 | ;7 TO 2 |
| 2D73 | 57 | 595 | DB | 87 | ;7 TO 3 |
| 2D74 | 2E | 596 | DB | 46 | ;7 TO 4 |
| 2D75 | 23 | 597 | DB | 35 | ;7 TO 5 |

ISIS-II 8080/8085 MACRO ASSEMBLER, V3.0 SPTB
WMATA SPEED REGULATION ROUTINE TABLES

| LOC | OBJ | LINE | SOURCE STATEMENT | | |
|---|---|---|---|---|---|
| 2D76 | 0A | 598 | DB | 10 | ;7 TO 6 |
| 2D77 | 00 | 599 | DB | 0 | ;7 TO 7 |
| 2D78 | 0A | 600 | DB | 10 | ;7 TO 8 |
| 2D79 | 56 | 601 | DB | 86 | ;7 TO 9 |
| 2D7A | 6E | 602 | DB | 110 | ;7 TO 10 |
| 2D7B | 72 | 603 | DB | 114 | ;7 TO 11 |
| 2D7C | 77 | 604 | DB | 119 | ;7 TO 12 |
| 2D7D | 89 | 605 | DB | 137 | ;7 TO 13 |
| 2D7E | 00 | 606 | DB | 0 | ;7 TO 14 |
| 2D7F | 00 | 607 | DB | 0 | ;7 TO 15 |
| 2D80 | 45 | 608 | DB | 69 | ;8 TO 0 |
| 2D81 | 34 | 609 | DB | 52 | ;8 TO 1 |
| 2D82 | 23 | 610 | DB | 35 | ;8 TO 2 |
| 2D83 | 23 | 611 | DB | 35 | ;8 TO 3 |
| 2D84 | 27 | 612 | DB | 39 | ;8 TO 4 |
| 2D85 | 23 | 613 | DB | 35 | ;8 TO 5 |
| 2D86 | 10 | 614 | DB | 16 | ;8 TO 6 |
| 2D87 | 0A | 615 | DB | 10 | ;8 TO 7 |
| 2D88 | 00 | 616 | DB | 0 | ;8 TO 8 |
| 2D89 | 56 | 617 | DB | 86 | ;8 TO 9 |
| 2D8A | 6E | 618 | DB | 110 | ;8 TO 10 |
| 2D8B | 72 | 619 | DB | 114 | ;8 TO 11 |
| 2D8C | 77 | 620 | DB | 119 | ;8 TO 12 |
| 2D8D | 89 | 621 | DB | 137 | ;8 TO 13 |
| 2D8E | 00 | 622 | DB | 0 | ;8 TO 14 |
| 2D8F | 00 | 623 | DB | 0 | ;8 TO 15 |
| 2D90 | 13 | 624 | DB | 19 | ;9 TO 0 |
| 2D91 | 23 | 625 | DB | 35 | ;9 TO 1 |
| 2D92 | 34 | 626 | DB | 52 | ;9 TO 2 |
| 2D93 | 34 | 627 | DB | 52 | ;9 TO 3 |
| 2D94 | 34 | 628 | DB | 52 | ;9 TO 4 |
| 2D95 | 34 | 629 | DB | 52 | ;9 TO 5 |
| 2D96 | 56 | 630 | DB | 86 | ;9 TO 6 |
| 2D97 | 56 | 631 | DB | 86 | ;9 TO 7 |
| 2D98 | 56 | 632 | DB | 86 | ;9 TO 8 |
| 2D99 | 00 | 633 | DB | 0 | ;9 TO 9 |
| 2D9A | 18 | 634 | DB | 24 | ;9 TO 10 |
| 2D9B | 1D | 635 | DB | 29 | ;9 TO 11 |
| 2D9C | 21 | 636 | DB | 33 | ;9 TO 12 |
| 2D9D | 34 | 637 | DB | 52 | ;9 TO 13 |
| 2D9E | 00 | 638 | DB | 0 | ;9 TO 14 |
| 2D9F | 00 | 639 | DB | 0 | ;9 TO 15 |
| 2DA0 | 29 | 640 | DB | 41 | ;10 TO 0 |
| 2DA1 | 3A | 641 | DB | 58 | ;10 TO 1 |
| 2DA2 | 4B | 642 | DB | 75 | ;10 TO 2 |
| 2DA3 | 4B | 643 | DB | 75 | ;10 TO 3 |
| 2DA4 | 4B | 644 | DB | 75 | ;10 TO 4 |
| 2DA5 | 4B | 645 | DB | 75 | ;10 TO 5 |
| 2DA6 | 6E | 646 | DB | 110 | ;10 TO 6 |
| 2DA7 | 6E | 647 | DB | 110 | ;10 TO 7 |
| 2DA8 | 6E | 648 | DB | 110 | ;10 TO 8 |
| 2DA9 | 18 | 649 | DB | 24 | ;10 TO 9 |
| 2DAA | 00 | 650 | DB | 0 | ;10 TO 10 |
| 2DAB | 0A | 651 | DB | 10 | ;10 TO 11 |
| 2DAC | 17 | 652 | DB | 23 | ;10 TO 12 |
| 2DAD | 1C | 653 | DB | 28 | ;10 TO 13 |
| 2DAE | 00 | 654 | DB | 0 | ;10 TO 14 |
| 2DAF | 00 | 655 | DB | 0 | ;10 TO 15 |
| 2DB0 | 2E | 656 | DB | 46 | ;11 TO 0 |
| 2DB1 | 3F | 657 | DB | 63 | ;11 TO 1 |
| 2DB2 | 50 | 658 | DB | 80 | ;11 TO 2 |
| 2DB3 | 50 | 659 | DB | 80 | ;11 TO 3 |
| 2DB4 | 50 | 660 | DB | 80 | ;11 TO 4 |
| 2DB5 | 50 | 661 | DB | 80 | ;11 TO 5 |
| 2DB6 | 72 | 662 | DB | 114 | ;11 TO 6 |
| 2DB7 | 72 | 663 | DB | 114 | ;11 TO 7 |
| 2DB8 | 72 | 664 | DB | 114 | ;11 TO 8 |
| 2DB9 | 1D | 665 | DB | 29 | ;11 TO 9 |
| 2DBA | 0A | 666 | DB | 10 | ;11 TO 10 |
| 2DBB | 00 | 667 | DB | 0 | ;11 TO 11 |

```
ISIS-II 8080/8085 MACRO ASSEMBLER, V3.0          SPTB
WMATA SPEED REGULATION ROUTINE TABLES

 LOC  OBJ          LINE        SOURCE STATEMENT

 2DBC 0A           668          DB      10      ;11 TO 12
 2DBD 17           669          DB      23      ;11 TO 13
 2DBE 00           670          DB       0      ;11 TO 14
 2DBF 00           671          DB       0      ;11 TO 15
 2DC0 37           672          DB      55      ;12 TO 0
 2DC1 44           673          DB      68      ;12 TO 1
 2DC2 54           674          DB      84      ;12 TO 2
 2DC3 54           675          DB      84      ;12 TO 3
 2DC4 54           676          DB      84      ;12 TO 4
 2DC5 54           677          DB      84      ;12 TO 5
 2DC6 77           678          DB     119      ;12 TO 6
 2DC7 77           679          DB     119      ;12 TO 7
 2DC8 77           680          DB     119      ;12 TO 8
 2DC9 21           681          DB      33      ;12 TO 9
 2DCA 17           682          DB      23      ;12 TO 10
 2DCB 0A           683          DB      10      ;12 TO 11
 2DCC 00           684          DB       0      ;12 TO 12
 2DCD 13           685          DB      19      ;12 TO 13
 2DCE 00           686          DB       0      ;12 TO 14
 2DCF 00           687          DB       0      ;12 TO 15
 2DD0 45           688          DB      69      ;13 TO 0
 2DD1 56           689          DB      86      ;13 TO 1
 2DD2 66           690          DB     102      ;13 TO 2
 2DD3 66           691          DB     102      ;13 TO 3
 2DD4 66           692          DB     102      ;13 TO 4
 2DD5 66           693          DB     102      ;13 TO 5
 2DD6 89           694          DB     137      ;13 TO 6
 2DD7 89           695          DB     137      ;13 TO 7
 2DD8 89           696          DB     137      ;13 TO 8
 2DD9 34           697          DB      52      ;13 TO 9
 2DDA 1C           698          DB      28      ;13 TO 10
 2DDB 17           699          DB      23      ;13 TO 11
 2DDC 13           700          DB      19      ;13 TO 12
 2DDD 00           701          DB       0      ;13 TO 13
 2DDE 00           702          DB       0      ;13 TO 14
 2DDF 00           703          DB       0      ;13 TO 15
                   704 $EJECT
                   705 ;DELAY MATRIX FOR SPEEDS GREATER THAN 23 MPH
                   706 ;      AND LESS THAN 50 MPH. DELAYS ARE NUMBER
                   707 ;      OF 20 MSEC TO COUNT DOWN.
 2E00              708          ORG     TAB23
 2E00 00           709          DB       0      ;0 TO 0
 2E01 25           710          DB      37      ;0 TO 1
 2E02 28           711          DB      40      ;0 TO 2
 2E03 23           712          DB      35      ;0 TO 3
 2E04 23           713          DB      35      ;0 TO 4
 2E05 30           714          DB      48      ;0 TO 5
 2E06 45           715          DB      69      ;0 TO 6
 2E07 45           716          DB      69      ;0 TO 7
 2E08 45           717          DB      69      ;0 TO 8
 2E09 13           718          DB      19      ;0 TO 9
 2E0A 29           719          DB      41      ;0 TO 10
 2E0B 2E           720          DB      46      ;0 TO 11
 2E0C 37           721          DB      55      ;0 TO 12
 2E0D 45           722          DB      69      ;0 TO 13
 2E0E 00           723          DB       0      ;0 TO 14
 2E0F 00           724          DB       0      ;0 TO 15
 2E10 25           725          DB      37      ;1 TO 0
 2E11 00           726          DB      00      ;1 TO 1
 2E12 22           727          DB      34      ;1 TO 2
 2E13 12           728          DB      18      ;1 TO 3
 2E14 12           729          DB      18      ;1 TO 4
 2E15 12           730          DB      18      ;1 TO 5
 2E16 34           731          DB      52      ;1 TO 6
 2E17 34           732          DB      52      ;1 TO 7
 2E18 34           733          DB      52      ;1 TO 8
 2E19 27           734          DB      39      ;1 TO 9
 2E1A 3F           735          DB      63      ;1 TO 10
 2E1B 44           736          DB      68      ;1 TO 11
 2E1C 48           737          DB      72      ;1 TO 12
```

ISIS-II 8080/8085 MACRO ASSEMBLER, V3.0 SPTB
WMATA SPEED REGULATION ROUTINE TABLES

| LOC | OBJ | LINE | SOURCE STATEMENT | | |
|---|---|---|---|---|---|
| 2E1D | 5A | 738 | DB | 90 | ;1 TO 13 |
| 2E1E | 00 | 739 | DB | 0 | ;1 TO 14 |
| 2E1F | 00 | 740 | DB | 0 | ;1 TO 15 |
| 2E20 | 28 | 741 | DB | 40 | ;2 TO 0 |
| 2E21 | 22 | 742 | DB | 34 | ;2 TO 1 |
| 2E22 | 00 | 743 | DB | 0 | ;2 TO 2 |
| 2E23 | 0A | 744 | DB | 10 | ;2 TO 3 |
| 2E24 | 0C | 745 | DB | 12 | ;2 TO 4 |
| 2E25 | 15 | 746 | DB | 21 | ;2 TO 5 |
| 2E26 | 35 | 747 | DB | 53 | ;2 TO 6 |
| 2E27 | 2F | 748 | DB | 47 | ;2 TO 7 |
| 2E28 | 28 | 749 | DB | 40 | ;2 TO 8 |
| 2E29 | 34 | 750 | DB | 52 | ;2 TO 9 |
| 2E2A | 4B | 751 | DB | 75 | ;2 TO 10 |
| 2E2B | 50 | 752 | DB | 80 | ;2 TO 11 |
| 2E2C | 55 | 753 | DB | 85 | ;2 TO 12 |
| 2E2D | 67 | 754 | DB | 103 | ;2 TO 13 |
| 2E2E | 00 | 755 | DB | 0 | ;2 TO 14 |
| 2E2F | 00 | 756 | DB | 0 | ;2 TO 15 |
| 2E30 | 23 | 757 | DB | 35 | ;3 TO 0 |
| 2E31 | 12 | 758 | DB | 18 | ;3 TO 1 |
| 2E32 | 0A | 759 | DB | 10 | ;3 TO 2 |
| 2E33 | 00 | 760 | DB | 0 | ;3 TO 3 |
| 2E34 | 14 | 761 | DB | 20 | ;3 TO 4 |
| 2E35 | 17 | 762 | DB | 23 | ;3 TO 5 |
| 2E36 | 30 | 763 | DB | 48 | ;3 TO 6 |
| 2E37 | 31 | 764 | DB | 49 | ;3 TO 7 |
| 2E38 | 2A | 765 | DB | 42 | ;3 TO 8 |
| 2E39 | 34 | 766 | DB | 52 | ;3 TO 9 |
| 2E3A | 4B | 767 | DB | 75 | ;3 TO 10 |
| 2E3B | 50 | 768 | DB | 80 | ;3 TO 11 |
| 2E3C | 55 | 769 | DB | 85 | ;3 TO 12 |
| 2E3D | 67 | 770 | DB | 103 | ;3 TO 13 |
| 2E3E | 00 | 771 | DB | 0 | ;3 TO 14 |
| 2E3F | 00 | 772 | DB | 0 | ;3 TO 15 |
| 2E40 | 23 | 773 | DB | 35 | ;4 TO 0 |
| 2E41 | 12 | 774 | DB | 18 | ;4 TO 1 |
| 2E42 | 0C | 775 | DB | 12 | ;4 TO 2 |
| 2E43 | 14 | 776 | DB | 20 | ;4 TO 3 |
| 2E44 | 00 | 777 | DB | 0 | ;4 TO 4 |
| 2E45 | 13 | 778 | DB | 19 | ;4 TO 5 |
| 2E46 | 37 | 779 | DB | 55 | ;4 TO 6 |
| 2E47 | 2E | 780 | DB | 46 | ;4 TO 7 |
| 2E48 | 27 | 781 | DB | 39 | ;4 TO 8 |
| 2E49 | 34 | 782 | DB | 52 | ;4 TO 9 |
| 2E4A | 4B | 783 | DB | 75 | ;4 TO 10 |
| 2E4B | 50 | 784 | DB | 80 | ;4 TO 11 |
| 2E4C | 55 | 785 | DB | 85 | ;4 TO 12 |
| 2E4D | 67 | 786 | DB | 103 | ;4 TO 13 |
| 2E4E | 00 | 787 | DB | 0 | ;4 TO 14 |
| 2E4F | 00 | 788 | DB | 0 | ;4 TO 15 |
| 2E50 | 30 | 789 | DB | 48 | ;5 TO 0 |
| 2E51 | 12 | 790 | DB | 18 | ;5 TO 1 |
| 2E52 | 15 | 791 | DB | 21 | ;5 TO 2 |
| 2E53 | 17 | 792 | DB | 23 | ;5 TO 3 |
| 2E54 | 13 | 793 | DB | 19 | ;5 TO 4 |
| 2E55 | 00 | 794 | DB | 0 | ;5 TO 5 |
| 2E56 | 25 | 795 | DB | 37 | ;5 TO 6 |
| 2E57 | 23 | 796 | DB | 35 | ;5 TO 7 |
| 2E58 | 23 | 797 | DB | 35 | ;5 TO 8 |
| 2E59 | 34 | 798 | DB | 52 | ;5 TO 9 |
| 2E5A | 4B | 799 | DB | 75 | ;5 TO 10 |
| 2E5B | 50 | 800 | DB | 80 | ;5 TO 11 |
| 2E5C | 55 | 801 | DB | 85 | ;5 TO 12 |
| 2E5D | 67 | 802 | DB | 103 | ;5 TO 13 |
| 2E5E | 00 | 803 | DB | 0 | ;5 TO 14 |
| 2E5F | 00 | 804 | DB | 0 | ;5 TO 15 |
| 2E60 | 45 | 805 | DB | 69 | ;6 TO 0 |
| 2E61 | 34 | 806 | DB | 52 | ;6 TO 1 |
| 2E62 | 35 | 807 | DB | 53 | ;6 TO 2 |
| 2E63 | 30 | 808 | DB | 48 | ;6 TO 3 |

ISIS-II 8080/8085 MACRO ASSEMBLER, V3.0 SPTB
WMATA SPEED REGULATION ROUTINE TABLES

| LOC | OBJ | LINE | SOURCE STATEMENT | | |
|---|---|---|---|---|---|
| 2E64 | 37 | 809 | DB | 55 | ;6 TO 4 |
| 2E65 | 25 | 810 | DB | 37 | ;6 TO 5 |
| 2E66 | 00 | 811 | DB | 0 | ;6 TO 6 |
| 2E67 | 14 | 812 | DB | 20 | ;6 TO 7 |
| 2E68 | 10 | 813 | DB | 16 | ;6 TO 8 |
| 2E69 | 56 | 814 | DB | 86 | ;6 TO 9 |
| 2E6A | 6E | 815 | DB | 110 | ;6 TO 10 |
| 2E6B | 72 | 816 | DB | 114 | ;6 TO 11 |
| 2E6C | 77 | 817 | DB | 119 | ;6 TO 12 |
| 2E6D | 89 | 818 | DB | 137 | ;6 TO 13 |
| 2E6E | 00 | 819 | DB | 0 | ;6 TO 14 |
| 2E6F | 00 | 820 | DB | 0 | ;6 TO 15 |
| 2E70 | 45 | 821 | DB | 69 | ;7 TO 0 |
| 2E71 | 34 | 822 | DB | 52 | ;7 TO 1 |
| 2E72 | 2F | 823 | DB | 47 | ;7 TO 2 |
| 2E73 | 2E | 824 | DB | 46 | ;7 TO 3 |
| 2E74 | 23 | 825 | DB | 35 | ;7 TO 4 |
| 2E75 | 14 | 826 | DB | 20 | ;7 TO 5 |
| 2E76 | 19 | 827 | DB | 25 | ;7 TO 6 |
| 2E77 | 00 | 828 | DB | 0 | ;7 TO 7 |
| 2E78 | 0A | 829 | DB | 10 | ;7 TO 8 |
| 2E79 | 56 | 830 | DB | 86 | ;7 TO 9 |
| 2E7A | 6E | 831 | DB | 110 | ;7 TO 10 |
| 2E7B | 72 | 832 | DB | 114 | ;7 TO 11 |
| 2E7C | 77 | 833 | DB | 119 | ;7 TO 12 |
| 2E7D | 89 | 834 | DB | 137 | ;7 TO 13 |
| 2E7E | 00 | 835 | DB | 0 | ;7 TO 14 |
| 2E7F | 00 | 836 | DB | 0 | ;7 TO 15 |
| 2E80 | 45 | 837 | DB | 69 | ;8 TO 0 |
| 2E81 | 34 | 838 | DB | 52 | ;8 TO 1 |
| 2E82 | 28 | 839 | DB | 40 | ;8 TO 2 |
| 2E83 | 2A | 840 | DB | 42 | ;8 TO 3 |
| 2E84 | 27 | 841 | DB | 39 | ;8 TO 4 |
| 2E85 | 23 | 842 | DB | 35 | ;8 TO 5 |
| 2E86 | 10 | 843 | DB | 16 | ;8 TO 6 |
| 2E87 | 0A | 844 | DB | 10 | ;8 TO 7 |
| 2E88 | 00 | 845 | DB | 0 | ;8 TO 8 |
| 2E89 | 56 | 846 | DB | 86 | ;8 TO 9 |
| 2E8A | 6E | 847 | DB | 110 | ;8 TO 10 |
| 2E8B | 72 | 848 | DB | 114 | ;8 TO 11 |
| 2E8C | 77 | 849 | DB | 119 | ;8 TO 12 |
| 2E8D | 89 | 850 | DB | 137 | ;8 TO 13 |
| 2E8E | 00 | 851 | DB | 0 | ;8 TO 14 |
| 2E8F | 00 | 852 | DB | 0 | ;8 TO 15 |
| 2E90 | 13 | 853 | DB | 19 | ;9 TO 0 |
| 2E91 | 27 | 854 | DB | 39 | ;9 TO 1 |
| 2E92 | 34 | 855 | DB | 52 | ;9 TO 2 |
| 2E93 | 34 | 856 | DB | 52 | ;9 TO 3 |
| 2E94 | 34 | 857 | DB | 52 | ;9 TO 4 |
| 2E95 | 34 | 858 | DB | 52 | ;9 TO 5 |
| 2E96 | 56 | 859 | DB | 86 | ;9 TO 6 |
| 2E97 | 56 | 860 | DB | 86 | ;9 TO 7 |
| 2E98 | 56 | 861 | DB | 86 | ;9 TO 8 |
| 2E99 | 00 | 862 | DB | 0 | ;9 TO 9 |
| 2E9A | 18 | 863 | DB | 24 | ;9 TO 10 |
| 2E9B | 1D | 864 | DB | 29 | ;9 TO 11 |
| 2E9C | 21 | 865 | DB | 33 | ;9 TO 12 |
| 2E9D | 34 | 866 | DB | 52 | ;9 TO 13 |
| 2E9E | 00 | 867 | DB | 0 | ;9 TO 14 |
| 2E9F | 00 | 868 | DB | 0 | ;9 TO 15 |
| 2EA0 | 29 | 869 | DB | 41 | ;10 TO 0 |
| 2EA1 | 3F | 870 | DB | 63 | ;10 TO 1 |
| 2EA2 | 4B | 871 | DB | 75 | ;10 TO 2 |
| 2EA3 | 4B | 872 | DB | 75 | ;10 TO 3 |
| 2EA4 | 4B | 873 | DB | 75 | ;10 TO 4 |
| 2EA5 | 4B | 874 | DB | 75 | ;10 TO 5 |
| 2EA6 | 6E | 875 | DB | 110 | ;10 TO 6 |
| 2EA7 | 6E | 876 | DB | 110 | ;10 TO 7 |
| 2EA8 | 6E | 877 | DB | 110 | ;10 TO 8 |
| 2EA9 | 18 | 878 | DB | 24 | ;10 TO 9 |

```
ISIS-II 8080/8085 MACRO ASSEMBLER, V3.0          SPTB      PAGE    23
WMATA SPEED REGULATION ROUTINE TABLES

 LOC  OBJ          LINE        SOURCE STATEMENT

 2EAA 00           879         DB      0        ;10 TO 10
 2EAB 0A           880         DB      10       ;10 TO 11
 2EAC 17           881         DB      23       ;10 TO 12
 2EAD 1C           882         DB      28       ;10 TO 13
 2EAE 00           883         DB      0        ;10 TO 14
 2EAF 00           884         DB      0        ;10 TO 15
 2EB0 2E           885         DB      46       ;11 TO 0
 2EB1 44           886         DB      68       ;11 TO 1
 2EB2 50           887         DB      80       ;11 TO 2
 2EB3 50           888         DB      80       ;11 TO 3
 2EB4 50           889         DB      80       ;11 TO 4
 2EB5 50           890         DB      80       ;11 TO 5
 2EB6 72           891         DB      114      ;11 TO 6
 2EB7 72           892         DB      114      ;11 TO 7
 2EB8 72           893         DB      114      ;11 TO 8
 2EB9 1D           894         DB      29       ;11 TO 9
 2EBA 0A           895         DB      10       ;11 TO 10
 2EBB 00           896         DB      0        ;11 TO 11
 2EBC 0A           897         DB      10       ;11 TO 12
 2EBD 17           898         DB      23       ;11 TO 13
 2EBE 00           899         DB      0        ;11 TO 14
 2EBF 00           900         DB      0        ;11 TO 15
 2EC0 37           901         DB      55       ;12 TO 0
 2EC1 48           902         DB      72       ;12 TO 1
 2EC2 55           903         DB      85       ;12 TO 2
 2EC3 55           904         DB      85       ;12 TO 3
 2EC4 55           905         DB      85       ;12 TO 4
 2EC5 55           906         DB      85       ;12 TO 5
 2EC6 77           907         DB      119      ;12 TO 6
 2EC7 77           908         DB      119      ;12 TO 7
 2EC8 77           909         DB      119      ;12 TO 8
 2EC9 21           910         DB      33       ;12 TO 9
 2ECA 17           911         DB      23       ;12 TO 10
 2ECB 0A           912         DB      10       ;12 TO 11
 2ECC 00           913         DB      0        ;12 TO 12
 2ECD 13           914         DB      19       ;12 TO 13
 2ECE 00           915         DB      0        ;12 TO 14
 2ECF 00           916         DB      0        ;12 TO 15
 2ED0 45           917         DB      69       ;13 TO 0
 2ED1 5A           918         DB      90       ;13 TO 1
 2ED2 67           919         DB      103      ;13 TO 2
 2ED3 67           920         DB      103      ;13 TO 3
 2ED4 67           921         DB      103      ;13 TO 4
 2ED5 67           922         DB      103      ;13 TO 5
 2ED6 89           923         DB      137      ;13 TO 6
 2ED7 89           924         DB      137      ;13 TO 7
 2ED8 89           925         DB      137      ;13 TO 8
 2ED9 34           926         DB      52       ;13 TO 9
 2EDA 1C           927         DB      28       ;13 TO 10
 2EDB 17           928         DB      23       ;13 TO 11
 2EDC 13           929         DB      19       ;13 TO 12
 2EDD 00           930         DB      0        ;13 TO 13
 2EDE 00           931         DB      0        ;13 TO 14
 2EDF 00           932         DB      0        ;13 TO 15
                   933 $EJECT
                   934 ;DELAY MATRIX FOR SPEEDS GREATER THAN 50 MPH.
                   935 ;DELAYS ARE NUMBER OF 20 MSEC TO COUNT DOWN.
 2F00              936         ORG     TA850
 2F00 00           937         DB      0        ;0 TO 0
 2F01 0F           938         DB      15       ;0 TO 1
 2F02 0B           939         DB      11       ;0 TO 2
 2F03 0A           940         DB      10       ;0 TO 3
 2F04 0A           941         DB      10       ;0 TO 4
 2F05 12           942         DB      18       ;0 TO 5
 2F06 19           943         DB      25       ;0 TO 6
 2F07 23           944         DB      35       ;0 TO 7
 2F08 2C           945         DB      44       ;0 TO 8
 2F09 13           946         DB      19       ;0 TO 9
 2F0A 29           947         DB      41       ;0 TO 10
 2F0B 2E           948         DB      46       ;0 TO 11
```

ISIS-II 8080/8085 MACRO ASSEMBLER, V3.0 SPTB
WMATA SPEED REGULATION ROUTINE TABLES

| LOC | OBJ | LINE | SOURCE STATEMENT | | |
|---|---|---|---|---|---|
| 2F0C | 37 | 949 | DB | 55 | ;0 TO 12 |
| 2F0D | 45 | 950 | DB | 69 | ;0 TO 13 |
| 2F0E | 00 | 951 | DB | 0 | ;0 TO 14 |
| 2F0F | 00 | 952 | DB | 0 | ;0 TO 15 |
| 2F10 | 0F | 953 | DB | 15 | ;1 TO 0 |
| 2F11 | 00 | 954 | DB | 00 | ;1 TO 1 |
| 2F12 | 0F | 955 | DB | 15 | ;1 TO 2 |
| 2F13 | 0A | 956 | DB | 10 | ;1 TO 3 |
| 2F14 | 0E | 957 | DB | 14 | ;1 TO 4 |
| 2F15 | 0A | 958 | DB | 10 | ;1 TO 5 |
| 2F16 | 0A | 959 | DB | 10 | ;1 TO 6 |
| 2F17 | 15 | 960 | DB | 21 | ;1 TO 7 |
| 2F18 | 1D | 961 | DB | 29 | ;1 TO 8 |
| 2F19 | 20 | 962 | DB | 32 | ;1 TO 9 |
| 2F1A | 38 | 963 | DB | 56 | ;1 TO 10 |
| 2F1B | 3C | 964 | DB | 60 | ;1 TO 11 |
| 2F1C | 41 | 965 | DB | 65 | ;1 TO 12 |
| 2F1D | 53 | 966 | DB | 83 | ;1 TO 13 |
| 2F1E | 00 | 967 | DB | 0 | ;1 TO 14 |
| 2F1F | 00 | 968 | DB | 0 | ;1 TO 15 |
| 2F20 | 0B | 969 | DB | 11 | ;2 TO 0 |
| 2F21 | 0F | 970 | DB | 15 | ;2 TO 1 |
| 2F22 | 00 | 971 | DB | 0 | ;2 TO 2 |
| 2F23 | 0A | 972 | DB | 10 | ;2 TO 3 |
| 2F24 | 0A | 973 | DB | 10 | ;2 TO 4 |
| 2F25 | 0A | 974 | DB | 10 | ;2 TO 5 |
| 2F26 | 0E | 975 | DB | 14 | ;2 TO 6 |
| 2F27 | 19 | 976 | DB | 25 | ;2 TO 7 |
| 2F28 | 22 | 977 | DB | 34 | ;2 TO 8 |
| 2F29 | 1C | 978 | DB | 28 | ;2 TO 9 |
| 2F2A | 34 | 979 | DB | 52 | ;2 TO 10 |
| 2F2B | 38 | 980 | DB | 56 | ;2 TO 11 |
| 2F2C | 3D | 981 | DB | 61 | ;2 TO 12 |
| 2F2D | 4F | 982 | DB | 79 | ;2 TO 13 |
| 2F2E | 00 | 983 | DB | 0 | ;2 TO 14 |
| 2F2F | 00 | 984 | DB | 0 | ;2 TO 15 |
| 2F30 | 0A | 985 | DB | 10 | ;3 TO 0 |
| 2F31 | 0A | 986 | DB | 10 | ;3 TO 1 |
| 2F32 | 0A | 987 | DB | 10 | ;3 TO 2 |
| 2F33 | 00 | 988 | DB | 0 | ;3 TO 3 |
| 2F34 | 0A | 989 | DB | 10 | ;3 TO 4 |
| 2F35 | 0C | 990 | DB | 12 | ;3 TO 5 |
| 2F36 | 13 | 991 | DB | 19 | ;3 TO 6 |
| 2F37 | 1E | 992 | DB | 30 | ;3 TO 7 |
| 2F38 | 26 | 993 | DB | 38 | ;3 TO 8 |
| 2F39 | 17 | 994 | DB | 23 | ;3 TO 9 |
| 2F3A | 2F | 995 | DB | 47 | ;3 TO 10 |
| 2F3B | 33 | 996 | DB | 51 | ;3 TO 11 |
| 2F3C | 38 | 997 | DB | 56 | ;3 TO 12 |
| 2F3D | 4A | 998 | DB | 74 | ;3 TO 13 |
| 2F3E | 00 | 999 | DB | 0 | ;3 TO 14 |
| 2F3F | 00 | 1000 | DB | 0 | ;3 TO 15 |
| 2F40 | 0A | 1001 | DB | 10 | ;4 TO 0 |
| 2F41 | 0E | 1002 | DB | 14 | ;4 TO 1 |
| 2F42 | 0A | 1003 | DB | 10 | ;4 TO 2 |
| 2F43 | 0A | 1004 | DB | 10 | ;4 TO 3 |
| 2F44 | 00 | 1005 | DB | 0 | ;4 TO 4 |
| 2F45 | 0E | 1006 | DB | 14 | ;4 TO 5 |
| 2F46 | 14 | 1007 | DB | 20 | ;4 TO 6 |
| 2F47 | 1F | 1008 | DB | 31 | ;4 TO 7 |
| 2F48 | 27 | 1009 | DB | 39 | ;4 TO 8 |
| 2F49 | 16 | 1010 | DB | 22 | ;4 TO 9 |
| 2F4A | 2E | 1011 | DB | 46 | ;4 TO 10 |
| 2F4B | 32 | 1012 | DB | 50 | ;4 TO 11 |
| 2F4C | 37 | 1013 | DB | 55 | ;4 TO 12 |
| 2F4D | 49 | 1014 | DB | 73 | ;4 TO 13 |
| 2F4E | 00 | 1015 | DB | 0 | ;4 TO 14 |
| 2F4F | 00 | 1016 | DB | 0 | ;4 TO 15 |
| 2F50 | 12 | 1017 | DB | 18 | ;5 TO 0 |
| 2F51 | 0A | 1018 | DB | 10 | ;5 TO 1 |

ISIS-II 8080/8085 MACRO ASSEMBLER, V3.0 SPTB
WMATA SPEED REGULATION ROUTINE TABLES

| LOC | OBJ | LINE | SOURCE STATEMENT | | |
|---|---|---|---|---|---|
| 2F52 | 0A | 1019 | DB | 10 | ;5 TO 2 |
| 2F53 | 0C | 1020 | DB | 12 | ;5 TO 3 |
| 2F54 | 0E | 1021 | DB | 14 | ;5 TO 4 |
| 2F55 | 00 | 1022 | DB | 0 | ;5 TO 5 |
| 2F56 | 0A | 1023 | DB | 10 | ;5 TO 6 |
| 2F57 | 12 | 1024 | DB | 18 | ;5 TO 7 |
| 2F58 | 1A | 1025 | DB | 26 | ;5 TO 8 |
| 2F59 | 23 | 1026 | DB | 35 | ;5 TO 9 |
| 2F5A | 3B | 1027 | DB | 59 | ;5 TO 10 |
| 2F5B | 3F | 1028 | DB | 63 | ;5 TO 11 |
| 2F5C | 44 | 1029 | DB | 68 | ;5 TO 12 |
| 2F5D | 56 | 1030 | DB | 86 | ;5 TO 13 |
| 2F5E | 00 | 1031 | DB | 0 | ;5 TO 14 |
| 2F5F | 00 | 1032 | DB | 0 | ;5 TO 15 |
| 2F60 | 19 | 1033 | DB | 25 | ;6 TO 0 |
| 2F61 | 0A | 1034 | DB | 10 | ;6 TO 1 |
| 2F62 | 0E | 1035 | DB | 14 | ;6 TO 2 |
| 2F63 | 13 | 1036 | DB | 19 | ;6 TO 3 |
| 2F64 | 14 | 1037 | DB | 20 | ;6 TO 4 |
| 2F65 | 0A | 1038 | DB | 10 | ;6 TO 5 |
| 2F66 | 00 | 1039 | DB | 0 | ;6 TO 6 |
| 2F67 | 0B | 1040 | DB | 11 | ;6 TO 7 |
| 2F68 | 14 | 1041 | DB | 20 | ;6 TO 8 |
| 2F69 | 2A | 1042 | DB | 42 | ;6 TO 9 |
| 2F6A | 42 | 1043 | DB | 66 | ;6 TO 10 |
| 2F6B | 46 | 1044 | DB | 70 | ;6 TO 11 |
| 2F6C | 4B | 1045 | DB | 75 | ;6 TO 12 |
| 2F6D | 5D | 1046 | DB | 93 | ;6 TO 13 |
| 2F6E | 00 | 1047 | DB | 0 | ;6 TO 14 |
| 2F6F | 00 | 1048 | DB | 0 | ;6 TO 15 |
| 2F70 | 23 | 1049 | DB | 35 | ;7 TO 0 |
| 2F71 | 15 | 1050 | DB | 21 | ;7 TO 1 |
| 2F72 | 19 | 1051 | DB | 25 | ;7 TO 2 |
| 2F73 | 1E | 1052 | DB | 30 | ;7 TO 3 |
| 2F74 | 1F | 1053 | DB | 31 | ;7 TO 4 |
| 2F75 | 12 | 1054 | DB | 18 | ;7 TO 5 |
| 2F76 | 0B | 1055 | DB | 11 | ;7 TO 6 |
| 2F77 | 00 | 1056 | DB | 0 | ;7 TO 7 |
| 2F78 | 0B | 1057 | DB | 11 | ;7 TO 8 |
| 2F79 | 34 | 1058 | DB | 52 | ;7 TO 9 |
| 2F7A | 4C | 1059 | DB | 76 | ;7 TO 10 |
| 2F7B | 51 | 1060 | DB | 81 | ;7 TO 11 |
| 2F7C | 55 | 1061 | DB | 85 | ;7 TO 12 |
| 2F7D | 67 | 1062 | DB | 103 | ;7 TO 13 |
| 2F7E | 00 | 1063 | DB | 0 | ;7 TO 14 |
| 2F7F | 00 | 1064 | DB | 0 | ;7 TO 15 |
| 2F80 | 2C | 1065 | DB | 44 | ;8 TO 0 |
| 2F81 | 1D | 1066 | DB | 29 | ;8 TO 1 |
| 2F82 | 22 | 1067 | DB | 34 | ;8 TO 2 |
| 2F83 | 26 | 1068 | DB | 38 | ;8 TO 3 |
| 2F84 | 27 | 1069 | DB | 39 | ;8 TO 4 |
| 2F85 | 1A | 1070 | DB | 26 | ;8 TO 5 |
| 2F86 | 14 | 1071 | DB | 20 | ;8 TO 6 |
| 2F87 | 0B | 1072 | DB | 11 | ;8 TO 7 |
| 2F88 | 00 | 1073 | DB | 0 | ;8 TO 8 |
| 2F89 | 3D | 1074 | DB | 61 | ;8 TO 9 |
| 2F8A | 54 | 1075 | DB | 84 | ;8 TO 10 |
| 2F8B | 59 | 1076 | DB | 89 | ;8 TO 11 |
| 2F8C | 5E | 1077 | DB | 94 | ;8 TO 12 |
| 2F8D | 70 | 1078 | DB | 112 | ;8 TO 13 |
| 2F8E | 00 | 1079 | DB | 0 | ;8 TO 14 |
| 2F8F | 00 | 1080 | DB | 0 | ;8 TO 15 |
| 2F90 | 13 | 1081 | DB | 19 | ;9 TO 0 |
| 2F91 | 20 | 1082 | DB | 32 | ;9 TO 1 |
| 2F92 | 1C | 1083 | DB | 28 | ;9 TO 2 |
| 2F93 | 17 | 1084 | DB | 23 | ;9 TO 3 |
| 2F94 | 16 | 1085 | DB | 22 | ;9 TO 4 |
| 2F95 | 23 | 1086 | DB | 35 | ;9 TO 5 |
| 2F96 | 2A | 1087 | DB | 42 | ;9 TO 6 |
| 2F97 | 34 | 1088 | DB | 52 | ;9 TO 7 |
| 2F98 | 3D | 1089 | DB | 61 | ;9 TO 8 |

ISIS-II 8080/8085 MACRO ASSEMBLER, V3.0 SPTB
WMATA SPEED REGULATION ROUTINE TABLES

| LOC | OBJ | LINE | SOURCE STATEMENT | | |
|---|---|---|---|---|---|
| 2F99 | 00 | 1090 | DB | 0 | ;9 TO 9 |
| 2F9A | 18 | 1091 | DB | 24 | ;9 TO 10 |
| 2F9B | 1D | 1092 | DB | 29 | ;9 TO 11 |
| 2F9C | 21 | 1093 | DB | 33 | ;9 TO 12 |
| 2F9D | 34 | 1094 | DB | 52 | ;9 TO 13 |
| 2F9E | 00 | 1095 | DB | 0 | ;9 TO 14 |
| 2F9F | 00 | 1096 | DB | 0 | ;9 TO 15 |
| 2FA0 | 29 | 1097 | DB | 41 | ;10 TO 0 |
| 2FA1 | 38 | 1098 | DB | 56 | ;10 TO 1 |
| 2FA2 | 34 | 1099 | DB | 52 | ;10 TO 2 |
| 2FA3 | 2F | 1100 | DB | 47 | ;10 TO 3 |
| 2FA4 | 2E | 1101 | DB | 46 | ;10 TO 4 |
| 2FA5 | 3B | 1102 | DB | 59 | ;10 TO 5 |
| 2FA6 | 42 | 1103 | DB | 66 | ;10 TO 6 |
| 2FA7 | 4C | 1104 | DB | 76 | ;10 TO 7 |
| 2FA8 | 54 | 1105 | DB | 84 | ;10 TO 8 |
| 2FA9 | 18 | 1106 | DB | 24 | ;10 TO 9 |
| 2FAA | 00 | 1107 | DB | 0 | ;10 TO 10 |
| 2FAB | 0A | 1108 | DB | 10 | ;10 TO 11 |
| 2FAC | 17 | 1109 | DB | 23 | ;10 TO 12 |
| 2FAD | 1C | 1110 | DB | 28 | ;10 TO 13 |
| 2FAE | 00 | 1111 | DB | 0 | ;10 TO 14 |
| 2FAF | 00 | 1112 | DB | 0 | ;10 TO 15 |
| 2FB0 | 2E | 1113 | DB | 46 | ;11 TO 0 |
| 2FB1 | 3C | 1114 | DB | 60 | ;11 TO 1 |
| 2FB2 | 38 | 1115 | DB | 56 | ;11 TO 2 |
| 2FB3 | 33 | 1116 | DB | 51 | ;11 TO 3 |
| 2FB4 | 32 | 1117 | DB | 50 | ;11 TO 4 |
| 2FB5 | 3F | 1118 | DB | 63 | ;11 TO 5 |
| 2FB6 | 46 | 1119 | DB | 70 | ;11 TO 6 |
| 2FB7 | 51 | 1120 | DB | 81 | ;11 TO 7 |
| 2FB8 | 59 | 1121 | DB | 89 | ;11 TO 8 |
| 2FB9 | 27 | 1122 | DB | 39 | ;11 TO 9 |
| 2FBA | 0A | 1123 | DB | 10 | ;11 TO 10 |
| 2FBB | 00 | 1124 | DB | 0 | ;11 TO 11 |
| 2FBC | 0A | 1125 | DB | 10 | ;11 TO 12 |
| 2FBD | 17 | 1126 | DB | 23 | ;11 TO 13 |
| 2FBE | 00 | 1127 | DB | 0 | ;11 TO 14 |
| 2FBF | 00 | 1128 | DB | 0 | ;11 TO 15 |
| 2FC0 | 37 | 1129 | DB | 55 | ;12 TO 0 |
| 2FC1 | 41 | 1130 | DB | 65 | ;12 TO 1 |
| 2FC2 | 3D | 1131 | DB | 61 | ;12 TO 2 |
| 2FC3 | 38 | 1132 | DB | 56 | ;12 TO 3 |
| 2FC4 | 37 | 1133 | DB | 55 | ;12 TO 4 |
| 2FC5 | 44 | 1134 | DB | 68 | ;12 TO 5 |
| 2FC6 | 4B | 1135 | DB | 75 | ;12 TO 6 |
| 2FC7 | 55 | 1136 | DB | 85 | ;12 TO 7 |
| 2FC8 | 5E | 1137 | DB | 94 | ;12 TO 8 |
| 2FC9 | 21 | 1138 | DB | 33 | ;12 TO 9 |
| 2FCA | 17 | 1139 | DB | 23 | ;12 TO 10 |
| 2FCB | 0A | 1140 | DB | 10 | ;12 TO 11 |
| 2FCC | 00 | 1141 | DB | 0 | ;12 TO 12 |
| 2FCD | 13 | 1142 | DB | 19 | ;12 TO 13 |
| 2FCE | 00 | 1143 | DB | 0 | ;12 TO 14 |
| 2FCF | 00 | 1144 | DB | 0 | ;12 TO 15 |
| 2FD0 | 45 | 1145 | DB | 69 | ;13 TO 0 |
| 2FD1 | 53 | 1146 | DB | 83 | ;13 TO 1 |
| 2FD2 | 4F | 1147 | DB | 79 | ;13 TO 2 |
| 2FD3 | 4A | 1148 | DB | 74 | ;13 TO 3 |
| 2FD4 | 49 | 1149 | DB | 73 | ;13 TO 4 |
| 2FD5 | 56 | 1150 | DB | 86 | ;13 TO 5 |
| 2FD6 | 5D | 1151 | DB | 93 | ;13 TO 6 |
| 2FD7 | 67 | 1152 | DB | 103 | ;13 TO 7 |
| 2FD8 | 70 | 1153 | DB | 112 | ;13 TO 8 |
| 2FD9 | 34 | 1154 | DB | 52 | ;13 TO 9 |
| 2FDA | 1C | 1155 | DB | 28 | ;13 TO 10 |
| 2FDB | 17 | 1156 | DB | 23 | ;13 TO 11 |
| 2FDC | 13 | 1157 | DB | 19 | ;13 TO 12 |
| 2FDD | 00 | 1158 | DB | 0 | ;13 TO 13 |

```
ISIS-II 8080/8085 MACRO ASSEMBLER, V3.0          SPTB
WMATA SPEED REGULATION ROUTINE TABLES

  LOC  OBJ        LINE        SOURCE STATEMENT

  2FDE 00         1159        DB      0       ;13 TO 14
  2FDF 00         1160        DB      0       ;13 TO 15
                  1161 $EJECT
                  1162        END

PUBLIC SYMBOLS

EXTERNAL SYMBOLS

USER SYMBOLS
DACC    A 2C20    PACC    A 2C00    PSAC    A 2C40    PSDC    A 2C60
TAB0    A 2800    TAB00   A 2D00    TAB1    A 2A80    TAB2    A 2AE0
TAB23   A 2E00    TAB3    A 2AF0    TAB50   A 2F00    TLO     A 2C80

ASSEMBLY COMPLETE,   NO ERRORS

ISIS-II ASSEMBLER SYMBOL CROSS REFERENCE, V2.1                PAGE   1

DACC      23#    399
PACC      22#    379
PSAC      24#    418
PSDC      25#    437
SPTB       6
TAB0      16#     37
TAB00     29#    479
TAB1      17#    318
TAB2      18#    361
TAB23     30#    708
TAB3      19#    368
TAB50     31#    936
TLO       26#    457

CROSS REFERENCE COMPLETE
```

We claim:

1. In speed control apparatus for a vehicle including a propulsion motor and reponsive to an input command speed, the combination of:

means responsive to the input command speed for determining a desired operating state for said propulsion motor, means for determining a predetermined speed control band in relation to said command speed, means for determining a first time period in relation to said speed band and in accordance with the speed of the vehicle and the acceleration of the vehicle, means for determining a second time period in accordance with the operating characteristic of said motor and the mass of said vehicle, and means for comparing the first time period with the second time period to determine when a transition of the motor is made to said desired state.

2. The speed control apparatus of claim 1, with said speed control band having a predetermined width between an upper speed limit and a lower speed limit, and with the first time period determining means being operative to determine said first time period in relation to the upper speed limit during positive acceleration of the vehicle.

3. The speed control apparatus of claim 1, with said speed control band having an upper speed limit and a lower speed limit, and with said first time period being determined in relation to the lower speed limit during deceleration of the vehicle.

4. The speed control apparatus of claim 1, including means for determining a permission vector in accordance with the number of times a particular state transition has been provided during a predetermined period of time; and means for selecting the state transition in accordance with said permission vector.

5. The speed control apparatus of claim 1, with the command speed being a speed maintaining speed limit, and with said comparing means being operative to maintain the speed of the vehicle within said speed control band.

6. The speed control apparatus of claim 1, with the command speed being a program stop speed limit, and with said comprising means being operative to decelerate the vehicle in accordance with said speed control band in relation to said program stop speed limit.

7. The method of speed control for a vehicle having a propulsion motor and a present speed and being responsive to a first command speed limit, including the steps of determining desired speed band limits for said vehicle in response to the first command speed limit, determining a first time required for the vehicle speed to change from the present speed to a predetermined one of said speed band limits in relation to the acceleration of the vehicle, determining a second time required for the vehicle tractive effort to change from the present tractive effort to a desired tractive effort in relation to said one speed band limit, a known operational characteristic of said motor and the mass of the vehicle, and comparing the first time with the second time to control a change of the vehicle speed from the present speed to said one speed band limit.

8. The speed control method of claim 7, with the desired speed band limits being determined in relation to a desired speed control band below the input command speed limit, with the first time determination being in relation to the upper speed band limit when the vehicle is accelerating, and with the first time determination being in relation to the lower speed band limit when the vehicle is decelerating.

9. The speed control method of claim 7, with the input command speed limit being a program stop speed limit having a predetermined deceleration rate, and with the first time determination being in relation to the acceleration of the vehicle plus said deceleration rate.

10. The speed control method of claim 7, with the vehicle being responsive to said input command speed limit for speed maintaining and being responsive to a second command speed limit having a predetermined deceleration rate for the program stop control of the vehicle, including determining second desired speed band limits for said vehicle in response to the second command speed limit, determining a third time required for the vehicle speed to change from the present speed to a predetermined one of the second speed band limits in relation to the acceleration of the vehicle plus said deceleration rate, determining a fourth time required for the vehicle tractive effort to change from the present tractive effort to a second desired tractive effort in relation to said one of the second speed band limits, a known operational characteristic of the motor and the mass of the vehicle, comparing the third time with the fourth time to control a second change of the vehicle speed from the present speed to said one of the second speed band limits, and selecting one of the first change and the second change in accordance with a comparison of the first command speed limit with the second command speed limit.

* * * * *